US006739398B1

(12) United States Patent
Yokley et al.

(10) Patent No.: US 6,739,398 B1
(45) Date of Patent: May 25, 2004

(54) LINER HANGER RUNNING TOOL AND METHOD

(75) Inventors: John M. Yokley, Kingwood, TX (US); Larry E. Reimert, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 58 days.

(21) Appl. No.: 10/004,588

(22) Filed: Dec. 4, 2001

Related U.S. Application Data

(60) Provisional application No. 60/292,049, filed on May 18, 2001.

(51) Int. Cl.[7] ..... E21B 23/00
(52) U.S. Cl. ..... 166/382; 166/123; 166/153
(58) Field of Search ..... 166/120, 123, 166/124, 208, 382, 153, 194, 387

(56) References Cited

U.S. PATENT DOCUMENTS 4,281,711 A 8/1981 Braddick et al.

*Primary Examiner*—Frank Tsay
(74) *Attorney, Agent, or Firm*—Loren G. Helmreich; Browning Bushman, P.C.

(57) ABSTRACT

The liner hanger running tool 120 includes improvements to the running tool release mechanism, the packoff bushing, and the packer setting assembly. The release mechanism may be operated hydraulically in response to fluid pressure, although the tool may also be released mechanically by right-hand rotation of the running string. The releasing mechanism includes inner piston 340, an outer piston 342, and a clutch 316. The packoff bushing 10 includes a C-shaped lock ring 36 which allows the packoff bushing to be repeatedly restabbed into the top of the liner hanger. The packer setting assembly 52 includes a C-shaped ring 64 for applying set-down weight to a setting sleeve, with pressure assist provided by seals for engaging the mandrel 132 and the setting sleeve 90. A method is provided for reliably releasing a running tool from a liner hanger, for allowing stabbing of the running tool packoff bushing into the top of the liner hanger, and for reliably setting the radial set packer element.

80 Claims, 42 Drawing Sheets

LINER HANGER RUNNING TOOL AND METHOD

RELATED APPLICATIONS

The present application claims priority from U.S. Ser. No. 60/292,049 filed May 18, 2001.

FIELD OF THE INVENTION

An improved liner hanger running tool is provided for hanging a liner from a casing within a wellbore. The liner hanger running tool includes improvements to a running tool release mechanism, a retrievable packoff bushing, and a packer setting assembly. The packer setting assembly may be used in other downhole sealing applications.

BACKGROUND OF THE INVENTION

When drilling a well, a borehole is typically drilled from the earth's surface to a selected depth and a string of casing is suspended and then cemented in place within the borehole. A drill bit is then passed through the initial cased borehole and is used to drill a smaller diameter borehole to an even greater depth. A smaller diameter casing is then suspended and cemented in place within the new borehole. This is conventionally repeated until a plurality of concentric casings are suspended and cemented within the well to a depth which causes the well to extend through one or more hydrocarbon producing formations.

Rather than suspending a concentric casing from the bottom of the borehole to the surface, a liner is often suspended adjacent to the lower end of the previously suspended casing, or from a previously suspended and cemented liner, so as to extend the liner from the previously set casing or liner to the bottom of the new borehole. A liner is defined as casing that is not run to the surface. A liner hanger is used to suspend the liner within the lower end of the previously set casing or liner. Typically, the liner hanger has the ability to receive a tie back tool for connecting the liner with a string of casing that extends from the liner hanger to the surface.

A running and setting tool disposed on the lower end of a work string may be releasably connected to the liner hanger, which is attached to the top of the liner. The work string lowers the liner hanger and liner into the open borehole so that the liner extends below the lower end of the previously set casing or liner. The borehole is filled with fluid, such as a selected drilling mud, which flows around the liner and liner hanger as the liner is run into the borehole. The assembly is run into the well until the liner hanger is adjacent the lower end of the previously set casing or liner, with the lower end of the liner typically slightly above the bottom of the open borehole.

When the liner reaches the desired location relative to the bottom of the open borehole and the previously set casing or liner, a setting mechanism is conventionally actuated to move slips on the liner hanger from a retracted position to an expanded position and into engagement with the previously set casing or liner. Thereafter, when set down weight is applied to the hanger slips, the slips are set to support the liner.

The typical liner hanger may be actuated either hydraulically or mechanically. The liner hanger may have a hydraulically operated setting mechanism for setting the hanger slips or a mechanically operated setting mechanism for setting the slips. A hydraulically operated setting mechanism typically employs a hydraulic cylinder which is actuated by fluid pressure in the bore of the liner, which communicates with the bore of the work string. When mechanically setting the liner hanger, it is usually necessary to achieve relative downhole rotation of parts between the setting tool and liner hanger to release the hanger slips. The hanger slips are typically one-way acting in that the hanger and liner can be raised or lifted upwardly, but a downward motion of the liner sets the slips to support the hanger and liner within the well.

To release the running tool from the set liner hanger, the setting tool may be lowered with respect to the liner hanger and rotated to release a running nut on the setting tool from the liner hanger. Cement is then pumped down the bore of the work string and liner and up the annulus formed by the liner and open borehole. Before the cement sets, the setting tool and work string are removed from the borehole. In the event of a bad cement job, a liner packer and a liner packer setting tool may need to be attached to the work string and lowered back into the borehole.

The packer is set utilizing a packer setting tool. Packers for liners are often called "liner isolation" packers. A typical liner isolation packer system includes a packer element mounted on a mandrel and a seal nipple disposed below the packer. The seal nipple stings into the tie back receptacle on top of or below the previously set and cemented liner hanger. A liner isolation packer may be used, as explained above, to seal the liner in the event of a bad cement job. The liner isolation packer is typically set down on top of the hanger after the hanger is secured to the outer tubular, and the packer is set by the setting tool to seal the annulus between the liner and the previously set casing or liner.

Generally, the deeper a well is drilled, the higher the temperature and pressure which is encountered. Thus, it is desirable to have liner packers which will ensure quality cementing of the liner so as to provide a high safety factor in preventing gas from the formation from migrating up the annulus between the liner and outer casing.

During the cementing operation, fluid such as drilling mud in the annulus between the liner and outer casing is displaced by cement as the cement is pumped down the flow bore of the work string. First, the drilling mud and then the cement flows around the lower end of the liner and up the annulus. If there is a significant restriction to flow in the annulus, the flow of the cement slows and a good cementing job is not achieved. Any slowing of the cementing in the annulus allows time for the gas in the formation to migrate up the annulus and through the cement to prevent a good cementing job.

Running Tool Release Mechanism

As a practical matter, the liner hanging running tool must include a release mechanism so that, once the liner is reliably set to the lower end of the casing, the running tool can be released from the liner hanger and retrieved to the surface. Conventional liner hanger running tool releasing mechanisms include hydraulically actuated mechanisms, and release mechanisms that are manipulated by left-hand rotation of the running string. The left-hand rotation of the running string is, however, generally considered undesirable since it may result in an unintended disconnection of one of the joints of the running string, thereby causing separation of the running string and a fishing operation to retrieve the running tool, which may have been damaged by the unintended disconnection. For various reasons, hydraulically operated running tool release mechanisms may fail to operate, or may prematurely release the running tool from the liner hanger.

Accordingly, improvements in release mechanisms are desired which will reliably release the running tool from the set liner only when intended, particularly when retrieving is easily accomplished and premature disengagement of the running tool from the liner is highly unlikely.

Packoff Bushing

A liner hanger packoff bushing conventionally seals between the liner hanger and the running tool, and thus between the liner and the running string or work string, which conventionally may be drill pipe. A packoff bushing is particularly required during cementing operations so that fluid pumped through the drill pipe continues to the bottom of the well and then back up into the annulus between the well bore and the liner to cement the liner in place. During cementing operations, the seal body of the packoff bushing is fitted in the annulus between the liner hanger and the running tool, and includes OD seals for sealingly engaging the liner hanger and ID seals for sealingly engaging the running tool. Packoff bushings are preferably retrievable with the running tool to prevent having to drill out the bushings after the cementing operation is complete. Also, a packoff bushing is preferably lockable to the liner hanger by locking within a profile to prevent the bushing from moving axially with respect to the liner hanger. If the packoff bushing is not lockable to the profile of the liner hanger, the bushing may get "pumped out" through the top of the receptacle, thereby losing a cementing job.

A conventional retrievable and lockable packoff bushing includes metal dogs or lugs which are locked into engagement with the liner hanger to prevent the packoff bushing from moving axially during the cementing operation. The packoff bushing is retrievable with the running tool, and thus eliminates the need to drill out the bushing after cementing operations are complete. Depending on the manufacturer, retrievable packoff bushings are also referred to as retrievable seal mandrels or retrievable cementing bushings. Regardless of the terminology, the retrievable and lockable packoff bushing seals the annulus between the running string and the top of the liner, and may be locked in a profile of the liner hanger by the slick joint to prevent the bushing from being pumped out of the liner hanger.

Cooperating surfaces on the liner running adapter, the slick joint on the running tool, and the seal body of the packoff bushing axially interconnect the bushing to the liner hanger while running the liner hanger into the well. These cooperating surfaces may be unlocked to release the running tool from the liner hanger and allow axial manipulation of the running tool and slick joint relative to the packoff bushing. The slick joint thus seals with the packoff bushing during axial movement of the running tool. Once the cooperating surfaces are unlocked from each other, shoulders on the packoff bushing and the running tool engage after a predetermined amount of axial movement between the running tool and the seal body, so that the packoff bushing may be retrieved to the surface with the running tool after the cementing operations is complete. A conventional packoff bushing is disclosed in U.S. Pat. No. 4,281,711.

A significant limitation on prior art packoff bushings concerns their desired retrievability with the running tool, when coupled with the desire to pick up the running tool relative to the packoff bushing before the cementing operation. An operator will typically want to pick up the running tool after release from the liner hanger to ensure that these tools are disconnected. The length of the running tool slick joint determines the maximum length that the running tool should be picked up after release from the liner hanger. When the packoff bushing is pulled out of the liner hanger, the dogs or lugs conventionally carried by the packoff bushing are allowed to move radially inward, thereby preventing the retrievable packoff bushing from being stabbed back into and locked into the liner hanger. Conventional liner hanger running tools do not allow the packoff bushing to be "re-stabbed" into the liner hanger and thereby re-establish pressure integrity between the liner hanger and the running tool. In many applications, it is difficult for the operator to determine the exact amount the running tool has been picked up, particularly when operating in deep or highly deviated wells. If the operator picks up the running tool an axial distance not permitted by the length of a slick joint, the packoff bushing will be pulled up with the running tool and will disengage from the liner hanger, which may cause a cementing failure costing the operator millions of dollars in lost time and money. The consequences of unintentionally unseating the packoff bushing from the liner hanger and not being able to re-stab and lock into the liner hanger may thus be severe.

The slick joint used with the liner hanger running tool has a polished OD surface which seals against the ID seals on the seal body of the packoff bushing. The slick joint OD surface can become scratched or damaged during handling, thereby causing a cementing leak during the cementing operation. Since the running tool is designed to move axially substantial distances relative to the packoff bushing, the inner seals on the seal body may wear out during the cementing process due to the reciprocation of the running tool slick joint. This problem is exacerbated when the quality of the polished surface on the slick joint has deteriorated. Axially long slick joints are expensive to manufacture and maintain.

Another problem with prior art packoff bushing concerns the limited load capacity of the lugs that lock the packoff bushing to the liner hanger. Conventional packoff bushings utilize multiple lugs protruding from the packoff seal body, which increases the complexity and the cost of the packoff bushing. The limited size of these lugs nevertheless restricts or limits the cementing pressure capacity of the packoff bushing.

Packer Setting Assembly

A conventional liner hanger running tool includes a packer setting assembly, which allows the activation and packoff of the liner top packer. Conventional packer setting assemblies incorporate multiple spring-loaded dogs or lugs which may be compressed to a reduced diameter position by insertion into the packer setting sleeve when running the liner hanger in the well and when cementing the liner within the casing. When the packer setting assembly is raised out of the packer setting sleeve, the dogs or lugs expand to a diameter greater than the ID at the upper end of the setting sleeve, which is also the tie back receptacle of the liner hanger. When the dogs engage the top of the setting sleeve, a setting force may be transferred from the running string through the dogs and to the packer setting sleeve as running string weight is slacked off to set the packer element.

Some prior art packer setting assemblies include an axial bearing to facilitate rotation of the work string while setting the packer element. Other packer setting assemblies include both a bearing and a shear indicator to provide a visual confirmation that the proper setting load was applied to the packer, and/or an unlocking feature that allows the packer setting assembly to be pulled out of the packer setting sleeve one time without exposing the setting dogs. This latter tool allows re-stabbing the packer setting assembly into the packer setting sleeve one time, thereby arming the setting dogs so they are ready to expand the second time the dogs are pulled out of the setting sleeve.

A primary problem concerning prior art packer setting assemblies is poor reliability. In some well environments, the packer setting dogs of conventional packer setting assemblies collapse and re-enter the setting sleeve without setting he packer element. Manufacturers have provided more dogs or lugs to alleviate this problem, and/or have provided heavier springs to bias the dogs radially outward. These changes have had little if any affect on achieving higher reliability.

The disadvantages of the prior art are overcome by the present invention, and an improved liner hanger running tool is hereinafter disclosed which includes improvements to a running tool release mechanism, a retrievable packoff bushing, and a packer setting assembly. In addition, the improved packer setting assembly may be used in operations not involving a liner hanger running tool.

SUMMARY OF THE INVENTION

A preferred embodiment of a liner hanger running tool of the present invention includes improvements to one or more of the running tool release mechanism, the retrievable packoff bushing and the packer setting assembly. The running tool may be used for positioning a liner within a casing in a wellbore and subsequently cementing the liner in place, then retrieving the running tool to the surface with the packoff bushing and the packer setting assembly. The packer setting assembly may be used in other downhole packer setting applications.

Running Tool Release Mechanism

The liner hanger running tool release mechanism preferably includes a hydraulically actuated mechanism for releasing the running tool from the set liner hanger in response to fluid pressure within the running tool, and also a mechanical right-hand release mechanism which, if necessary, allows the running tool to be mechanically released from the liner hanger by right-hand rotation of the work string. The combination of the hydraulic release mechanism and the right-hand release mechanism significantly improves reliability of the running tool.

It is an object of the present invention to provide an improved running tool release mechanism for releasing a running tool from a set liner hanger. The running tool may be hydraulically released, but also may be released by right-hand rotation of the running string. A first piston is used for hydraulic release. A second piston is used to disengage a clutch, thereby allowing a nut to move downward along the right-hand threads on the running tool mandrel due to right-hand rotation of the running string. Once the nut has moved axially downward on the mandrel, the work string may be picked up to disengage the running tool from the liner hanger.

Yet another feature of the invention is that, after the clutch has been disengaged to allow right-hand release of the running tool, fluid pressure may be used to reengage the clutch to allow rotation of the liner during a cementing operation.

Yet another feature of the invention is that fluid within the running tool which transmits fluid pressure to the piston for hydraulic release of the running tool may be isolated by a sleeve, such that the sleeve shifts downward to expose a port and allow hydraulic fluid to release the running tool.

A significant feature of the running tool release mechanism is that the release mechanism may be actuated both hydraulically and by right-hand rotation of the running string or work string.

A related feature of the running tool release mechanism is that reliability of the release operation is significantly improved with little if any cost increases.

Packoff Bushing

During the cementing operation, the packoff bushing serves its function of providing a seal between the liner hanger and the running string. The packoff bushing may be axially fixed to the liner hanger during the cementing operation by a C-shaped lock ring, which is held locked in a groove in the liner hanger by a fluid pressure responsive piston. The packoff bushing is designed such that it may be reinserted into the liner hanger when the packoff bushing is raised with the running string relative to the set liner hanger. Accordingly, the cost of the slick joint may be avoided. The liner hanger packoff bushing may thus be removed from the liner hanger when the operator picks up the running tool to check for release of the running tool from the liner hanger and verify that the liner is properly set in the casing. When the running tool is slacked back off into the liner hanger before pumping cement, the packoff bushing can be re-stabbed and resealed to the liner hanger. When pressure is subsequently applied to the running string during a cementing operation, the packoff bushing will be locked to the liner hanger by the fluid pressure to prevent movement out of the liner hanger. Fluid pressure thus keeps the packoff bushing locked to the liner hanger, while the absence of pressure in the running string allows the packoff bushing to be picked up out of the liner hanger and subsequently reinserted into the liner hanger. The liner hanger running tool thus includes a packoff bushing which may be repeatedly "re-stabbed" back into the liner hanger, as desired by the operator, to re-establish pressure integrity between the running tool and the liner hanger.

By providing a re-stabbable packoff bushing, the operator has much more flexibility when picking up to check for release of the running tool. By providing a packoff bushing which may be repeatedly reinserted into the liner hanger so that a seal may be repeatedly established between the running string and the liner hanger, the operator avoids much of the risk of a bad cementing job, and the significant loss of time and money to correct a bad cementing job. The re-stabbable packoff bushing may be used on a running tool with or without a liner hanger packer for sealing between the casing and the liner hanger.

The packoff bushing is preferably designed with a C-shaped lock ring to increase the cementing pressure capability of the packoff bushing. Compared to prior art packoff bushings, the one-piece lock ring avoids the use of multiple lugs and springs which add length and complexity to the packoff bushing without significantly increasing the cementing pressure capability of the packoff bushing when locked to the liner hanger.

It is an object of the present invention to provide a liner hanger running tool with the packoff bushing which may be repeatedly restabbed into the top of the liner.

A feature of this invention is that the packoff bushing incorporates a C-shaped one-piece lock ring, which effectively locks the packoff bushing to the liner hanger in response to fluid pressure, which acts on a piston to retain the lock ring in the locked position. The absence of fluid pressure allows the lock ring to be collapsed, thereby permitting the restabbing of the packoff bushing into the top of the liner hanger. The C-shaped lock ring may include radially external or internal slots for facilitating expansion and contraction of the lock ring.

The packoff bushing includes a radially outer shoulder for engaging a radially inner shoulder on the liner hanger when the lock ring is aligned with the groove in the liner hanger, so that set down weight may be applied to the liner hanger. The packoff bushing also includes a radially inner shoulder, so that the packoff bushing is retrieved with the tool to the surface. In addition to the packoff bushing, the running tool may include a packer setting assembly for activating the packer element to seal between the casing and the liner hanger.

It is a feature of the invention that the running tool may include a retrievable packoff bushing which may be reinserted or "restabbed" into the liner hanger numerous times. A related feature of the invention is that the cost of a slick joint may be avoided.

It is a further feature of the present invention to provide an improved liner hanger running tool packoff bushing wherein fluid pressure keeps the packoff bushing locked to the liner hanger, while the absence of fluid pressure may allow the packoff bushing to be picked up out of the liner and subsequently reinserted into the liner. A related feature of the running tool with the improved packoff bushing is the reduced risk of a bad cementing job.

Packer Setting Assembly

The packer setting assembly may be used with the liner hanger running tool to set the liner top packer after the liner hanger has been set, and after the running tool has been released from the liner hanger. The packer setting assembly may be positioned on the running tool at a desired location, which may be axially between the liner hanger releasing assembly and the slip setting assembly at the lower end of the running string or work string. When the running tool is assembled at the surface, the packer setting assembly is thus contained within the tie back receptacle or setting sleeve of the liner hanger assembly.

The packer setting load is preferably transferred to the packer setting sleeve through a one piece C-shaped setting ring. The C ring design enables more weight to be set down on the setting sleeve than with the plurality of dogs used in the prior art. A lock out feature keeps the setting ring in weight-transfer engagement with the setting sleeve so that the setting ring will not prematurely snap radially inward toward the packer setting housing before the packer is set. Seals on both the ID and the OD of the packer setting assembly also aid in setting the packer. Once the initial load has been set down on the liner hanger, the ID seal which seals to the running tool mandrel, and the OD seal which seals to the setting sleeve, act as a piston responsive to pressure applied to the annulus to assist in setting the packer element. This fluid pressure assist along with the set down weight achieves the proper setting force to the liner top packer element. By using annulus pressure to aid in setting the packer element, a significant additive hydraulic force complements the set down weight to reliably set the liner hanger packer element.

A preferred packer setting assembly includes an unlocking feature that allows the assembly to be pulled out of the packer setting sleeve one time without releasing a setting ring. Upon re-stabbing the assembly into the setting sleeve, the packer setting ring becomes activated and is ready to expand the second time the packer setting assembly is pulled out of the setting sleeve. An adjustable shear indicator may be included to provide immediate visual confirmation, when the running tool is retrieved to the surface, that adequate setting force was applied to the liner top packer. A bearing assembly in the packer setting tool allows rotation and slack off of the running string without damaging the packer setting sleeve or setting ring. Rotation also breaks the static friction between the running string and the casing, thereby reducing buckling and insuring maximum transfer of setting force to the liner packer element.

It is an object of the present invention to provide a packer setting assembly which uses an expandable and collapsible one-piece C-ring to set weight down to a packer element. The packer setting assembly also includes O.D. seals and I.D. seals, so that fluid pressure may be used to increase the setting force applied to the packer element.

It is a feature of the packer setting assembly according to the present invention that the C-ring may be locked in a collapsed position by a locking mechanism to prevent the C-ring from moving to its expanded position. This allows the packer setting assembly to be pulled out of the tie back receptacle one time without releasing the C-ring, and allows the lockout mechanism to engage the top of the tie back receptacle for weight set down. The next time the packer assembly is pulled out of the tie back receptacle, the C-ring is allowed to expand radially outward for engagement with the top of the tie back receptacle.

It is a further feature of the present invention that the packer setting assembly has multiple uses. The packer setting assembly may be used as part of a liner hanger running tool, although the packer setting assembly may also be used for other applications wherein an operator desires to radially set a downhole packer.

It is a feature of the invention that the packer setting assembly transfers the packer setting load to the packer setting sleeve through a C-shaped setting ring.

A related feature is that seals on both the I.D. and O.D. of the packer setting assembly may assist in setting the packer.

Yet another feature of the packer setting assembly is that the setting ring may be easily and reliably locked out to prevent premature actuation.

Yet another feature of the packer setting assembly is that it may include an unlocking feature so that the assembly may be pulled out of the packer setting sleeve one time without releasing the setting ring.

An advantage of the improvements to each of the running tool release mechanism, the retrievable packoff bushing, and the packer setting assembly is that these mechanisms rely upon components which have been found highly reliable in the oilfield services industry. The complexity of the running tool with one or more of these features is not significantly increased and, in many cases, is made simpler. Tool reliability has been increased to perform the desired downhole operations.

These and other objects, features and advantages of the present invention will become apparent from the following detailed description, wherein reference is made to the figures in the accompanying drawings.

BRIEF DESCRIPTION OF THE DRAWINGS

FIGS. 1A–1J illustrate sequentially lower portions of a liner hanger setting tool run into a well. FIG. 1A illustrates the interconnection of the tool to a work string. FIG. 1B illustrates the liner hanger slip setting assembly. FIG. 1C illustrates the packer setting assembly. FIG. 1D illustrates the liner hanger releasing assembly. FIG. 1E illustrates the retrievable cementing bushing. FIG. 1F illustrates the packer element. FIG. 1G illustrates the hanger slip assembly. FIG. 1H illustrates the lower end of the running tool mandrel. FIG. 1I illustrates the ball diverter. FIG. 1J illustrates the liner wiper plug.

DETAILED DESCRIPTION OF PREFERRED EMBODIMENTS

FIGS. 1–9 Running Tool

To hang off the liner, the running tool 120 may initially be attached to the lower end of a work string WS and releasably connected to the liner hanger, from which the liner is suspended for lowering into the bore hole beneath the previously set casing or liner C. The assembly may easily be run in at a rate that does not adversely affect the well formations or the running tool.

Figure 1A:
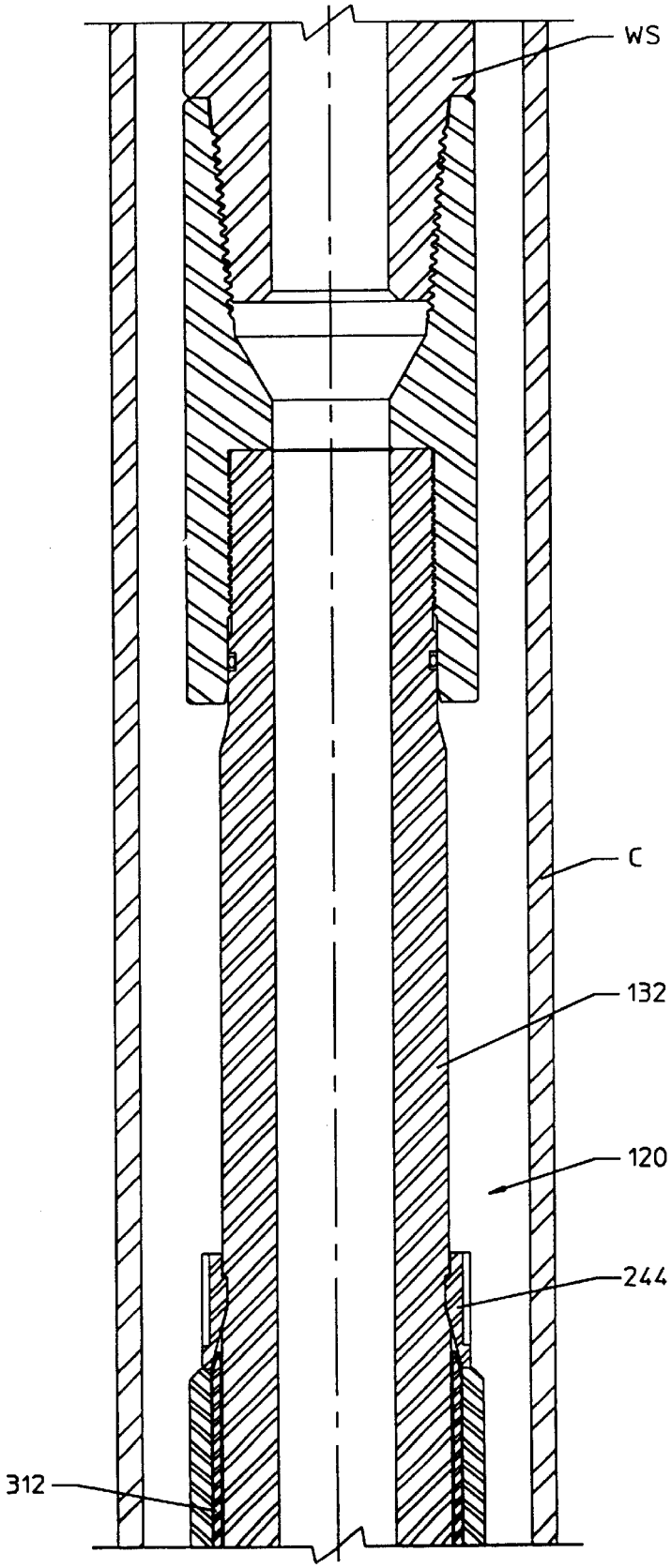
Figure 1B:
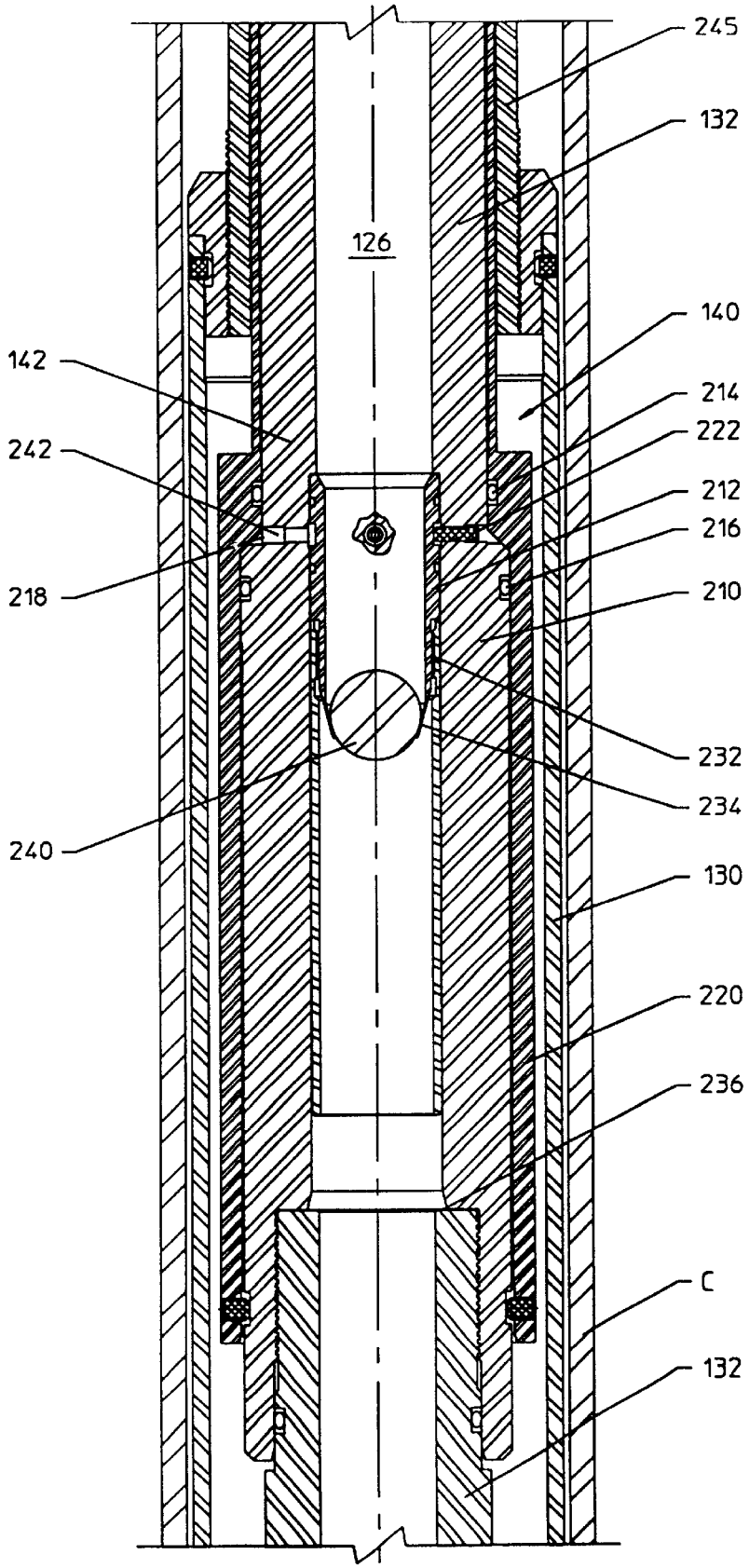
Figure 1C:
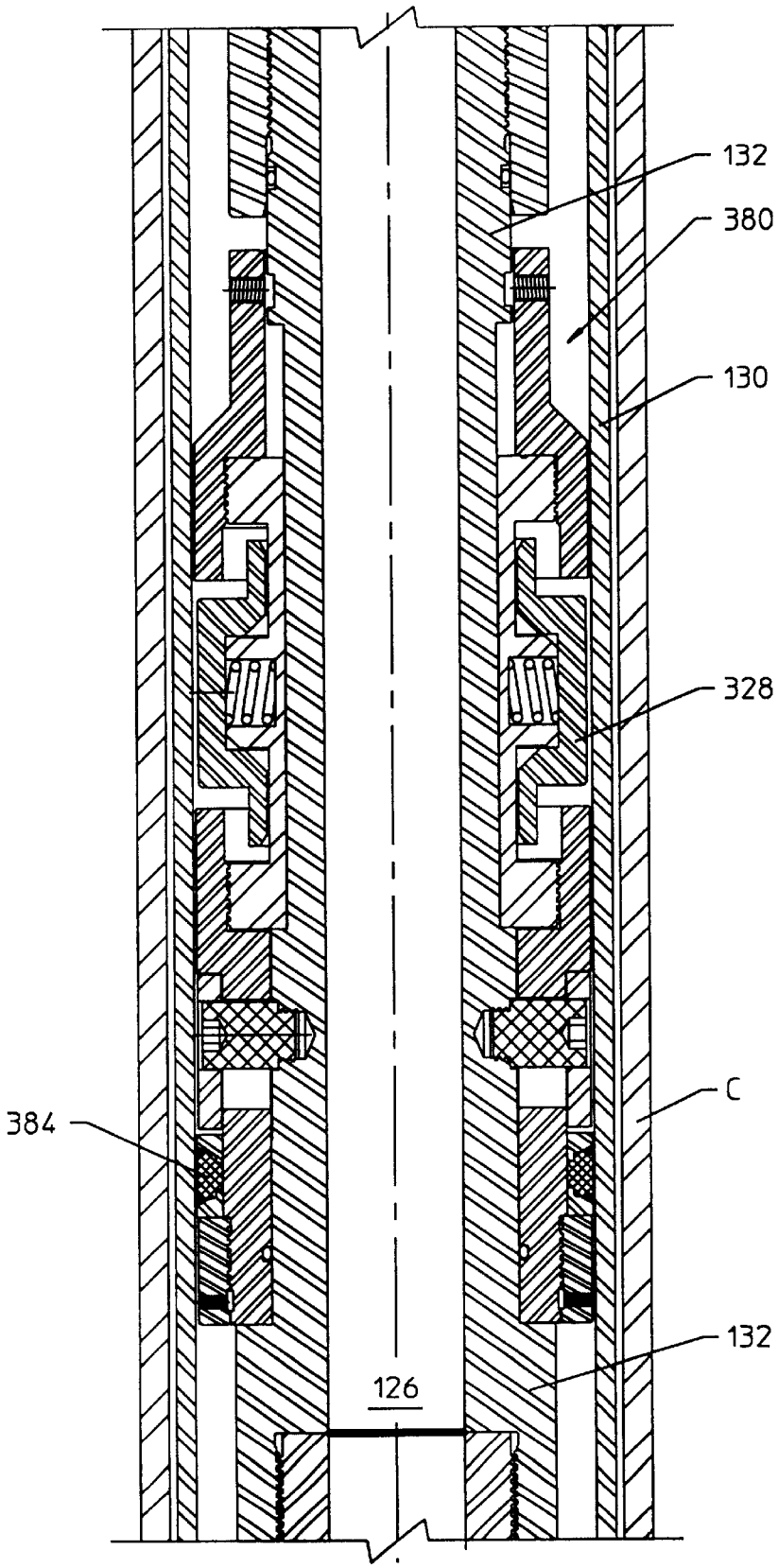

A tie back receptacle 130 as shown in FIG. 1B is supported about the running tool 120, with its upper end having the liner hanger slip setting assembly 140. The upper end of the tie back receptacle 130, upon removal of the running tool, provides a means by which a casing tie back (not shown) may subsequently extend from its upper end to the surface. As shown in FIGS. 1A–1I, the tool 120 includes a central mandrel 132, which may comprise multiple connected sections.

Figure 1D:
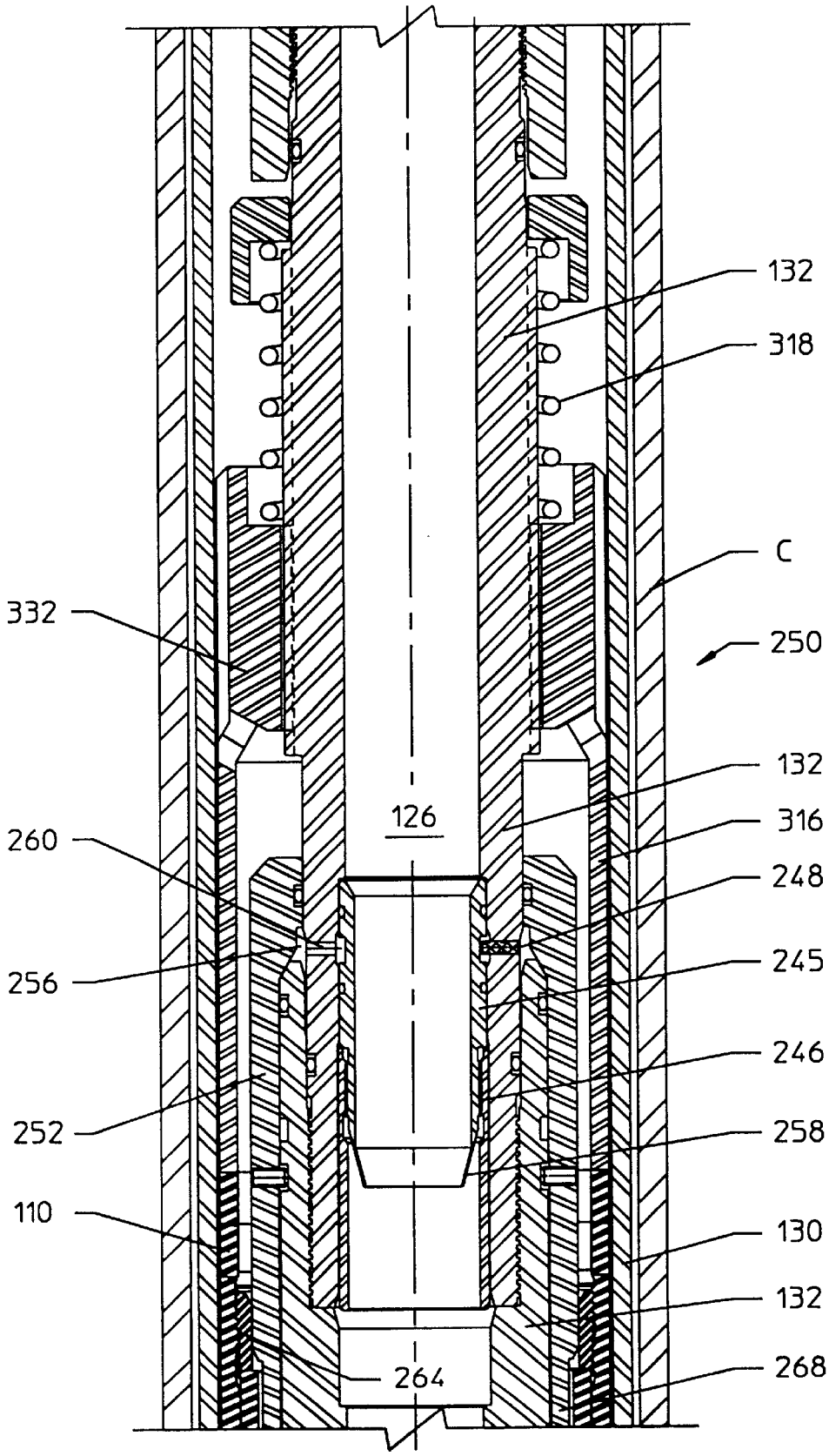
Figure 1E:
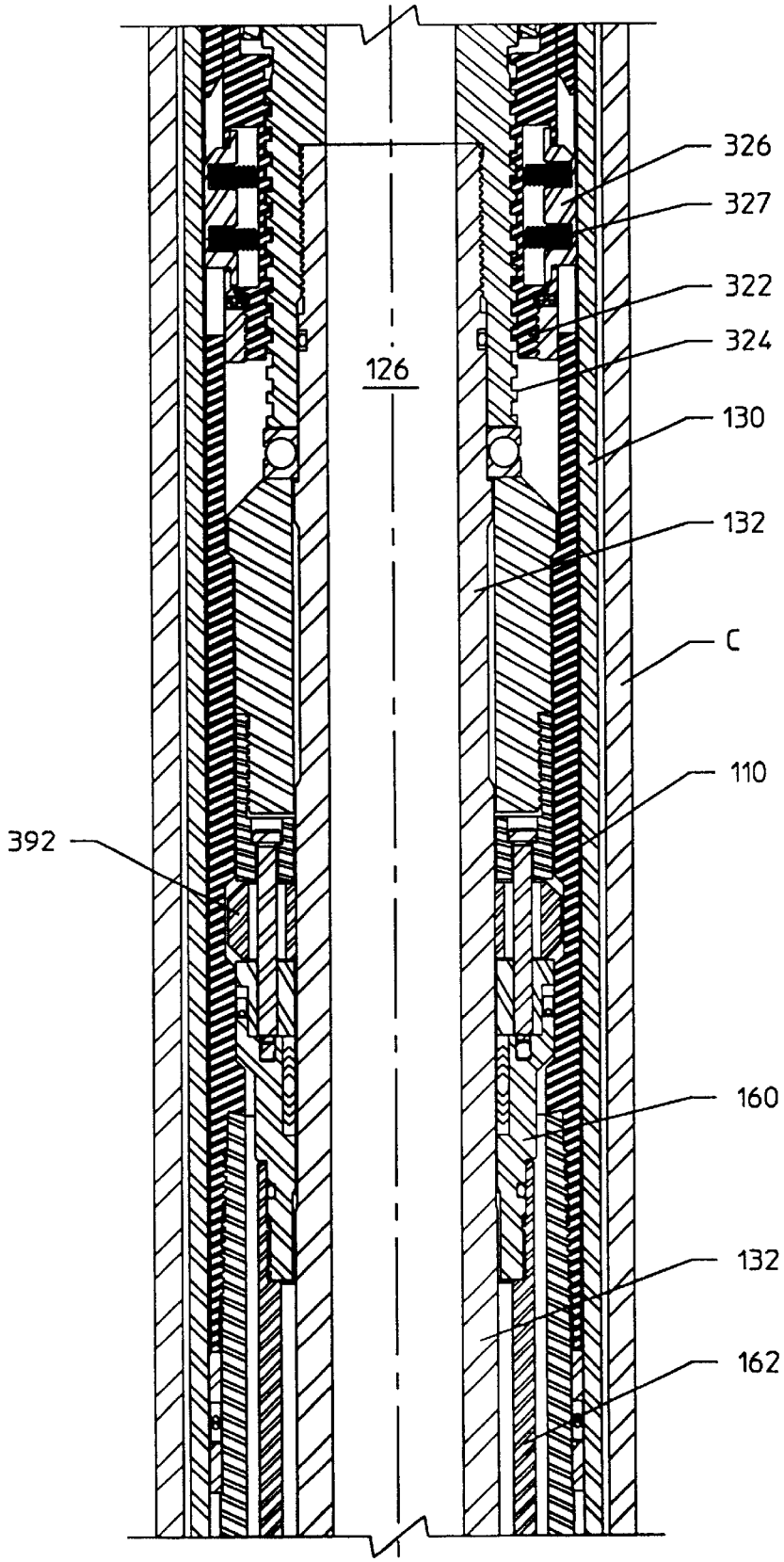
Figure 1F:
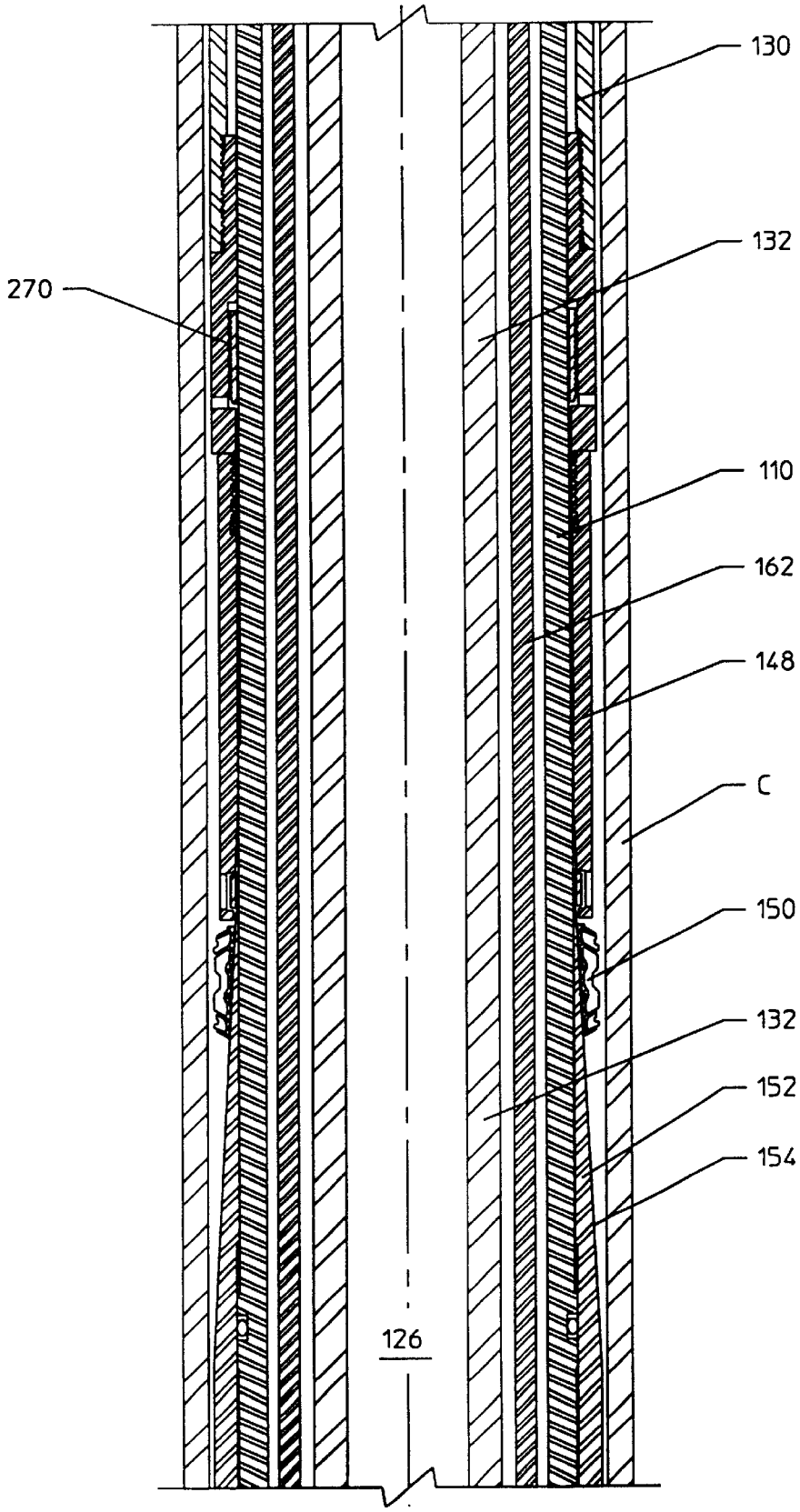
Figure 1G:
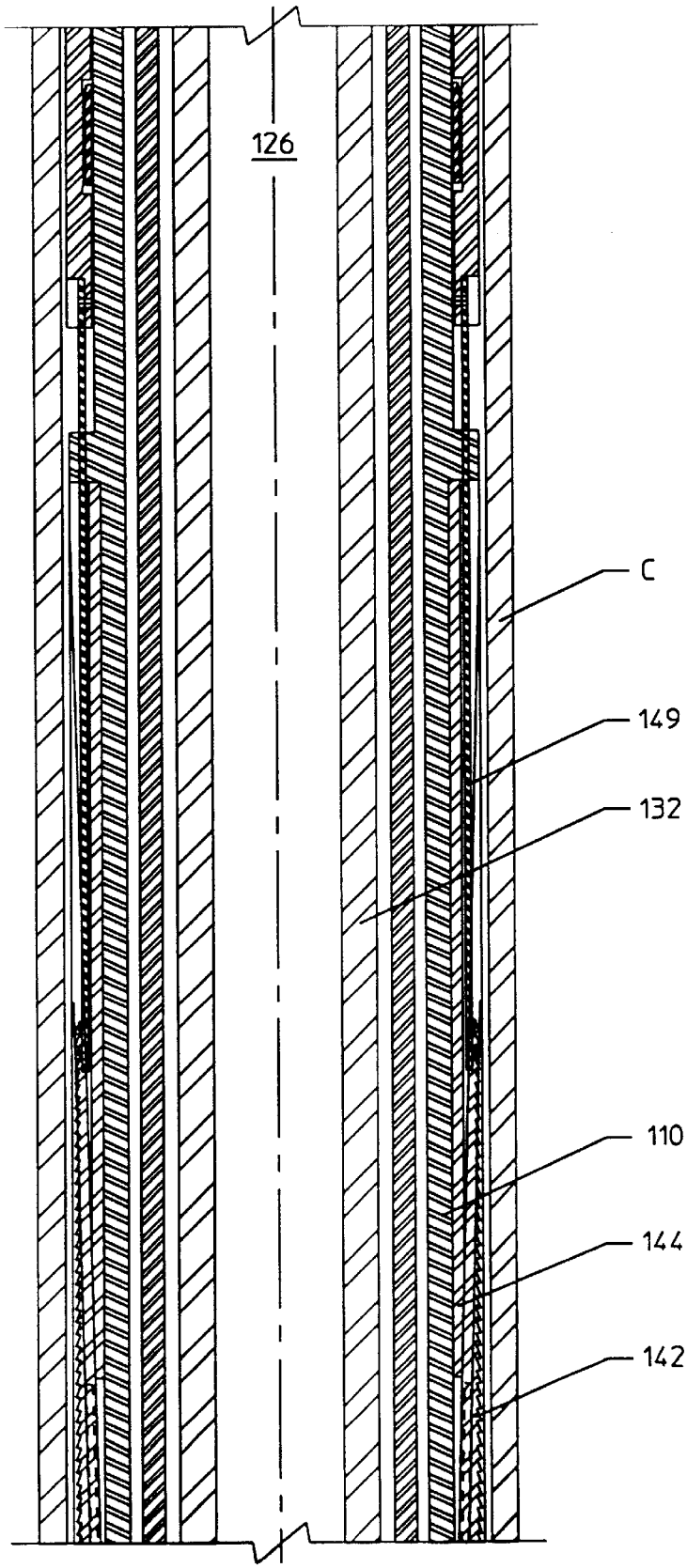
Figure 1H:
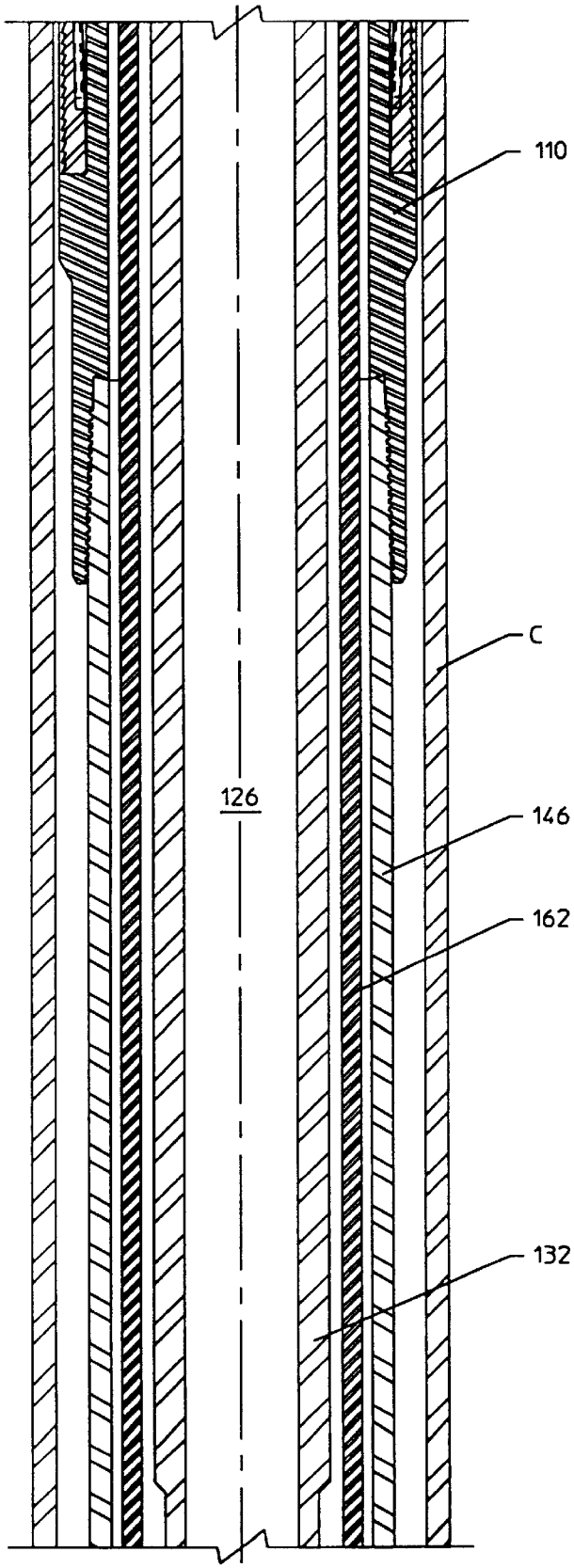

The lower end of the tie back receptacle 130 is connected to the packer element pusher sleeve 148 as shown in FIG. 1F, whose function will be described in connection with the setting of the packer element 150 about an upper cone 152, as well as setting of the slips 142 about a lower cone 144 (see FIG. 1G) below the packer element 150. The running tool 120 includes a cementing bushing 160 (see FIG. 1E) from which a tubular body 162 is suspended for supporting the ball diverter 280 (see FIG. 1I) and liner wiper plug 180 (see FIG. 1J) at the lower end of the running tool. The retrievable cementing bushing 160 provides a retrievable seal between the running tool 120 and the liner hanger assembly for fluid circulation purposes. By incorporating an axially movable slick joint, the running tool can be moved without breaking the seal provided by the packoff bushing.

The liner hanger slip setting assembly 140 as shown in FIG. 1B includes a sleeve 212 disposed within and axially moveable relative to a portion 210 of the running tool mandrel 132. The piston sleeve 212 is held in its upper position by shear pins 222 in mandrel portion 210. A tubular ball seat 232 is supported at the lower end of sleeve 212. The lower end of the ball seat has a neck portion 234 which is reduced in diameter and is thinner, for the purpose described below. A ball 240 is dropped from the surface into the running tool bore 126 and onto the seat 232. An increase in fluid pressure within the mandrel 132 will shear the pins 222 and lower the ball seat to a landed position in the bore of the running tool, e.g., against the stop shoulder 236.

Figure 2A:
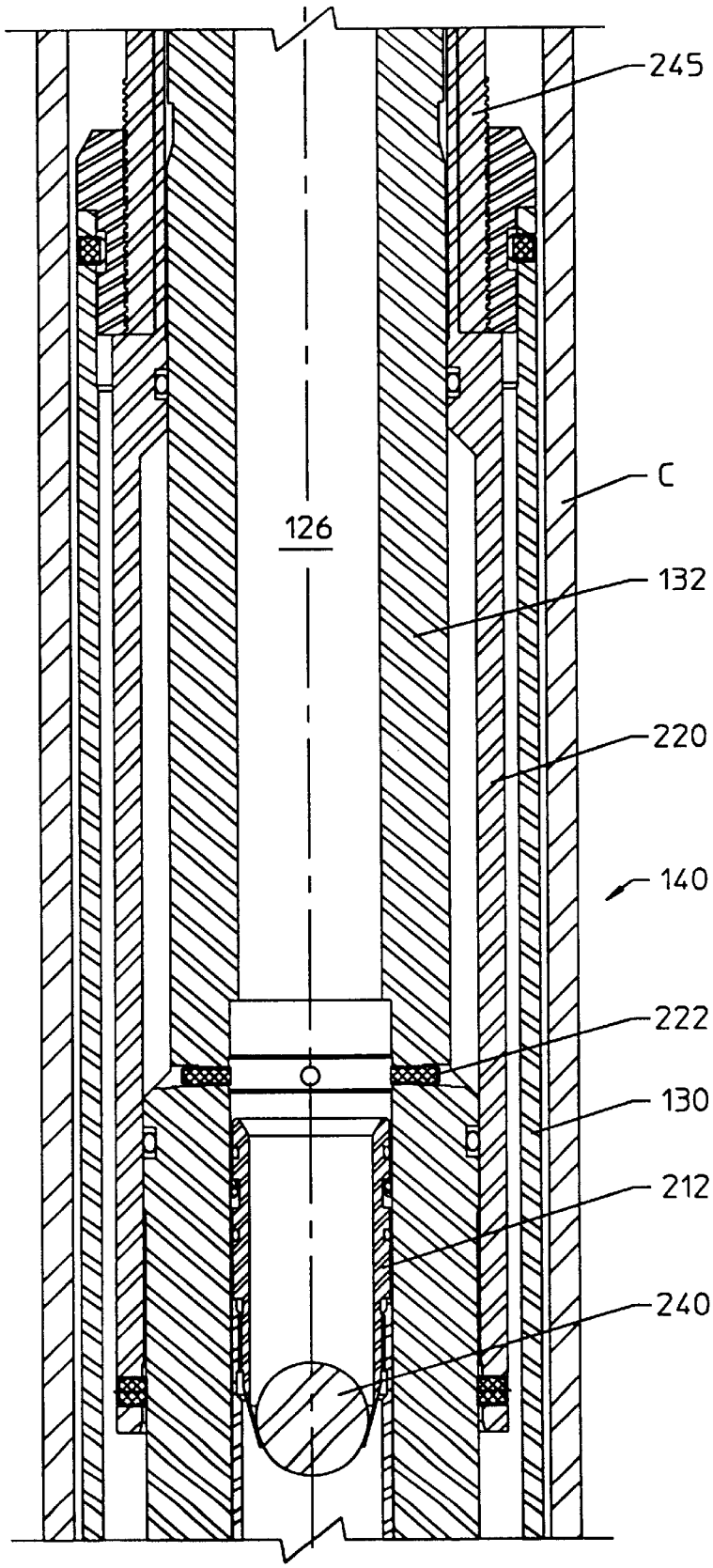
FIG. 2A illustrates the tie back receptacle raised to set the slips.
Figure 2B:
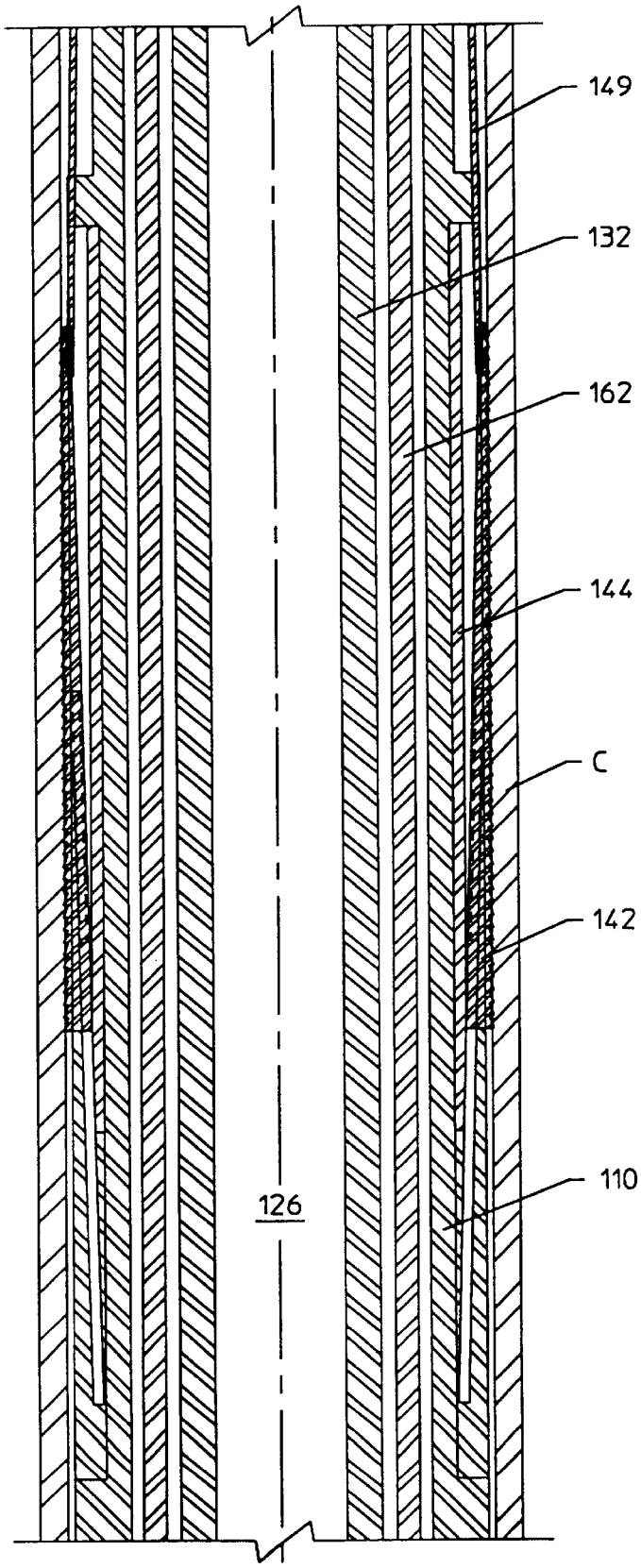
FIG. 2B illustrates the slips in the set position.
Figure 3A:
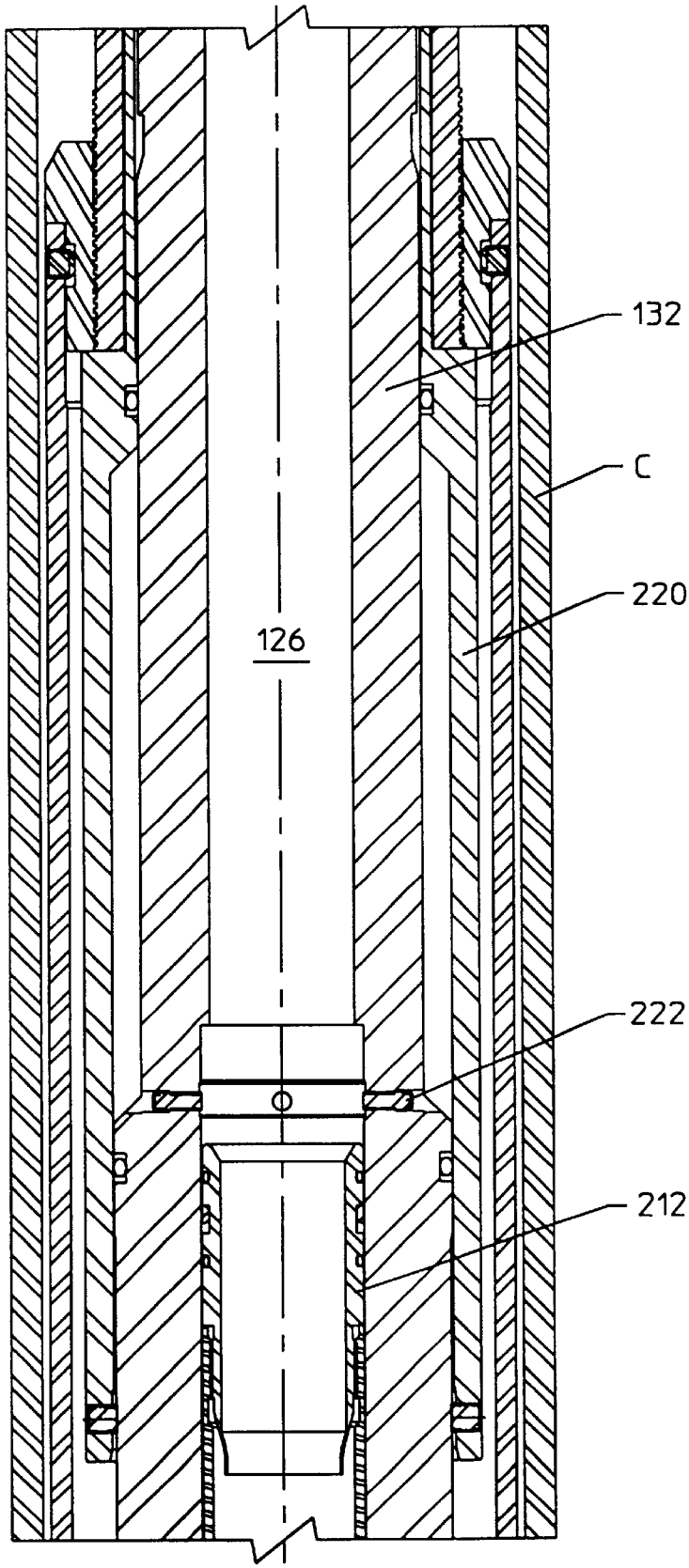
FIG. 3A shows the upper seat after release of the ball.
Figure 3B:
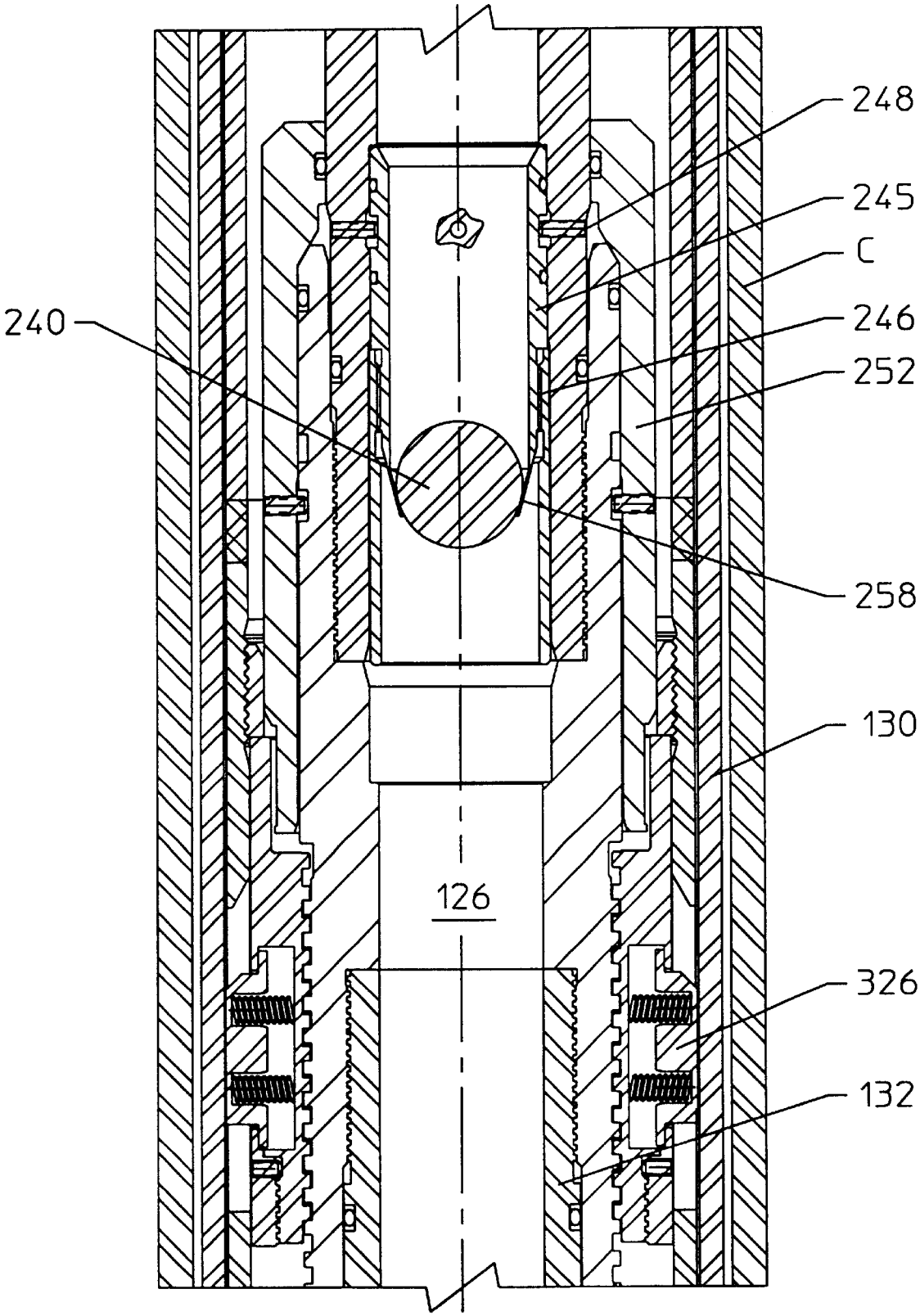
FIG. 3B shows the ball landed on the lower seat.
Figure 3C:
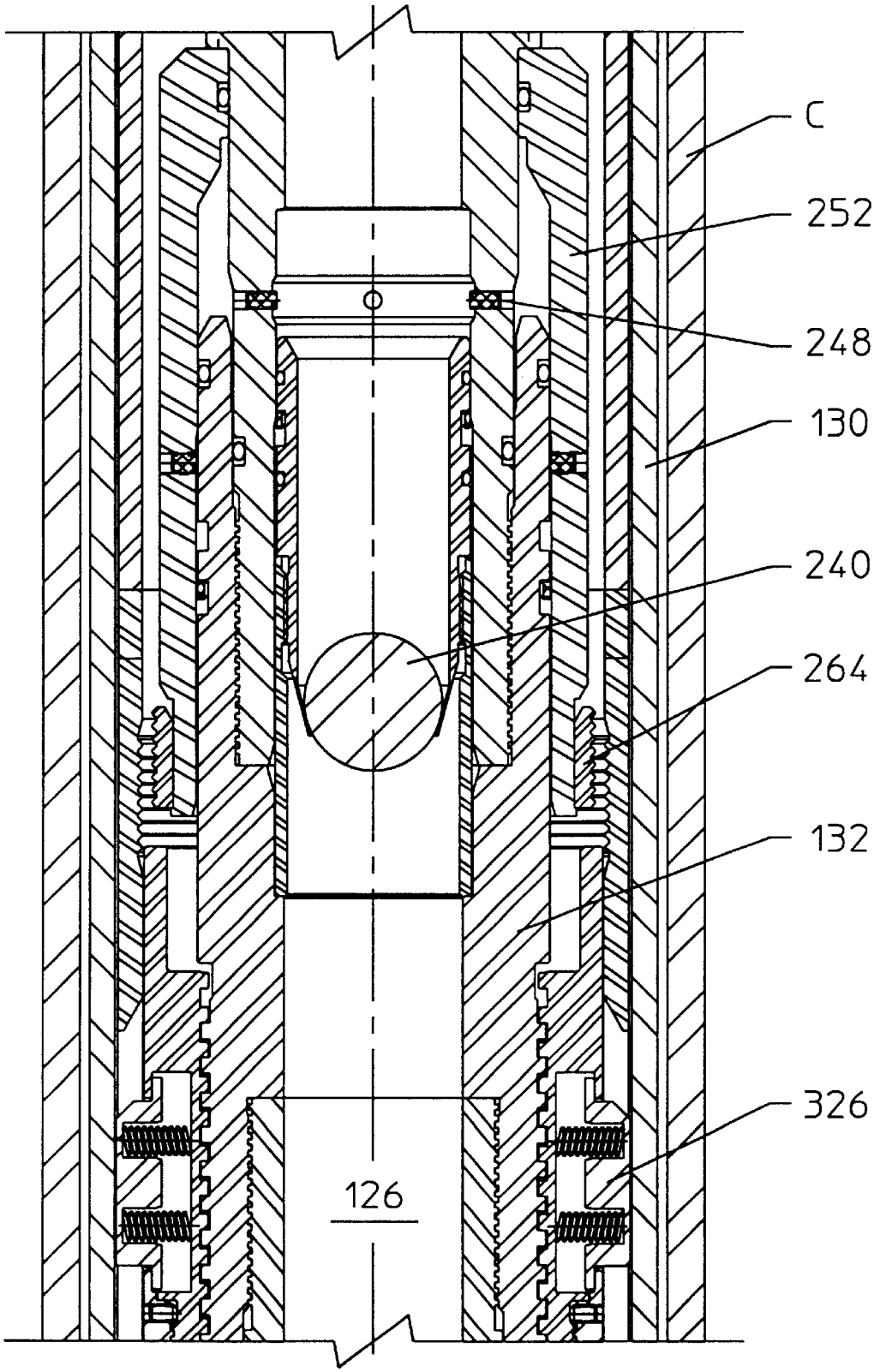
FIG. 3C illustrates the lower seat moved downward to open ports and allowed the lock ring of the releasing assembly to contract.

Piston sleeve 220 is disposed about and is axially moveable relative to portion 210. An upper sealing ring 214 is disposed about a smaller O.D. of the running tool mandrel than is the lower sealing ring 216 to form an annular pressure chamber 218 between them for lifting the tie back receptacle 130 from the position shown in FIG. 1B to an upper position, as will be described in connection with setting the slips 142. Ports 242 formed in the running tool mandrel 132 connect the running tool bore with the surrounding pressure chamber 218 once the sleeve 212 is lowered. An increase in pressure through the ports 242 will raise the piston sleeve 220. Upward movement of the sleeve 220 causes the upper end 312 of the piston sleeve 220 to overcome the resistance of the split ring 244 as shown in FIG. 1A in order to raise the tie back receptacle 130, as shown in FIG. 2A, and thereby raise the slips 142, as shown in FIG. 2B. Sleeve 245 as shown in FIG. 1D may move downward to expose ports 260, raising the piston 252 to release the ring 244 which was connected to the top of the tie back receptacle 130. A further increase in pressure will force the ball through the reduced neck of the seat 232 to pump the ball to a seated position on a lower seat 246 (see FIG. 1D), which is similar to the upper seat 232.

Figure 9A:
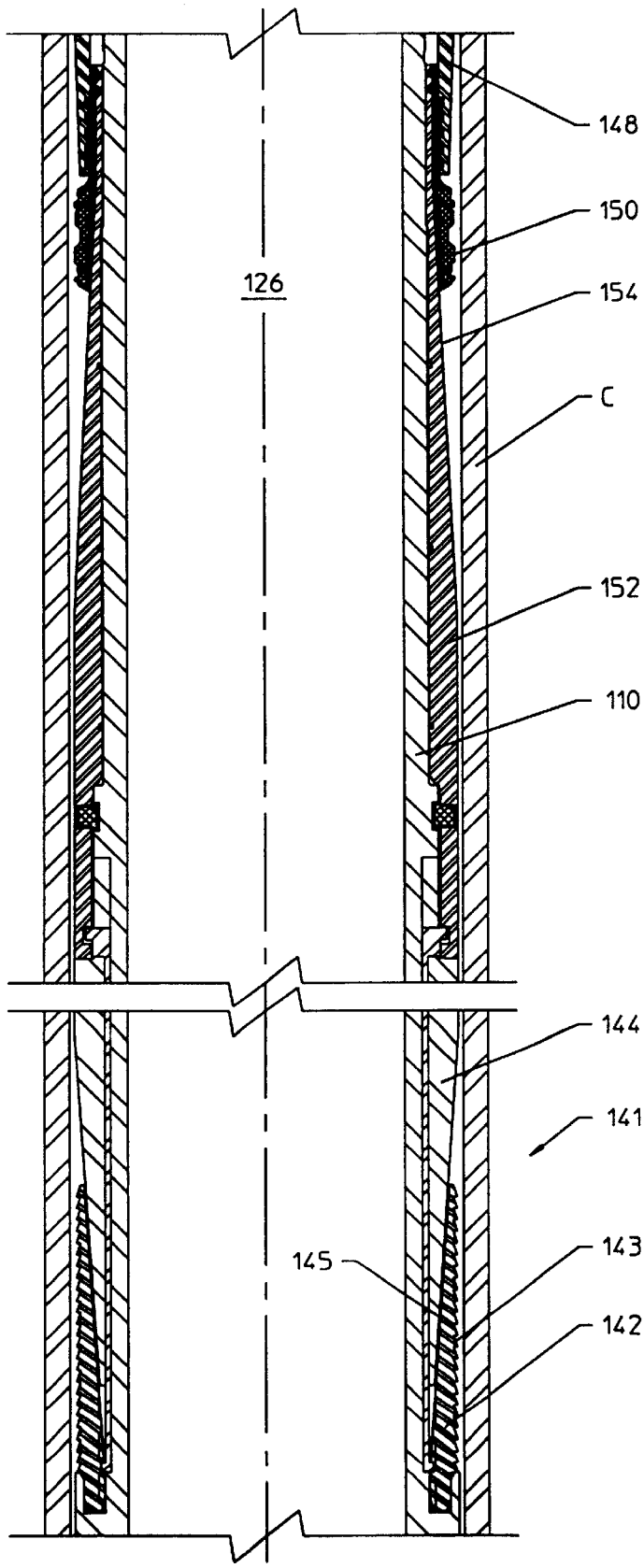
FIG. 9A shows the packer elements and slips in the run in position.

The slip assembly 141 is shown on FIG. 9A is made up of arcuate slip segments 142 received within circumferentially spaced recesses in slip body sleeve about the lower end of the liner hanger 110 and beneath the lower cone 144. Alternatively, a one piece C-slip may be used. Each slip segment 142 includes a relatively long tapered arcuate slip having teeth 143 on its outer side and an arcuate cone surface 145 mounted on its inner side for sliding engagement with cone 144. When three circumferentially spaced slip segments are used, each of three recesses may include a slot in each side. The opposite sides of each slip may have tangs adjacent and parallel to their inner surfaces for fitting closely within the slots to thereby retain the slip within the recesses. The tangs may slide longitudinally within the slots to hold the slip and thus the cone on the body sleeve. The teeth 143 are adapted to bite into the casing C as the liner weight is applied to the slip.

Figure 9B:
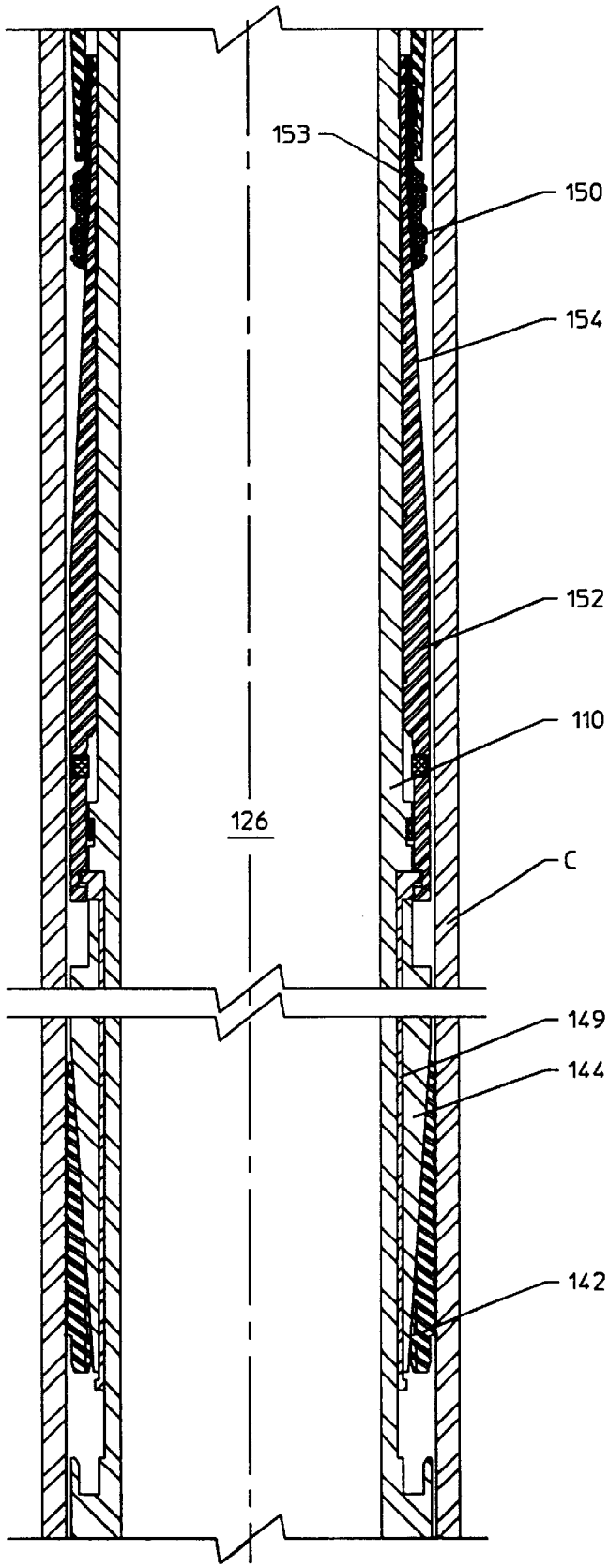
FIG. 9B shows the components moved to set slips.

The slips 142 are movable vertically between a lower retracted position, as shown in FIG. 9A, wherein their outer teeth 143 are spaced from the casing C, and an upper position as shown in FIG. 9B, wherein the slips 142 have moved vertically over the cone 144 and into engagement with the casing C, but prior to suspending the liner hanger therefrom. The slips 142 are raised to this position by sliding over the outer surface of the cone 144 when raising an actuator slat 149 (see FIG. 1G) connected to the upper end of each slip 142 as the slat moves within a groove in the outer diameter of the upper end of the cone 144. The upper end of slat 149 is connected to the lower end of upper cone 152, which has an upwardly and inwardly tapering cone surface 154 about which the packer element 150 is disposed.

The slips 142 are kept from prematurely setting as the tool 120 is run into the wellbore by the split ring 244 (see FIG. 1A) which grippingly engages the upper end of the tie back connector 130 to prevent its upward movement to set the slips. The ring 244 is split to permit it to expand and move outwardly to a position for releasing the liner hanger slip setting assembly 140 to move upwardly. For this purpose, the lower end of the split sleeve 244 has an inner diameter adapted to be engaged by the upper end of an upward extension 312 on the sleeve 220. When moved outwardly by the piston action of the sleeve 220, the locking ring 244 is free to move upwardly as the tie back connector moves upwardly, thereby unloading the running tool. Other types of locking mechanisms may be used to keep the slips from prematurely setting.

If the slips are circumferentially spaced, the reaction of the slip 142 moving up the cone 144 as it slides along opposite sides of the recess creates hoop loading to cause lower and more uniform stress in the casing and liner hanger. The loads are transferred circumferentially, rather than radially inwardly, thereby preventing hanger collapse and burst of the casing. Although not shown in the figures, the upper end of each slip 142 may be connected to the lower end of an activator slat which, like that of the embodiment described above, extends slidably through the downwardly and inwardly tapered cone for the slip.

In an alternative slip assembly, the slip assembly may include a ring disposed about the slip cone in which there is a recess beneath the cone taper. The recess receives and retains the lower end of the slip when in its contracted position. However, as the slip is pulled upwardly by raising of the tie bar or slat, the lower end of the slip is pulled out of the recess and the slip is permitted to expand outwardly against the casing. The slip expands sufficiently so as to raise a groove away from a flange on the lower end of the slat to accommodate downward movement of the slat and upper cone as the packer element 150 thereabout is forced downwardly and into sealing position with the casing C. This downward movement of the packer element 150 results from the lowering of the pusher sleeve 148 at the lower end of receptacle 130 to move the packer element downwardly about the cone 152.

Figure 9C:
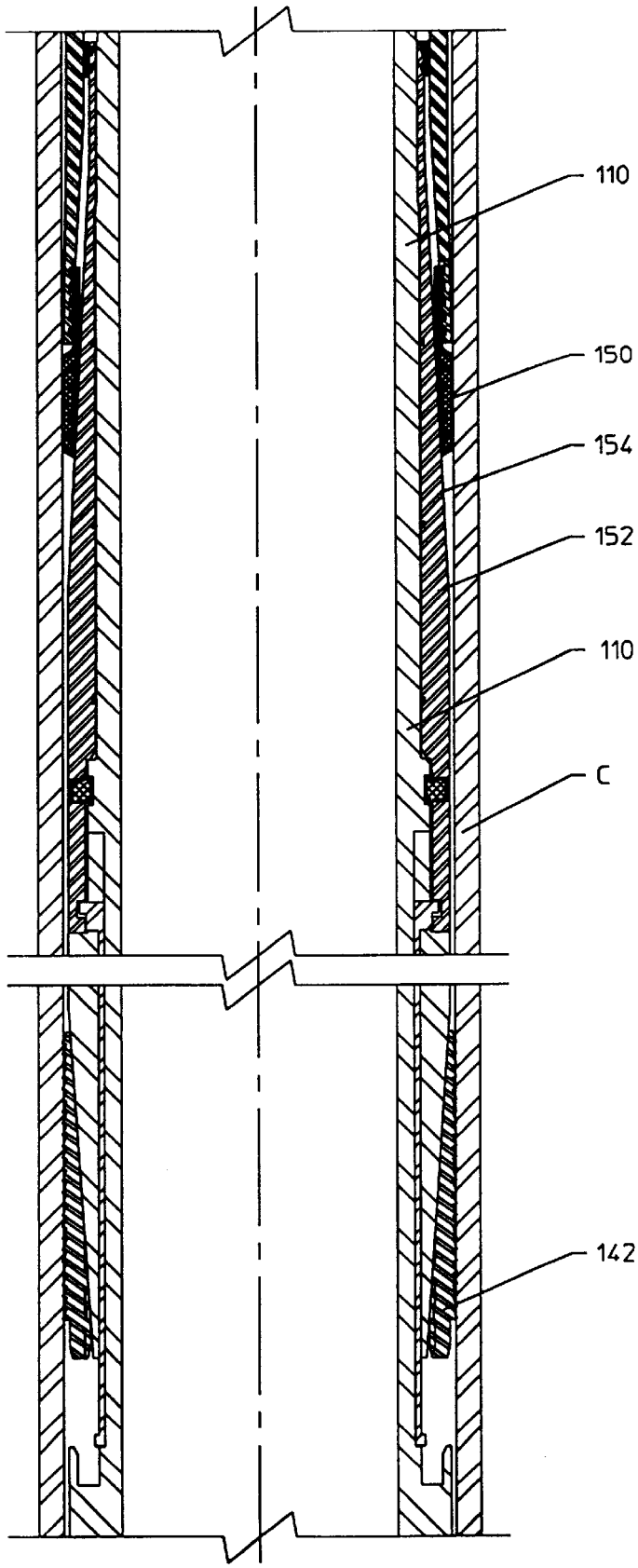
FIG. 9C shows the slips engaged with the casing and the packer element moved to seal with the casing.
Figure 10A:
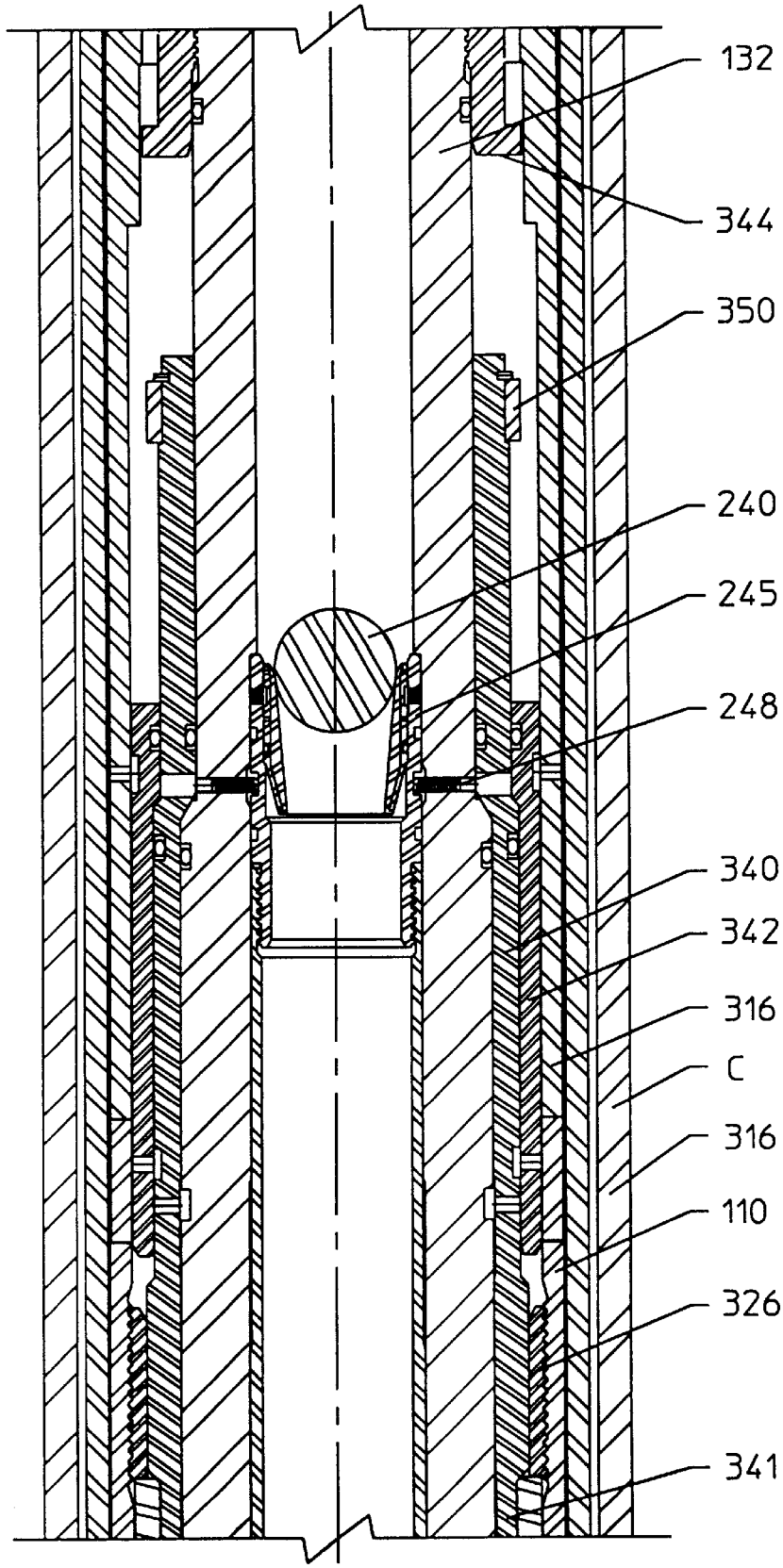
FIGS. 10A and 10B illustrates running tool components for a hydraulic release when run in the well.
Figure 10B:
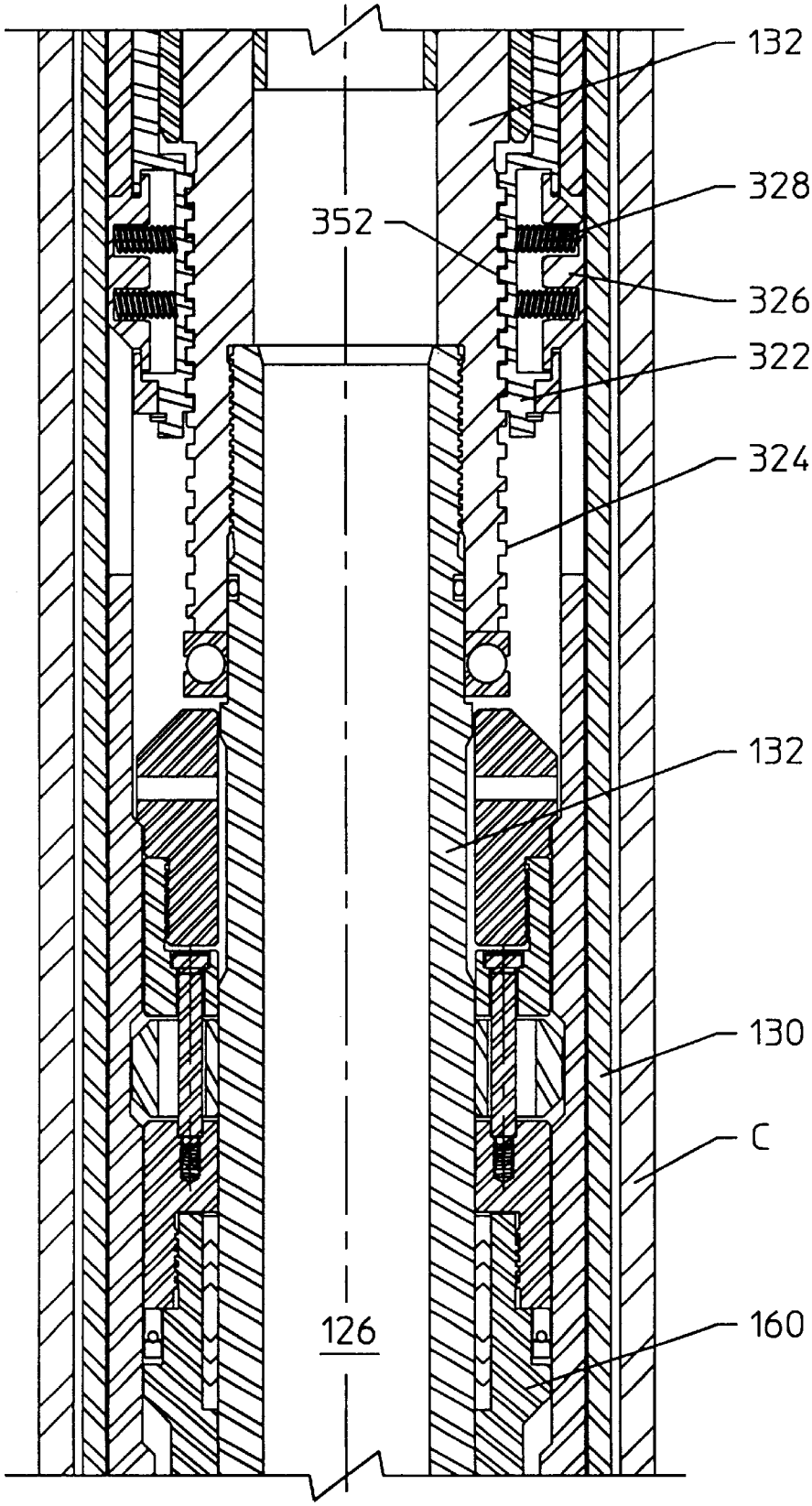
Figure 10C:
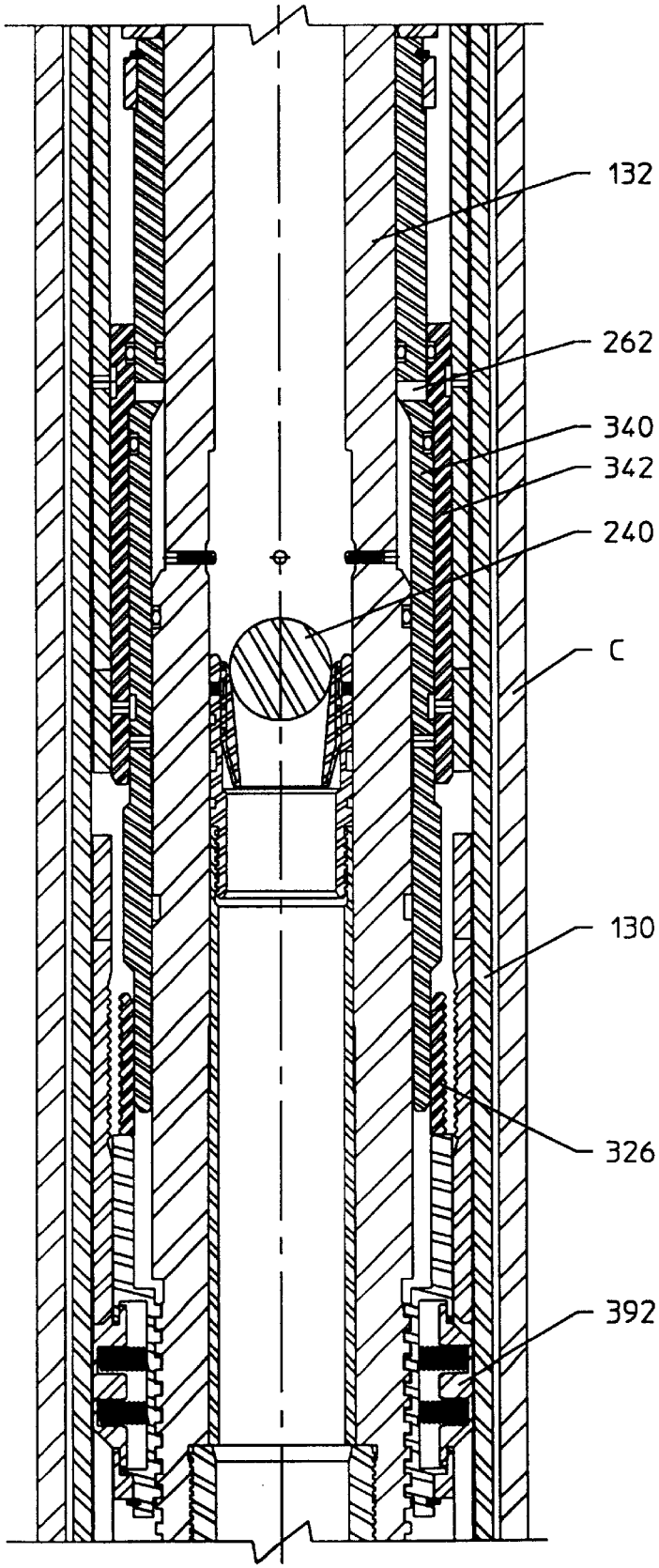
FIG. 10C illustrates the components once the pressure is increased to shift the ball seat, thereby releasing the running tool and disengaging a clutch.
Figure 10D:
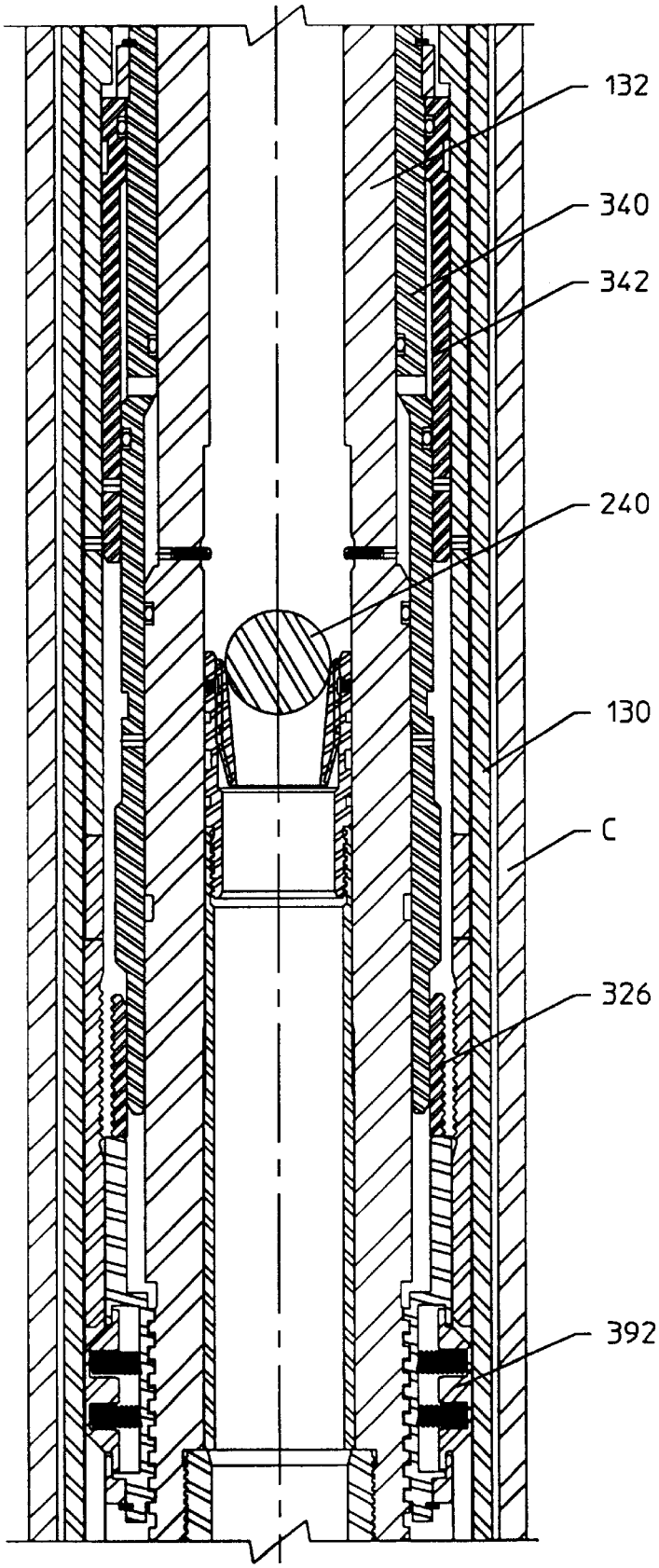
FIG. 10D illustrates fluid pressure acting on the second piston so the clutch can reengage the liner hanger.

If the slip 142 is a C-shaped slip, it has the ability to contract and expand between a contracted run-in position (as shown in FIG. 9A), and its extended or maximum expansion position (as shown in the FIG. 9C). This maximum expansion position preferably is the as-fabricated or as-machined position for each slip 142. Thus, the slips may be designed so as to approach this expanded position as the slips expand outwardly into engagement with the casing.

FIG. 9A shows the relationship of both the packer element 150 and the circumferentially spaced slips 142 about the upper and lower cones 152 and 144. In FIG. 9B, the slips are set and the packer element retracted. The packer element 150 is pushed downwardly over the upper cone 152 and into sealing engagement with the casing, as shown in FIG. 9C. Although the upper cone 152 is initially not yet set when the slips 142 are set, setting of the slips 142 does not urge the packer element outwardly, since the normally contracted packing element 150 is tightly held about the small end 153 of the upper cone 152 (see FIG. 9B) and is not moved downwardly until forced downwardly by the pusher sleeve 148.

The annular packer element 150 (see FIG. 1F) is disposed about a downwardly-enlarged upper cone 152 beneath the pusher sleeve 148. The packer element 150 is originally of a circumference in which its O.D. is reduced and thus spaced from the casing C. However, the packer element 150 is expandable so that it may be moved downwardly over the cone 152 to seal against the casing.

Figure 6A:
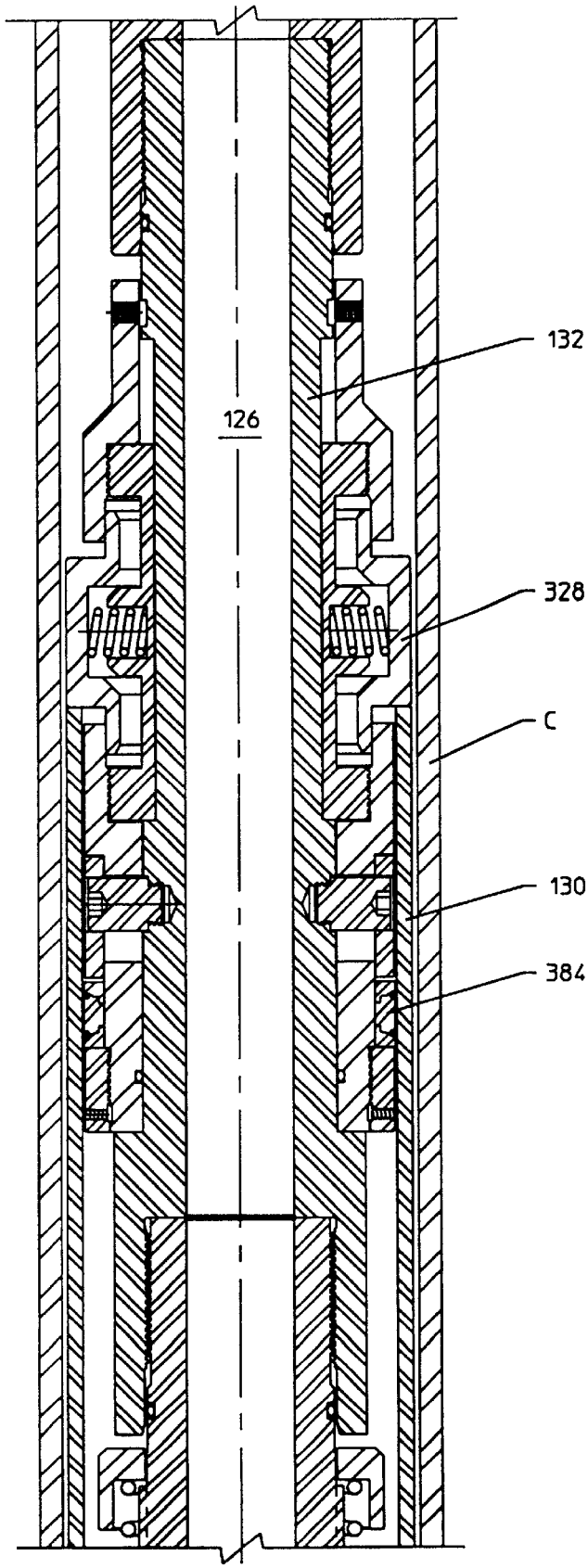
FIG. 6A illustrates the tool positioned to weight set the packer element.
Figure 6B:
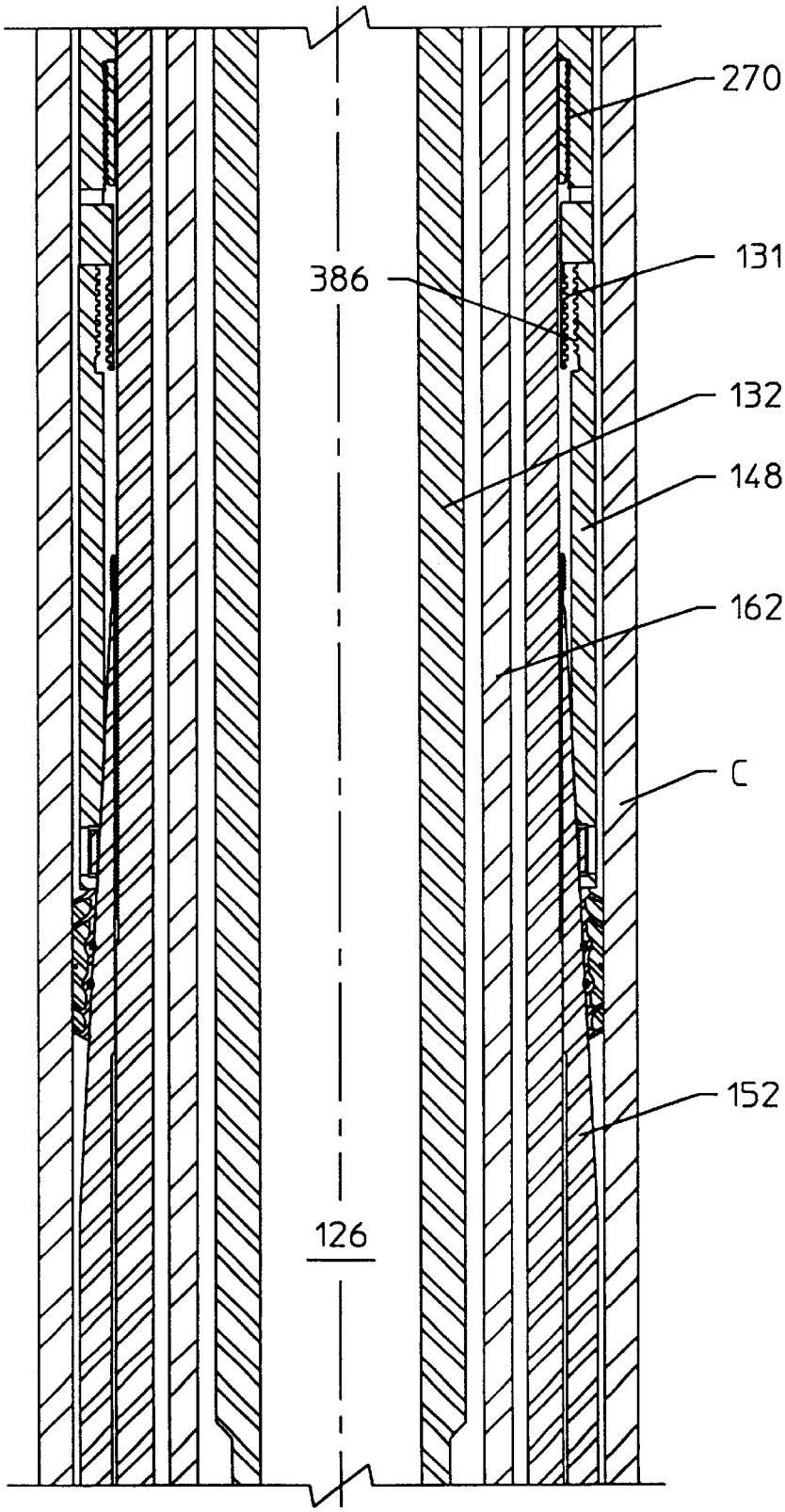
FIG. 6B illustrates the packer element in the set position.
Figure 7A:
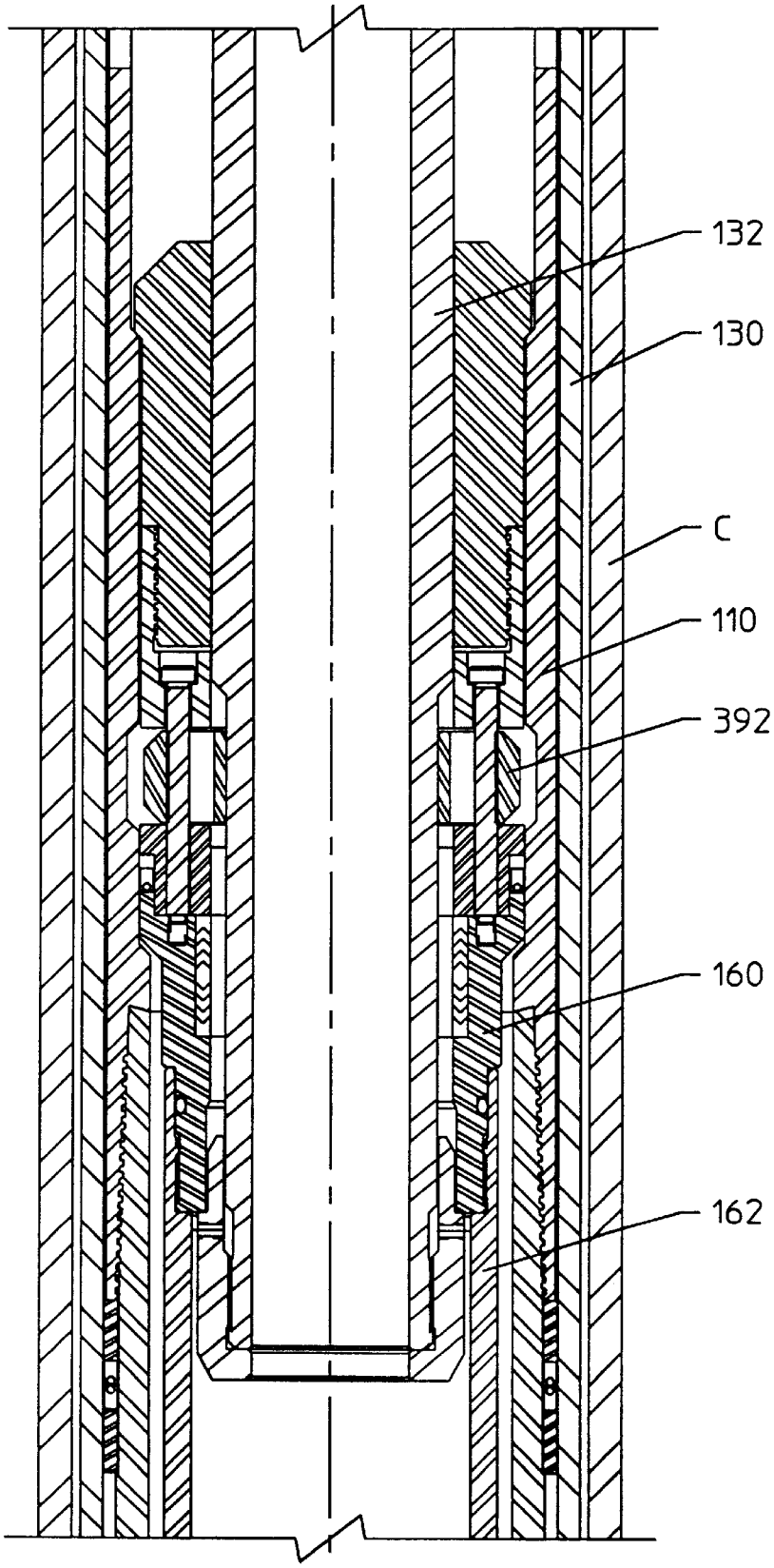
FIG. 7A illustrates the running tool packoff bushing unlocked from the liner hanger.

The packer element 150 is adapted to be set by means which includes spring-pressed lugs 328 which, when moved upwardly out of the tie back receptacle 130, will be forced to an expanded position, as shown in FIG. 6A, to engage the top of the tie back receptacle. When weight is set down, the expanded lugs 328 transmit this downward force through to the pusher sleeve 148 and the packer element 150. A body lock ring 270 (see FIG. 1F) is disposed between the tie back connector 130 and the pusher sleeve 148 and permits the packer element 150 to be forced downwardly over the upper cone 154 by lowering of the tie back connector. Upward movement of the set packer element is prevented.

The packer element 150 may be of a construction as described in U.S. Pat. No. 4,757,860, comprising an inner metal body for sliding over the cone and annular flanges or ribs which extend outwardly from the body to engage the casing. Rings of resilient sealing material may be mounted between such ribs. The seal bodies may be formed of a material having substantial elasticity to span the annulus between the liner hanger and the casing C.

The lower ball seat 246 (see FIG. 1D) is mounted within the running tool bore by shear pins 248 opposite the pressure chamber 256. Sleeve 245 thus supports seat 246. The lower end of the ball seat has reduced thinner section or neck 258. Furthermore, one or more ports 260 formed in the running tool are positioned to be uncovered to permit fluid pressure in the running tool to be admitted to the pressure chamber 256 upon lowering of the seat 246. The ball 240 when released from the upper seat 232 will land onto the second seat 246, whereby pressure within the running tool above the ball will move the seat 246 downward upon shearing the pins 248 to open the ports 260 leading to the pressure chamber 256.

The ball 240 may thus pass through the first seat 232 for seating on the reduced diameter 258 of the second seat 246 so that additional pressure may be supplied through the ports 260 for raising the outer piston sleeve 252. This in turn permits split ring 264 having outer teeth gripping the liner hanger 110 to move into position opposite a reduced diameter lower end 268 of the sleeve 252 and thus out of gripping engagement with the liner hanger, whereby the running tool is released from the liner hanger.

At this stage, the operator will pressure up to pass the ball through seat 246, so that the drop in pressure will indicate that the ball 240 has passed through the ball seat 246, allowing circulation through the running string to continue, and the ball to be pumped downwardly into the ball diverter 280 (see FIG. 1I). Fluids are then circulated through the tool awaiting cement displacement. The cement is then injected into the running tool and pumped downwardly, and the pump down plug 182 follows the cement and into the liner wiper plug 180 (see FIGS. 1J, 5A and 5B). This then forms a barrier to the previously displaced cement and the displacement fluid.

The lower end of the running tool mandrel 132 extends downwardly below the slip assembly and has an enlarged body 145 (see FIG. 1I) adapted to reciprocate within the liner 146. This enlarged body 145 has an upwardly facing shoulder 147 which may be raised into engagement with a downwardly facing shoulder to permit the running tool to be raised out of the set liner hanger, as will be described.

Figure 4A:
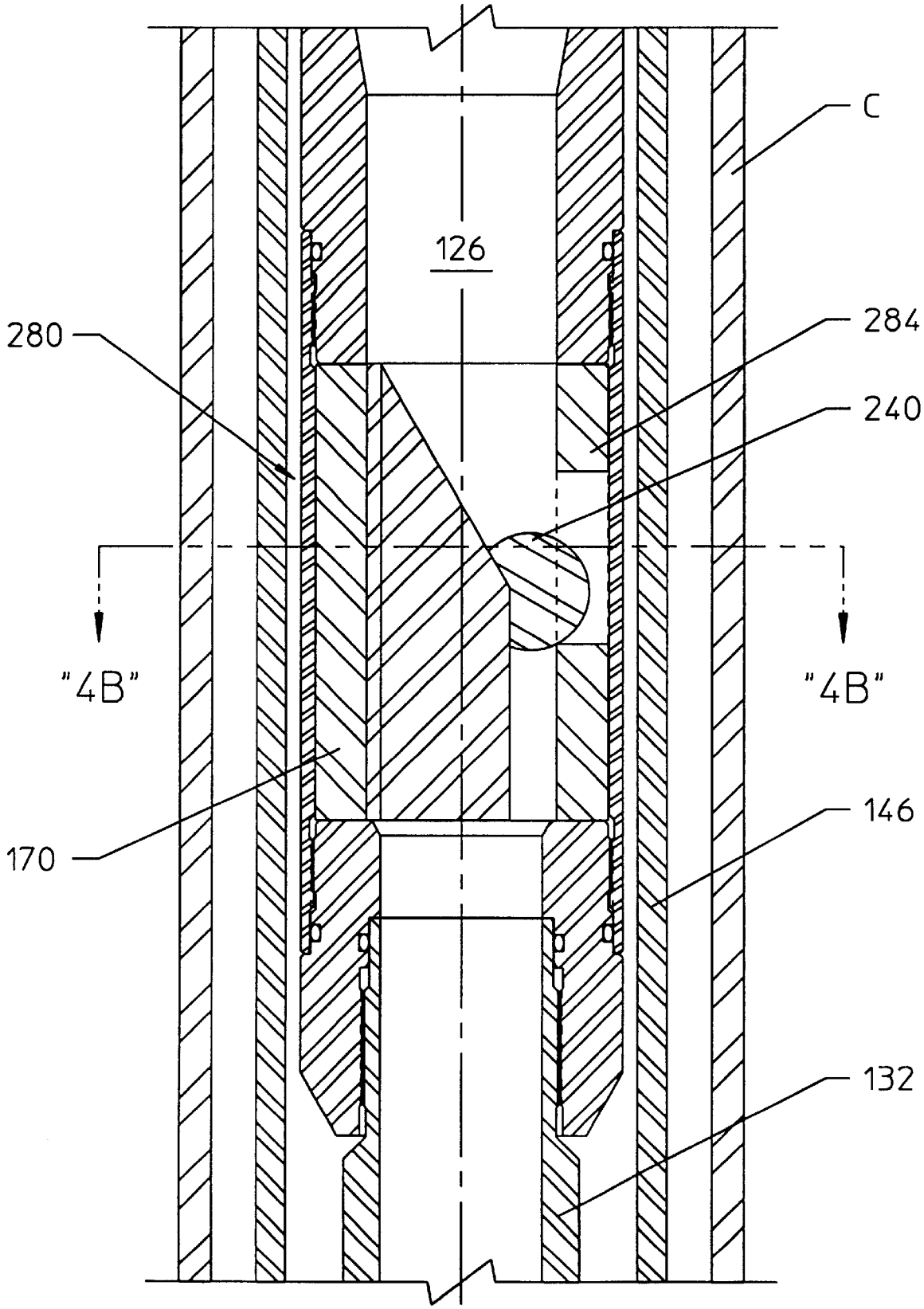
FIG. 4A illustrates the ball released from the lower seat and dropped into the diverter.
Figure 4B:
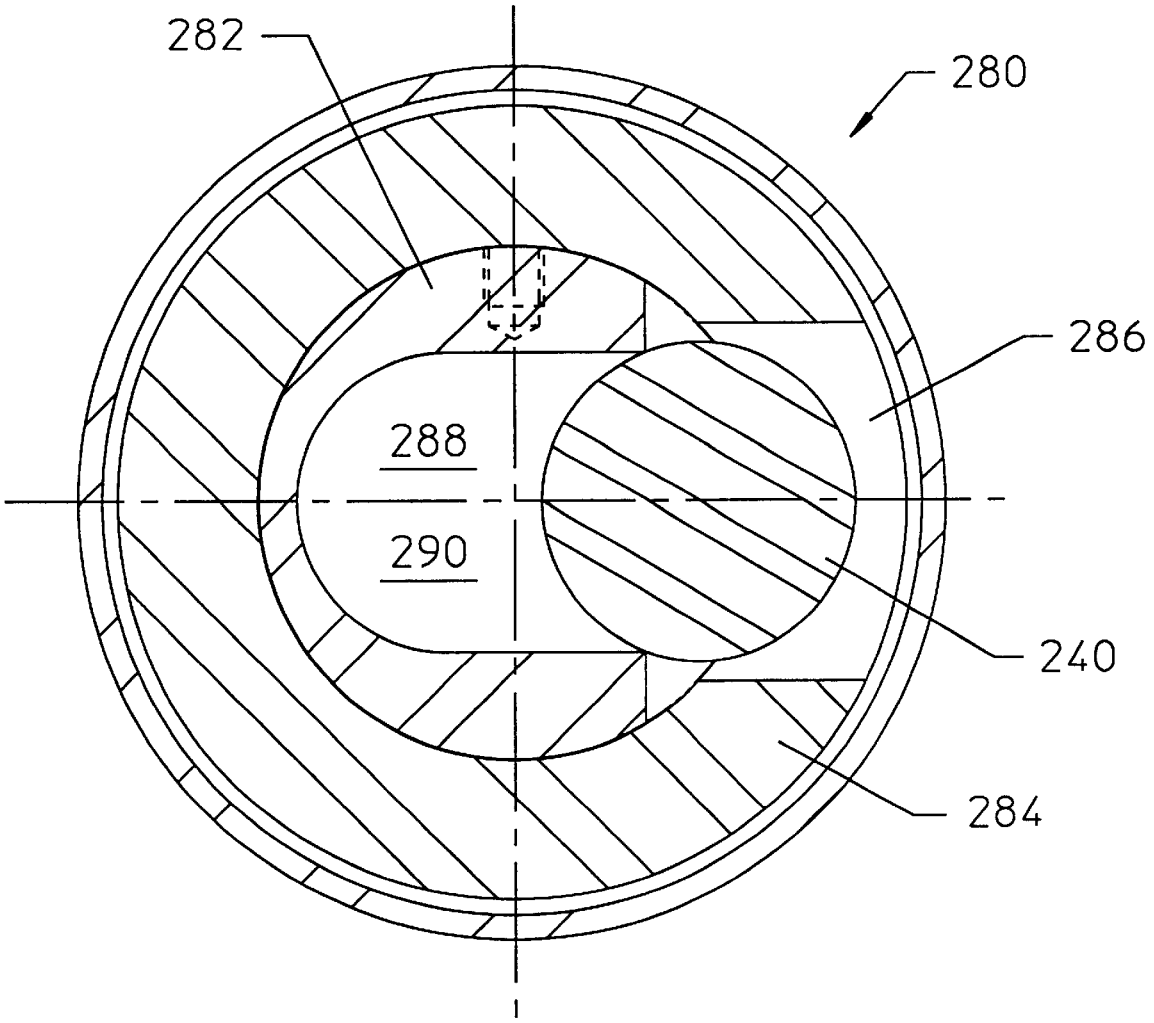
FIG. 4B is a crossed section through FIG. 4A.

The ball diverter 280 is suspended from the lower end of the running tool 120. As shown in FIG. 4A, the ball 240 is in place within the diverter. FIG. 4B shows the upper end of a U-shaped insert 282 secured to the I.D. of the diverter sleeve 284 forming a ball slot 286.

The throat 288 of the insert 282 is somewhat smaller than the O.D. of the ball 240 so that the ball outer edges contact the sides of throat 288 when the ball seats on the lower end of the slot 286. The ball 240 is thus contacted at these points in a rest position to define a passageway 290 through the ramp to the left of the ball. If desired, the left side of the ball may be engaged by a larger object to urge the ball to a further radially outward position in the slot 286 of the sleeve 284.

FIGS. 2–8 illustrate movement of components of the tool 120 in the process of setting the liner. Once the liner is lowered to the desired depth, fluids are circulated through the well bore "bottoms up". After conditioning the well bore, the ball 240 is dropped from handling equipment at the surface and allowed either to free fall or be pumped at a desired rate onto the upper seat 232. Upon application of pressure to the seated ball, pins 222 between the seat and the liner hanger setting assembly are sheared to permit the ball and seat to move downwardly to a position uncovering ports 242 in the body of the slip setting assembly 140. The further application of fluid pressure will cause the surrounding piston sleeve 220 to travel upwardly. As a result, the tie back receptacle 130, the actuator slip slat 149 and slips 142 are pulled upward until the circumferentially spaced slips engage with the casing C. Thus, as shown in FIG. 2A, the piston sleeve 220 of the slip setting assembly 140 surrounding the running tool mandrel 132 has been moved upwardly by the increase in pressure above the ball 240. The piston sleeve 220 is moved upwardly until the upper end 312 of the piston sleeve 220 engages and releases the split lock ring 244. This enables the tie back receptacle 130 to continue to be moved upwardly.

On the other hand, raising of the tie back receptacle 130 raises the cone 144, slip arm 149 and slip 142 to the set position, as shown in FIG. 2B. At this time, the load on the liner can be slacked off onto the slips, whereby the weight of the liner is "hung" in the casing. While holding pressure constant in the drill pipe to keep the slips in contact-with the casing, the liner hanger thus may be slacked off onto the slips. To be certain that the entire liner load is slacked off onto the liner hanger assembly 110, additional pipe weight may be applied to check for hanger movement. Once it is determined that the slips have been hung, the fluid pressure can be reapplied to the seated ball 240 to a higher predetermined level, so that the ball may be pumped to the lower seat 246 in the liner hanger releasing assembly 250. With the ball so seated, a predetermined pressure may be applied to move the ball seat 246 and sleeve 245 downward to uncover the ports 260 in the liner hanger releasing assembly. Higher fluid pressure may then be applied to cause the piston sleeve 252 to move upwardly, thereby allowing the liner hanger releasing ring 264 to collapse within the reduced diameter lower end 268 of the sleeve 252, thereby disengaging the running tool from the liner hanger. If the hydraulic release is not operable to move the ring 264 to disengage the running tool, the operator may resort to a mechanical release mode. The function of the ball in releasing the running tool from the set liner hanger is discussed below.

Figure 5A:
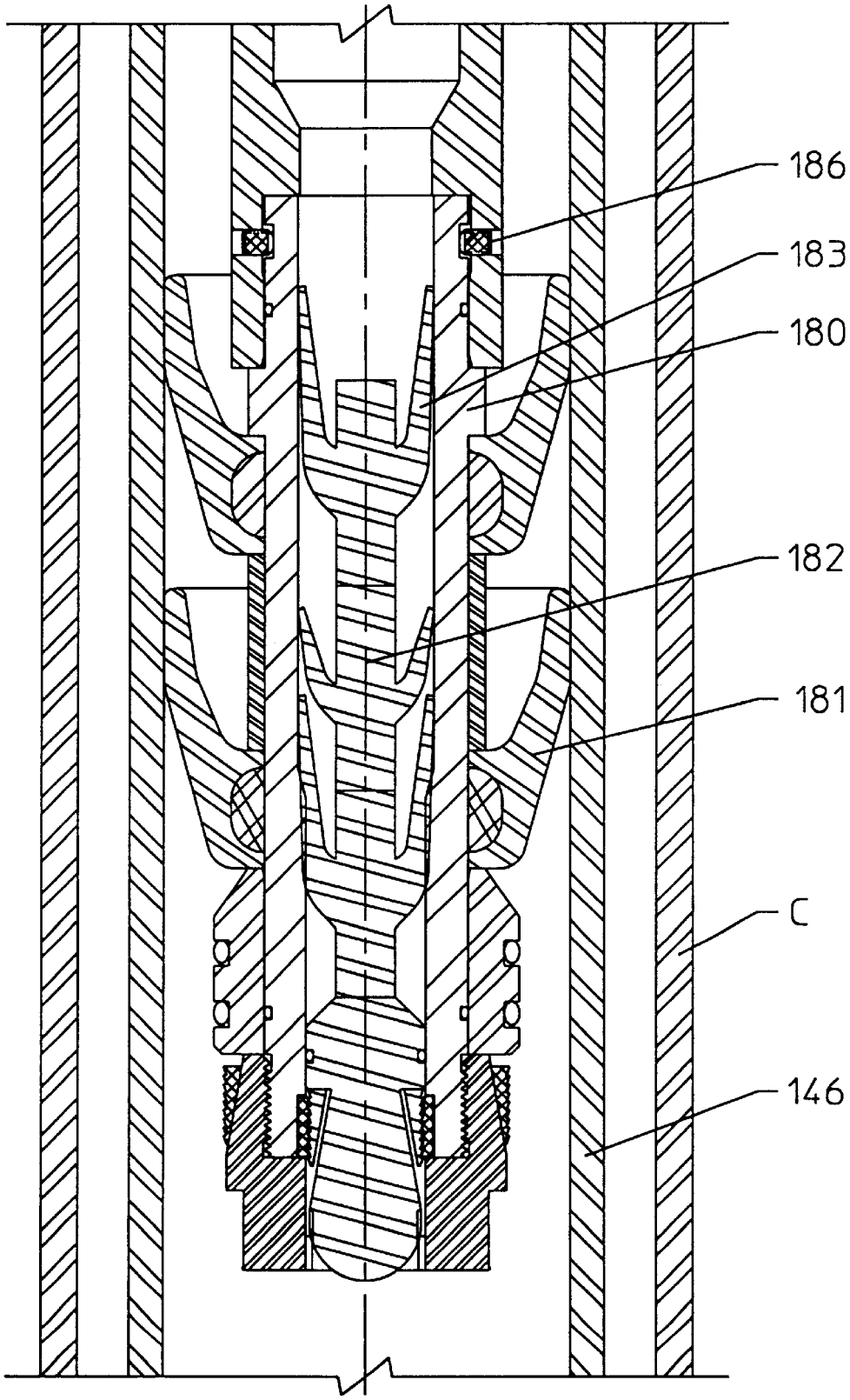
FIG. 5A illustrates the pump down plug landed on the wiper plug.

The further increase in pressure on the ball 240 and the lower seat 246 will release the ball from the lower seat so that circulation through the running string may continue while the ball 240 is pumped downwardly into the ball diverter 280. Fluids may then be circulated through the tool awaiting cement displacement. The cement and the displacement fluid are then injected into the running tool and pumped downwardly. When the cement has been pumped, the pump down plug which seals with the drill pipe is released from the surface handling equipment to land on a seat in the liner wiper plug, thereby forming a barrier between the previously displaced cement and the displacement fluid. A calculated amount of displacement fluid is required to pump the drill pipe plug down to the lower liner wiper plug. The operator observes the pressure increase when the pump down plug 182 latches into the liner wiper plug 180. The pump-down plug 182 (see FIG. 5A) thus follows the cement into the liner wiper plug 180. As the pump-down plug gets close to the running tool, the pump rate may be lowered so as to reduce the risk of malfunction between the latching and sealing of the lower wiper plug and the pump-down plug. This allows observation of the pump pressure increase when the pump-down plug 182 has landed in the lower wiper plug 180, as shown in FIG. 5A.

Figure 5B:
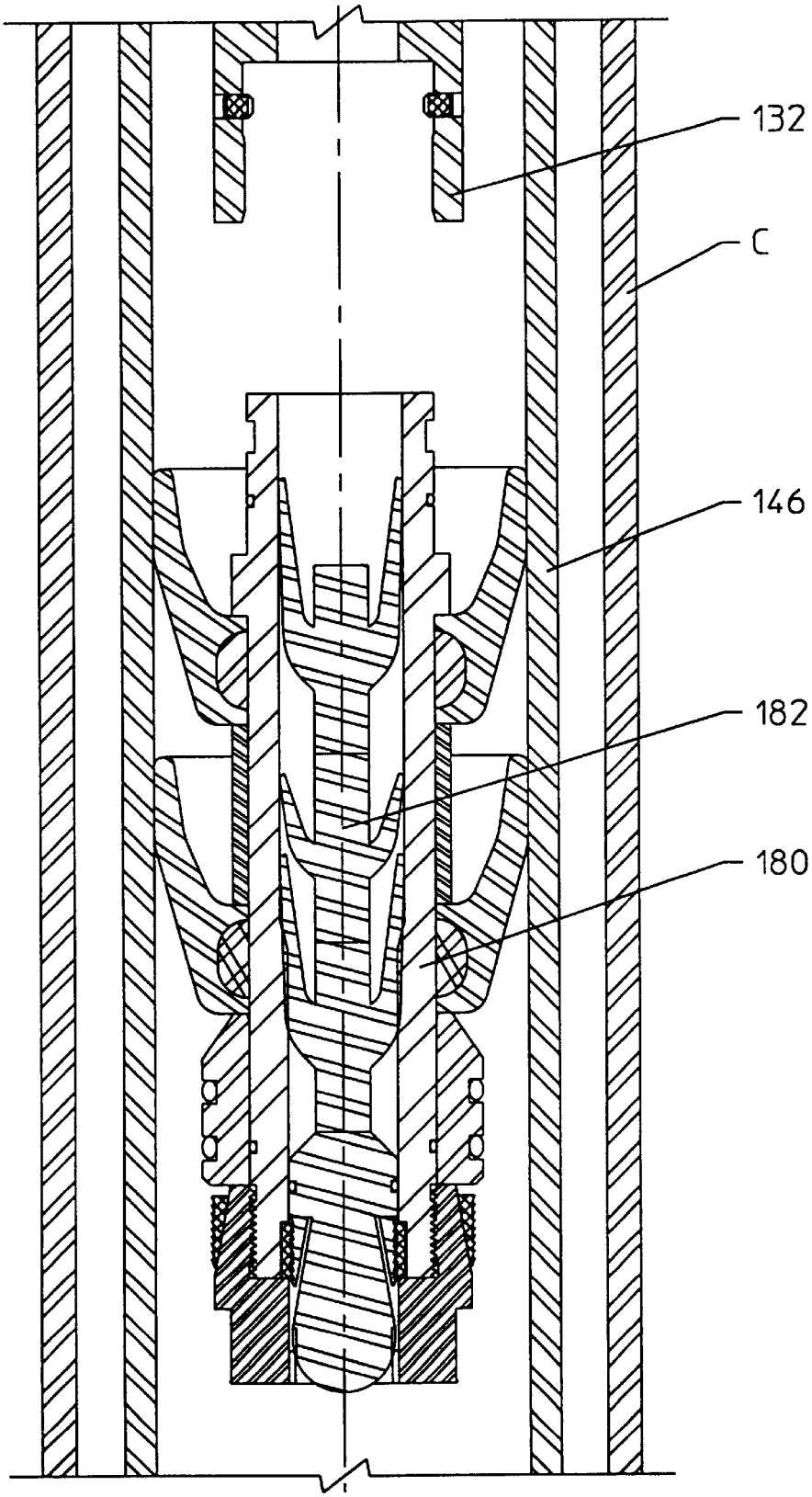
FIG. 5B illustrates the liner wiper plug and pump down plug released.
Figure 5C:
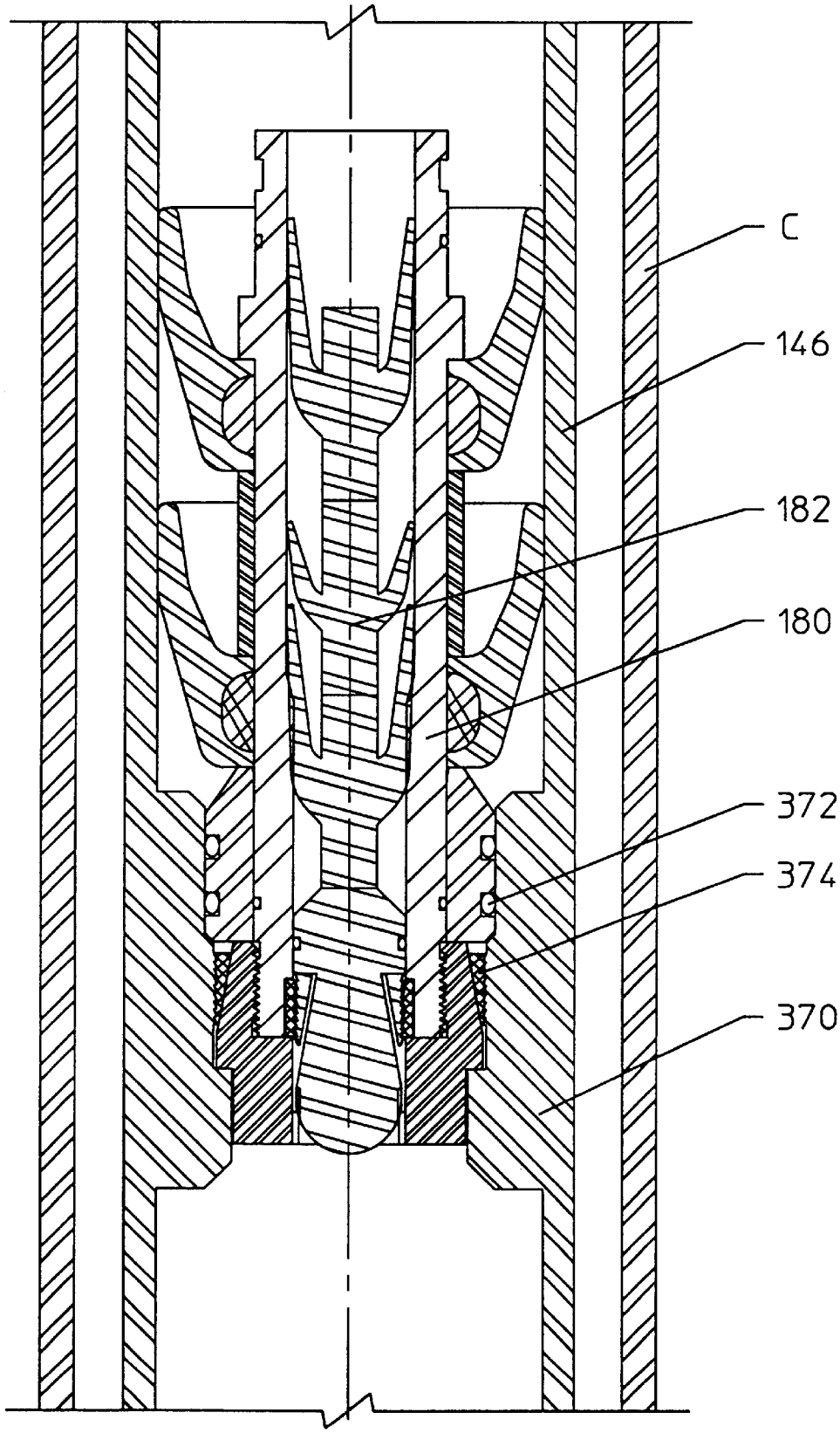
FIG. 5C illustrates the plug set landed within a landing collar.

It takes a calculated amount of displacement fluid to force the cement to the desired height in the annulus between the liner and casing. The drill string may be pressured to the predetermined level to shear the pins 186 (see FIG. 5A) connecting the plug set to the running tool. With the liner wiper plug released as shown in FIG. 5B, displacement fluids move the plug set down the liner 146 to the landing collar 370. The plug set thus forms a barrier between the cement and the displacement fluid, and keeps the displacement fluid from contaminating the cement fluids. A calculated amount of displacement fluid may be used to force the cement to desired height in the annulus between the liner and the casing.

The operator continues to pump displacement fluid until the liner wiper and pump down plug set latches into the landing collar 370 (see FIG. 5C) located in a lower portion of the casing. When so landed, seals 372 about the plug set seal within the upper reduced bore of the landing collar 370, and slips 374 with toothed surfaces engage the opening in the landing collar to prevent upward movement of the landed plug by any downhole pressure. At this time, pressure in the running tool may be increased to a substantial level above circulating pressure to be sure that the wiper plug is properly landed and held down, and that the seals between the plug set and the landing collar are effected. The plug may then be tested by bleed-off pressure to insure that the flotation equipment below the landing collar 370 is holding.

Conventional cementing equipment may be used beneath the diverter 280, including the above described plugset which forms a barrier to different fluids flowing down the liner. A pump down plug 182 as shown in FIG. 5A may include upwardly facing cups 183 for cleaning the drill string, so that increased pressure in the running string when the plug 182 seals with the liner wiper plug 120 releases both plugs (the set) from the lower end of the liner hanger. The liner wiper plug 180 has similar cups 181, and lands on the collar 186 to be sealingly locked in place and close off the lower end of the casing.

The released running tool 120 may be picked up until the packer setting assembly 380 (see FIG. 1C) is removed from the top of the tie back receptacle 130, whereby the spring pressed lugs 328 are raised to a position above the top of the tie back receptacle, at which time they expand outwardly.

With the packer setting assembly 380 in its expanded position, weight can be slacked off by engaging the lugs 328 with the top of the tie back receptacle to cause the packer element 150 to begin its downward sealing sequence. This weight also activates a sealing ring 384 between the packer setting assembly 380 and the tie back receptacle to aid in further setting the packer element with annulus pressure assist. With the packer element 150 in engagement with the casing, rams on a BOP at the surface may be closed onto the drill pipe to form a pressure vessel between the rams and the expanded packer. The cross sectional area between the casing and the drill pipe is known and the load required to fully set the packer element 150 is known, so that the operator may apply pre-determined fluid pressure to the annulus to cause the tie back receptacle to move down applying a predetermined additional axial load to the packer element.

Downward movement of the pusher sleeve 148 to set the packer element 150 will disengage the internal threads 386 (see FIG. 6B) of the pusher sleeve from the tie back receptacle 130. The pusher sleeve 148 thus moves radially outwardly as the pusher sleeve moves down the cone 152. The pusher sleeve 148 may be split along its circumference in such a manner that in its normal contracted position, its internal threads 386 would engage the external threads 131 on the tie back receptacle 130. Other types of pusher sleeves may be used.

The mandrel 132 of the released running tool 120 may then be raised to raise the cementing bushing 160 to cause the lugs 392 on the bushing to move in and unlock from the liner hanger 110. After pulling the lower end of the running tool to a predetermined position at the upper end of the liner, the operator may circulate fluid through the running tool to pump any excess cement to the surface. Circulation effectively reduces the amount of cement that will need to be drilled out before reentering the top of the liner, and enables the operator to check for fluid flow and/or fluid loss.

Figure 8A:
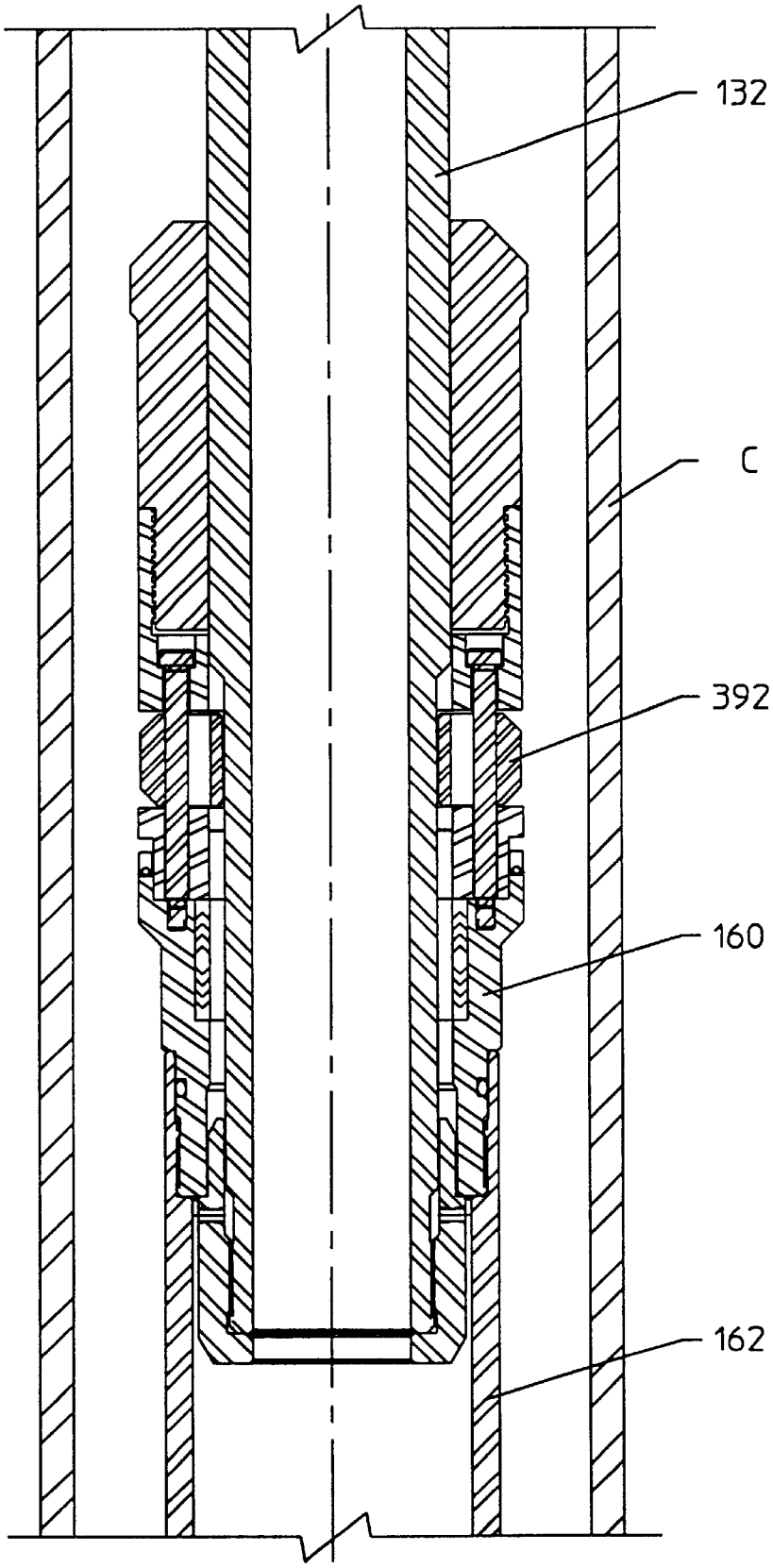
FIGS. 8A and 8B show the lower end of the running tool released from and pulled upward from the set liner hanger, with the upper portion of the set liner hanger being shown in FIGS. 8C, 8D and 8E.
Figure 8B:
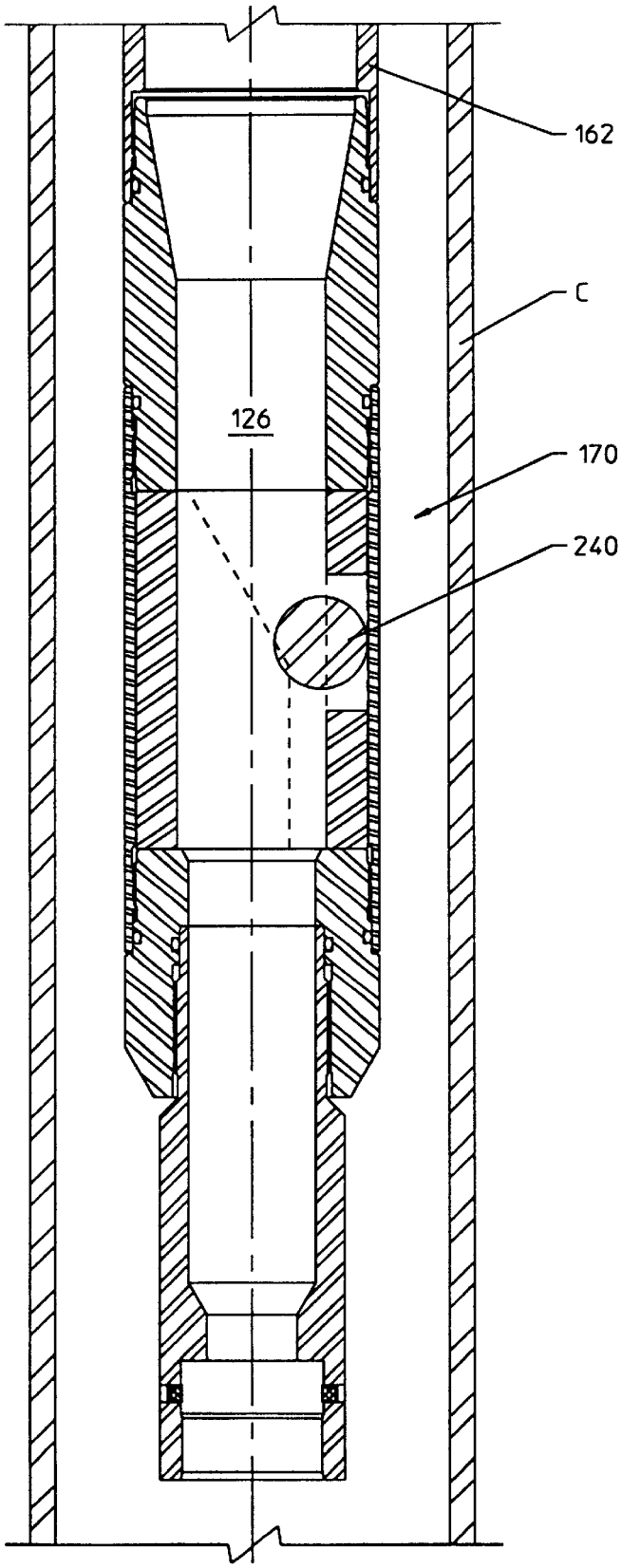
Figure 8C:
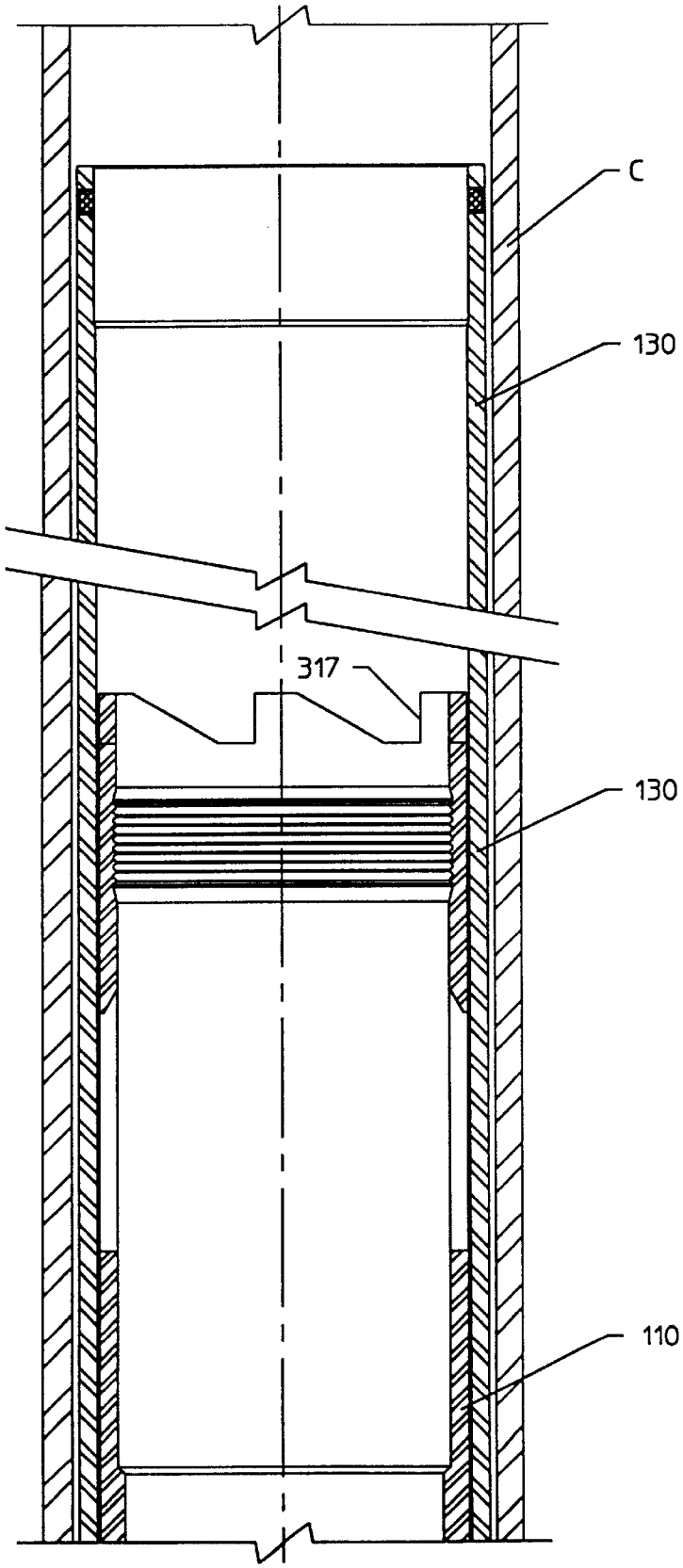
Figure 8D:
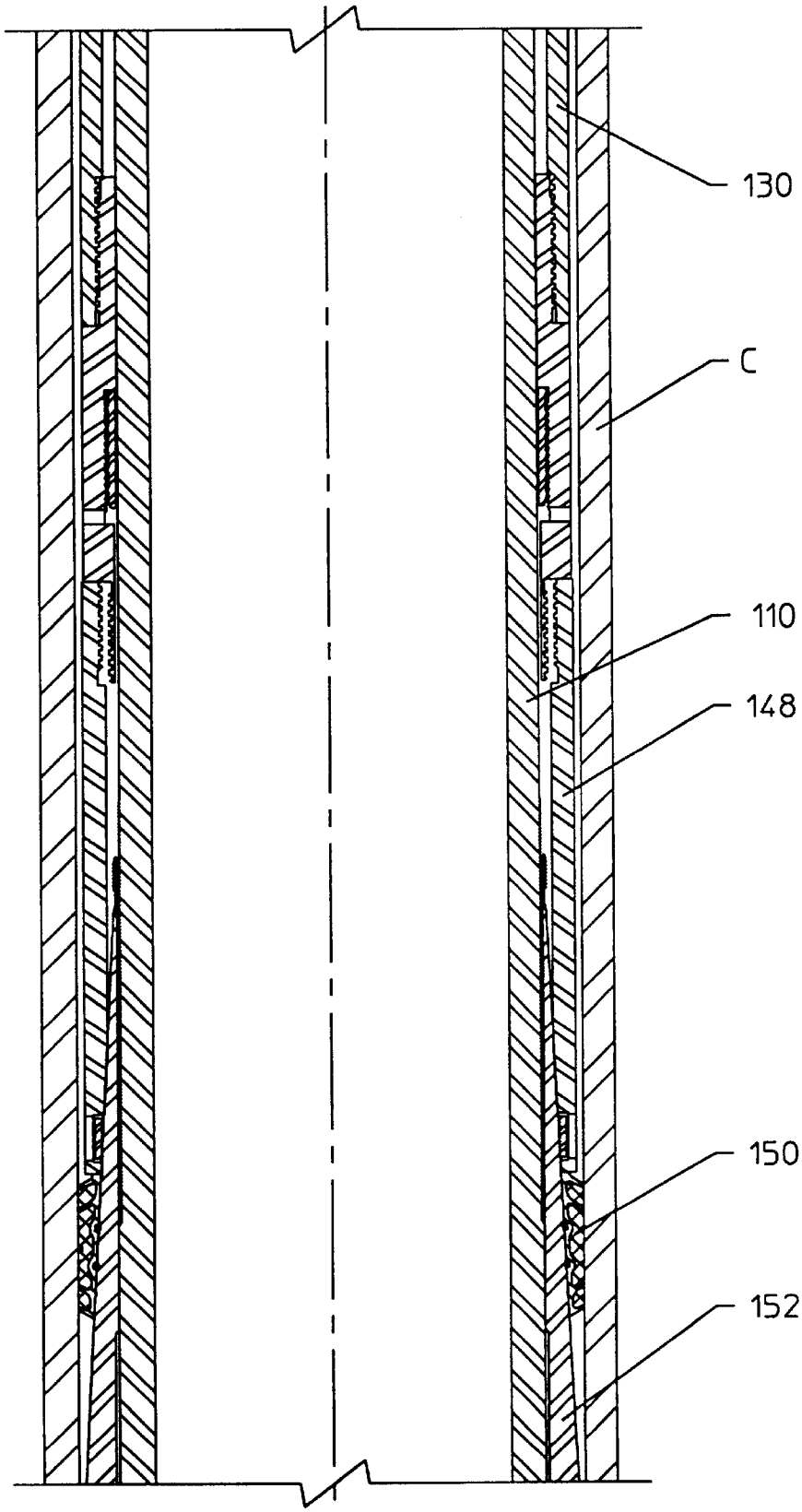
Figure 8E:
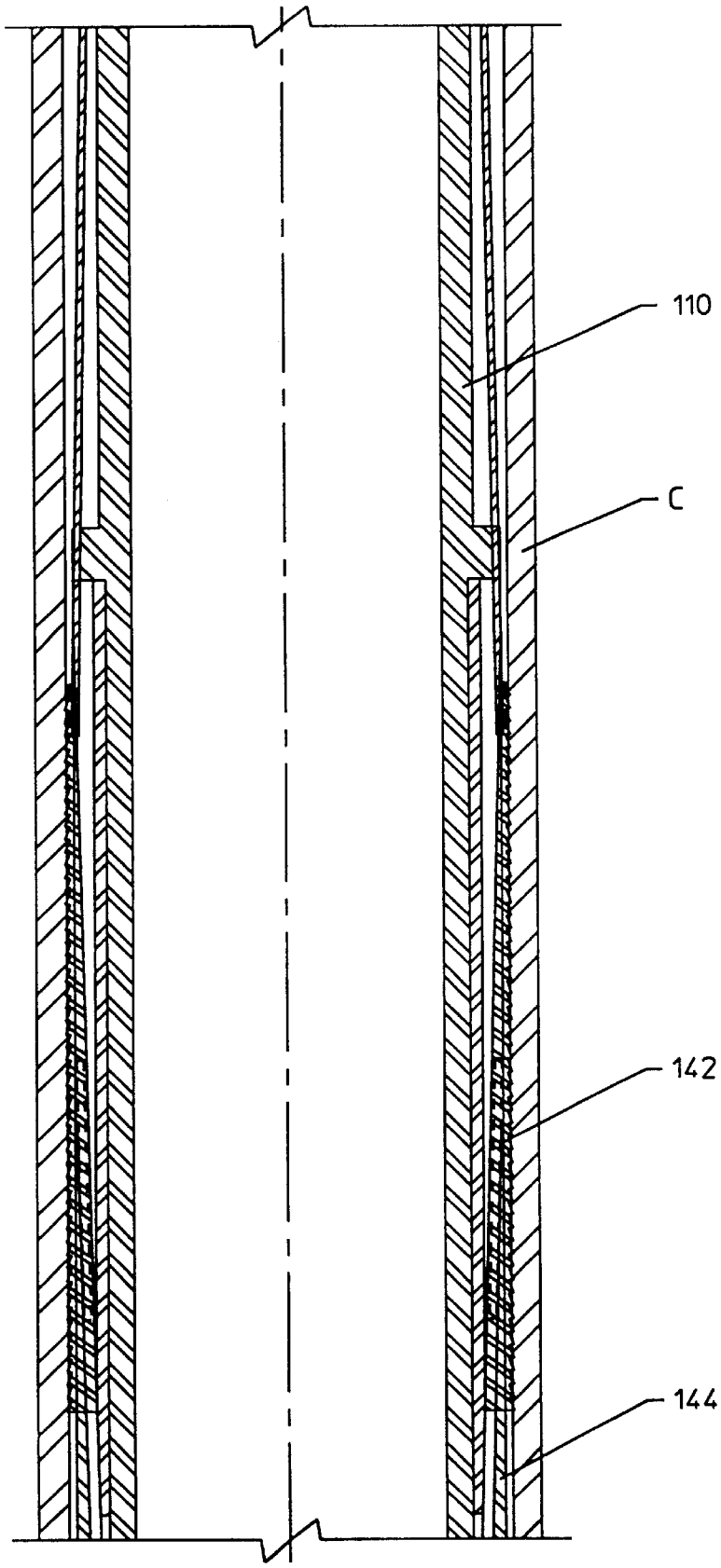

After the running tool is picked up to a pre-determined position above the liner top, the operator circulates through the drill string to pump any excess cement to the surface, thus reducing the amount of cement that will need to be drilled out before reentering the top of the liner. FIG. 8A shows the released running tool 120 raised from the liner. Upon checking for fluid flow and/or fluid loss, the operator pulls the running tool out of the hole. Once the tool reaches the surface, the operator may check for damage to the running tool, wash fluids off the tool, and flush the tool I.D. before returning the tool to the shop. FIG. 9C also shows what remains in the casing C, namely the set packer 150 and set slips 142.

Figure 11:
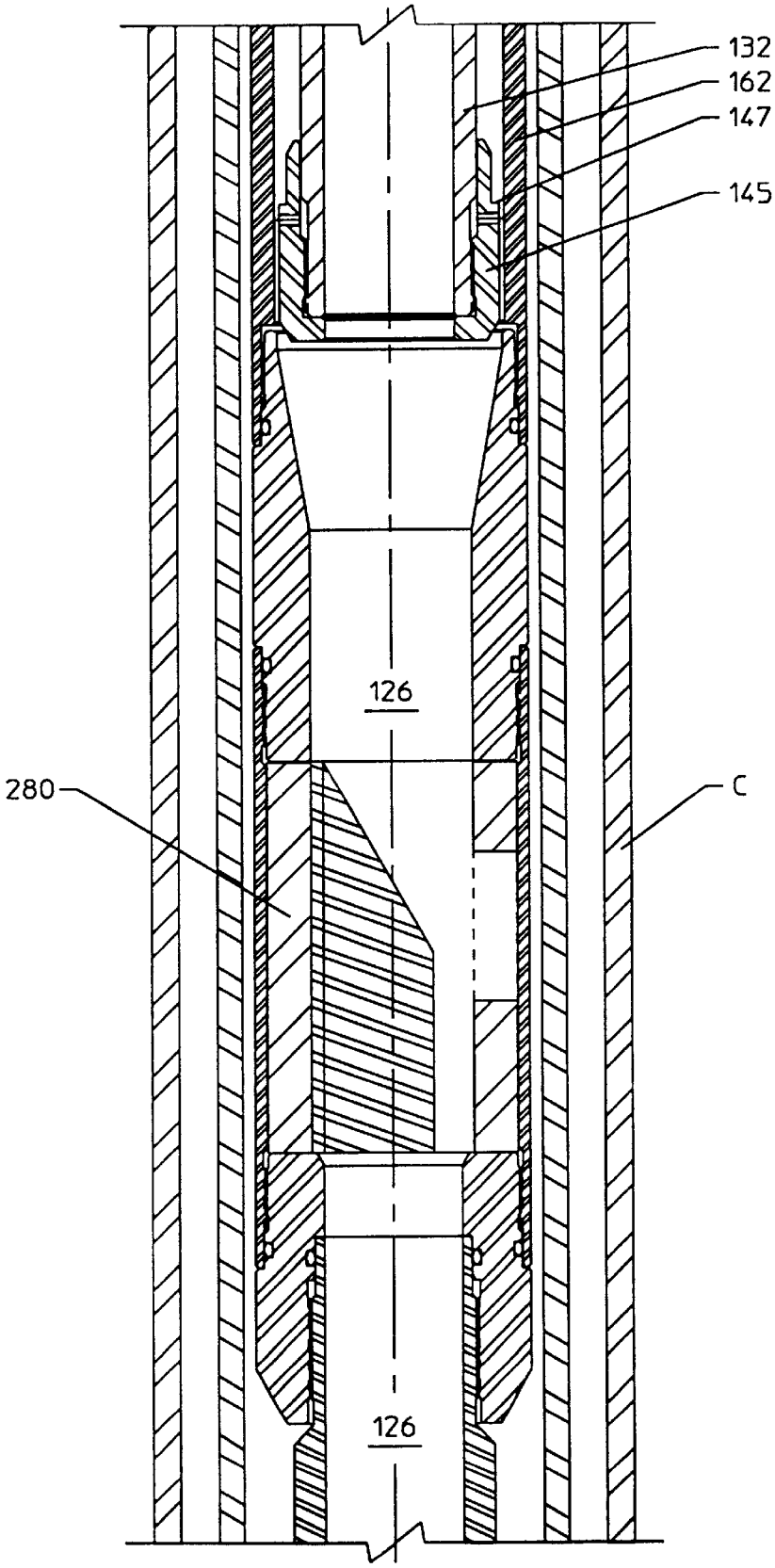
FIGS. 11A and 11B show sequential components of the running tool during a mechanical release from the liner hanger.
FIG. 11C shows the components with the ball seat shifted to release the running tool and disengage the clutch.
FIG. 11D illustrates the second piston activated to engage the clutch with the running tool released.
Figure 1J:
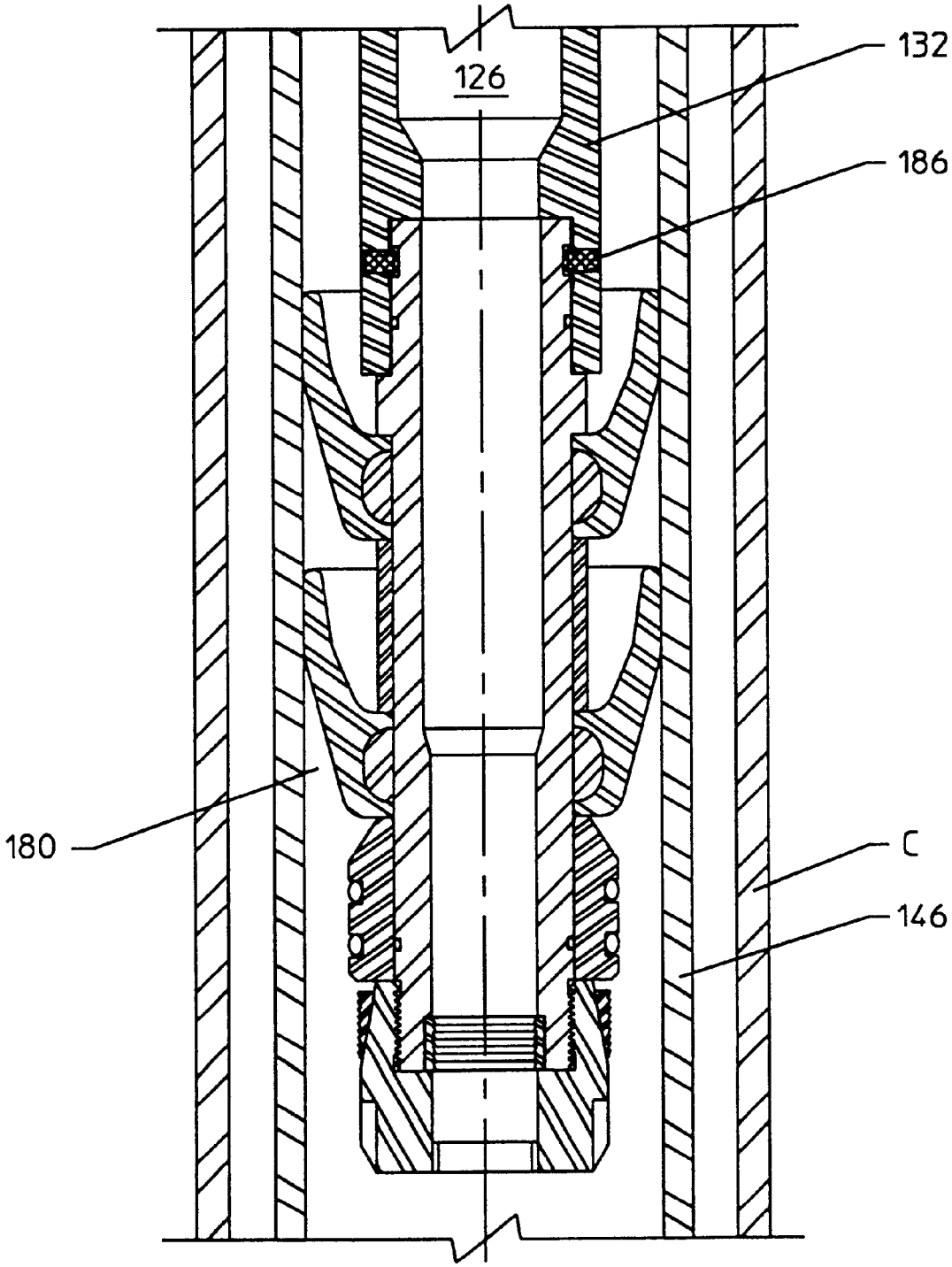

FIGS. 10 and 11 Liner Hanger Releasinq Assembly

The liner hanger releasing assembly 250 as shown in FIGS. 1D and 1E may be replaced with the releasing assembly shown in FIGS. 10 and 11. The liner hanger releasing assembly as shown in FIGS. 10 and 11 may still be disposed beneath the packer setting assembly 380 as described above or the packer setting assembly 52 described below, and includes an inner piston sleeve 340 sealably disposed about the running tool mandrel 132, and another piston sleeve 342 disposed about the inner piston sleeve. The piston sleeve 340 forms a pressure chamber similar to the sleeve 252 shown in FIG. 1D for releasing the liner hanger.

The liner hanger releasing assembly as shown in FIGS. 10 and 11 releases the lock ring 326 which is externally grooved for engaging the grooved inner diameter of the liner hanger 110 of the upper end of the liner 146. The lock ring 326 is held in locking position by the enlarged upper outer diameter of the piston sleeve 340 which, as shown in the FIG. 10A, is in its lower position. At this time, the clutch 316 as shown in FIG. 1D is pressed downwardly by springs 318 to engage the liner hanger 110, which is threaded for engagement with right-handed threads 324 on the running tool mandrel 132. The nut 322 carries lugs 326 which are pressed outwardly by springs 327 into vertical slots formed in the liner hanger 110 to prevent relative rotation between the mandrel 132 and the liner hanger.

Upon raising of the inner piston 340, the lock ring 326 is free to contract inwardly about the lower reduced outer diameter 268 of the piston sleeve 340 and thereby free the running tool to be raised after setting of the slips but prior to setting of the packer, thus permitting circulation of cement downwardly through the tool and upwardly within the annulus between the tool and casing.

In the event the lock ring 326 is not released for any reason, such as frictional engagement between the I.D. of the lock ring 326 and the O.D. of piston 340 (see FIG. 11A), the operator has the option of releasing the running tool mechanically, as shown in FIG. 11. As shown in FIG. 11C, lowering of the ball 240 to open the port 260 in the running tool mandrel will permit pressure fluid to pass through the port 262 in the inner piston 340 to act upon the outer piston 342 and cause the outer piston to be moved upwardly upon shearing of the pin 358 (see FIG. 11A) between the inner and outer pistons. This permits the outer piston 342, which is connected to the clutch 316 by a shear pin 360, to raise the clutch 316 and to de-clutch it from the liner hanger.

Once the clutch 316 is disengaged, the operator may rotate the tool to the right so that with the right-hand threads between the threaded nut 322 and the running tool mandrel 132 lower the nut on the mandrel 132, as shown in FIG. 11C. Once the threaded nut 322 is lowered, the running tool may be picked up the distance the nut 322 moved down, thereby releasing the lock ring 326 and thus disengaging the running tool from the liner hanger. As shown in the FIG. 11D, the locking ring 326 has collapsed on the reduced O.D. 341 of the inner piston 340.

The running tool 120 may thus be lowered to engage its clutch with that of the liner hanger. The clutch 316 is pressed downwardly by the spring 318, so that the lower teeth 317 (see FIG. 8C) at the upper end of liner hanger 110 are engaged with similar teeth at the lower end of clutch 316 to maintain rotary engagement between the running tool and the liner hanger. As shown in FIG. 1D, the upper end 332 of the clutch 316 may be splined to the O.D. of the running tool mandrel 132 so as to permit relative axial movement with respect thereto under the urging of the spring 318. When the clutch 316 is engaged, rotation of the work string rotates the liner hanger. When the clutch is disengaged, rotation of the work string rotates the running tool mandrel 132 to move nut 322 with respect to thread 324, as described below.

Figure 11A:
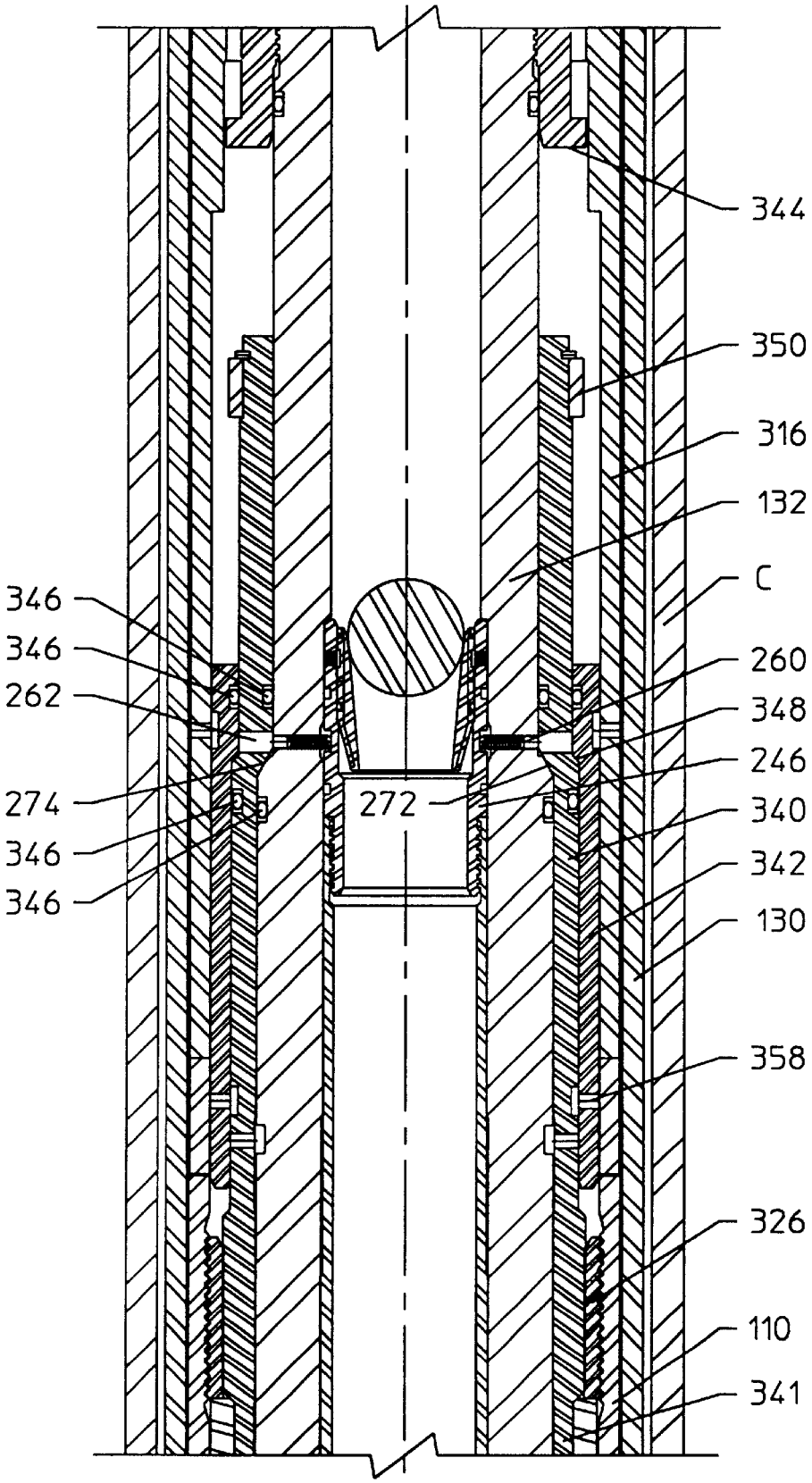
Figure 11B:
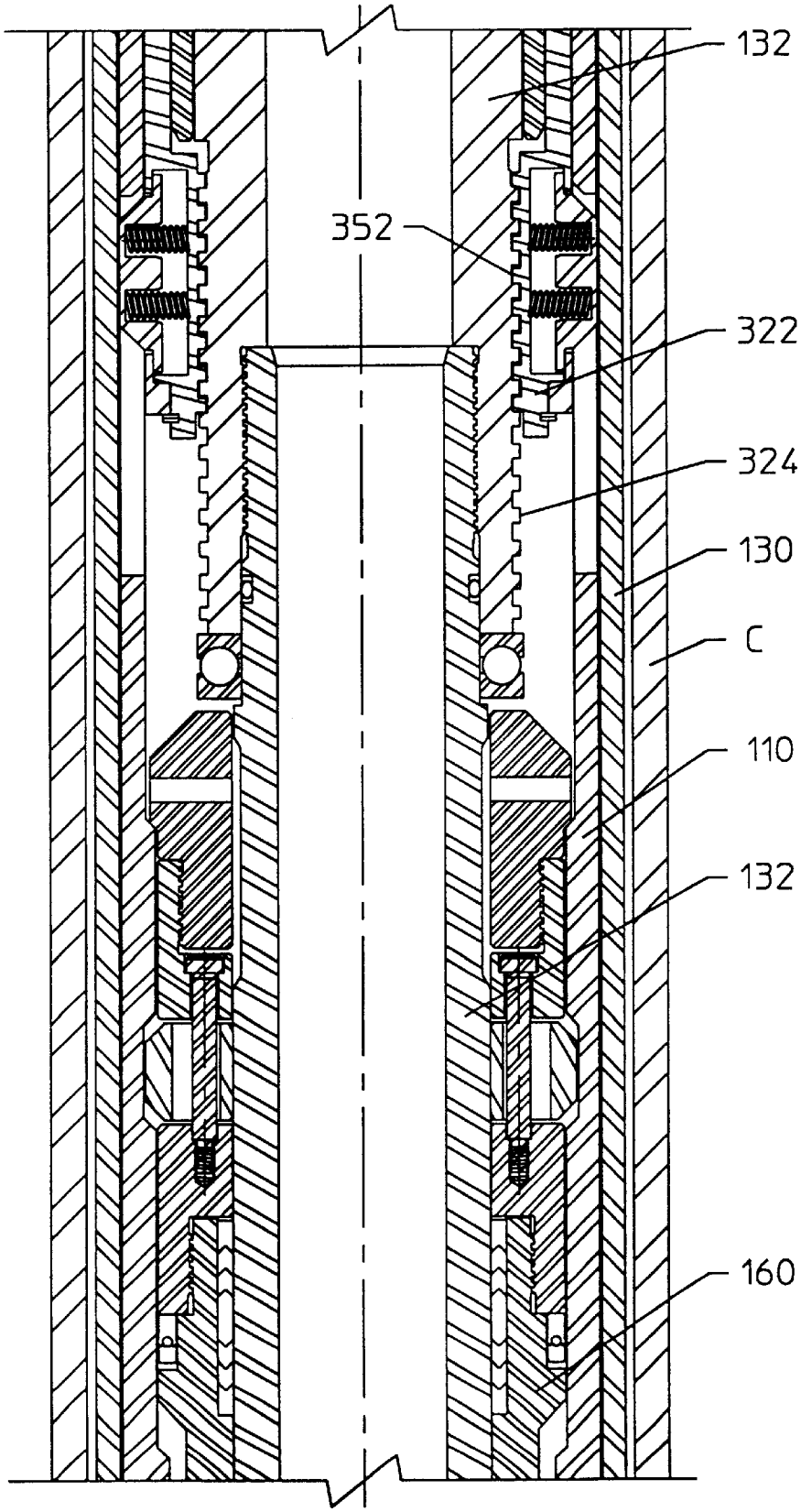
Figure 11C:
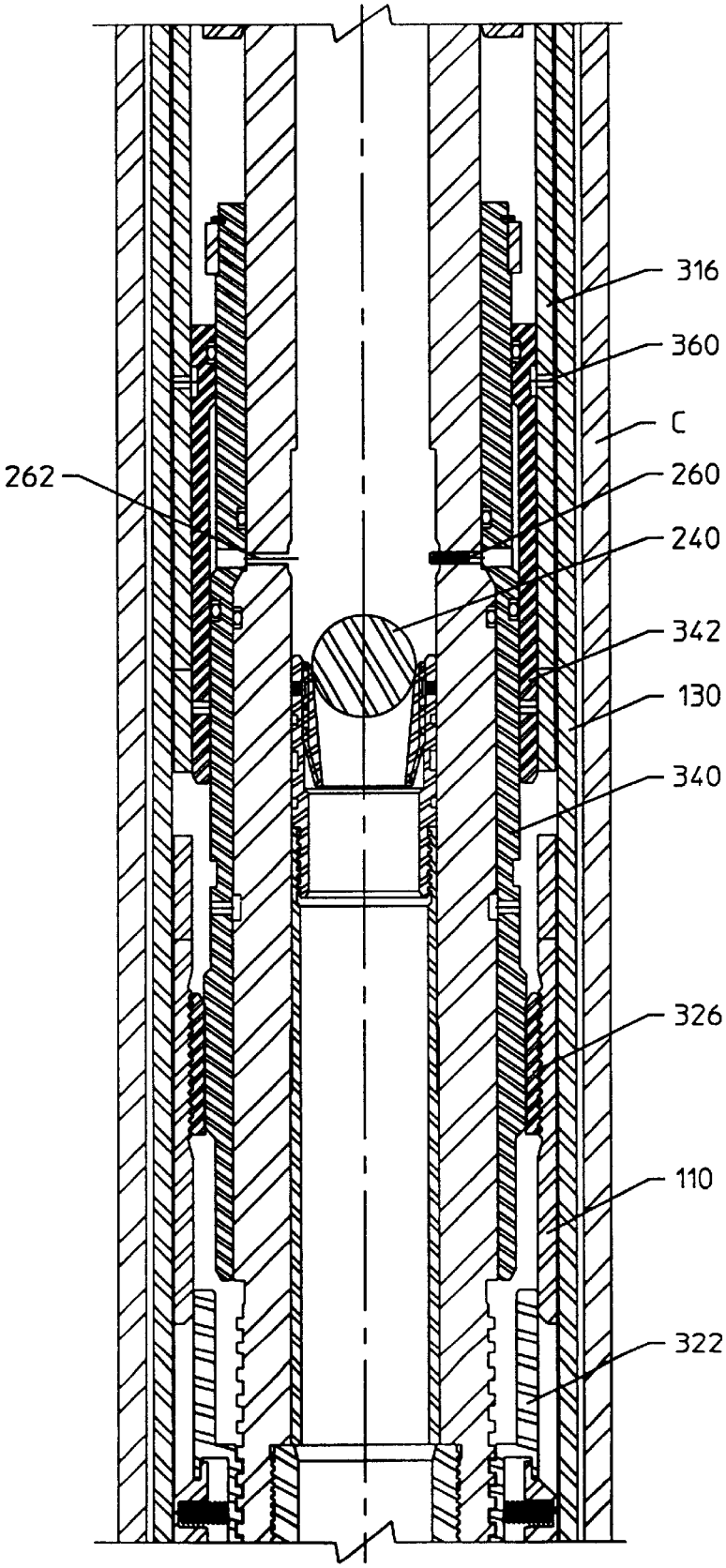
Figure 110:
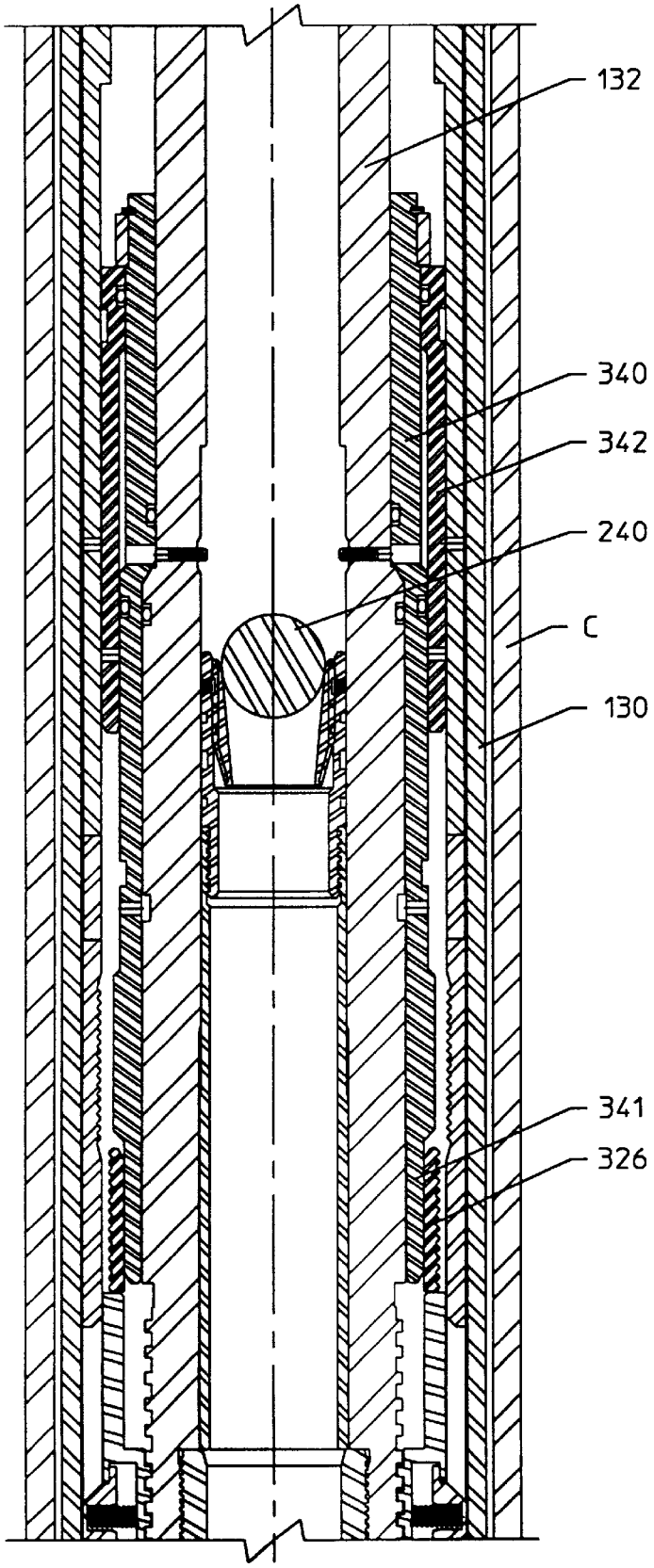

FIGS. 11A–C accordingly illustrates a liner hanger release assembly which enables the operator to release mechanically by right-hand rotation, in the event he is unable to release hydraulically. As shown in FIG. 11A and 11B, the running tool mandrel 132 is surrounded by the pair of inner and outer sleeve pistons 340 and 342. The inner piston 340 has a shoulder 272 for engaging shoulder 274 of the running tool mandrel 132. Intermediate seal rings above and below ports 260 are uncovered upon lowering of the ball 240 on the ball seat 246 to the lower position, as shown in FIG. 11C. Outer sleeve piston 342 surrounds the inner piston 340 and, while in the position as shown in FIG. 11A, is supported on the inner piston 340 by engaging an outer shoulder 348 on the inner piston with the generally opposite shoulder on the outer piston 342. More particularly, this shoulder 348 is generally aligned with the port 262 in the inner sleeve 340 and intermediate the upper and lower seal rings 346 between the inner and outer sleeves. A ring 350 forms a stop shoulder at the upper end of the inner piston 340 to limit upward movement of the outer piston 342 with respect to the inner piston. The inner piston 340 is stopped in a upward direction by a downwardly facing shoulder 344 on the running tool.

In the initial position of the assembly as shown in FIG. 11A, prior to lowering of the lower ball seat 246 and opening of the port 260 from the bore of the running tool, the lock ring 326 is held in a locked position between an enlarged diameter portion of the inner piston 340 and the inner diameter of the liner hanger 110. The nut 322 as shown in FIG. 11B is positioned below reduced diameter portion 341 of the inner piston 340, with the internal threads 352 engaged with the threads 324 about the running tool mandrel 132. As in the case of the previously described embodiment, the threaded nut 322 is prevented from rotation relative to the liner hanger assembly by spring pressed lugs 326 in vertical slots in the liner hanger 110. If the running tool is not hydraulically released by opening of the ports 260 to raise the inner piston 340 and release the lock ring 326, the running tool may be mechanically released by a second hydraulic release operation, as discussed above.

If the operator wishes to rotate the liner while cementing, higher fluid pressure is then applied to the outer piston 342 to shear pins 360 between the outer piston 342 and clutch 316, at which time the spring 318 will re-engage the clutch. The operator may then rotate the running tool mandrel 132, thereby rotating the liner hanger. Additional fluid pressure may then be applied to the ball 240 to force it through the reduced thinner diameter of the seat 246.

FIG. 12 Packoff Bushing

Figure 12A:
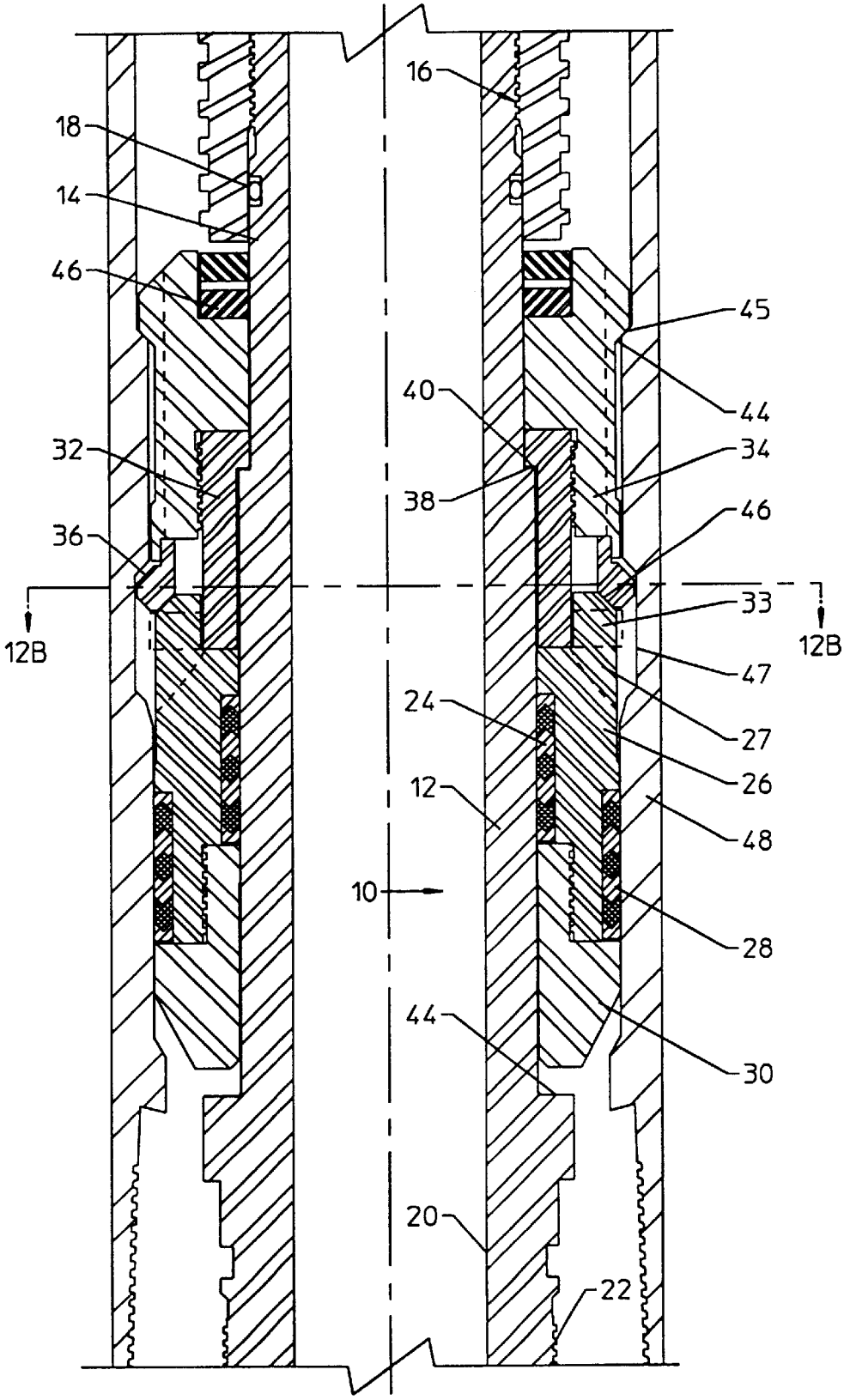
FIG. 12A is a cross-sectional view of a preferred retrievable packoff bushing according to the present invention, which may be positioned below a liner hanger packer setting assembly and above the ball diverter.

Referring now to FIG. 12A, a preferred embodiment of a packoff bushing 10 is depicted for sealing between a radially outward liner running adapter of the liner hanger and a radially inward running tool mandrel. The packoff bushing 10 is axially captured on the running tool mandrel or tubular body 12. The compact design of the packoff bushing and its limited axial movement on the running tool body 12 facilitates re-stabbing the packoff bushing into the liner hanger, as explained below. The upper end 14 of body 12 includes threads 16 and seal 18 for sealed engagement with the lower end of the liner hanger releasing assembly of the running tool. The lower end 20 of the body 12 includes similar threads 22 for interconnection with a sleeve which extends downward to a ball diverter. The body or sub 12 is thus part of the mandrel of the running tool, and a slick joint is not required.

As shown in FIG. 12A, an internal seal 24 and an external seal 28 are provided on the locking piston 26. Seal 24, which may be a V-packing seal, thus seals between the locking piston 26 and the body 12 and seal 28, which may also be a V-packing seal, seals between the piston 26 and the running adapter of the liner hanger 48. Retainer 30 is threadably connected to the piston 26 for holding the seals 24 and 28 in place.

Retaining member 32 is threadably connected to top cap 34 so that the one-piece C-ring 36 is positioned between the top cap 34 and the piston 26. Retaining member 32 includes a shoulder 38 for engaging shoulder 40 on the body 12. The lower flange portion 33 of the retaining member 32 and the upper end 27 of the piston 26 are each splined, so that the spline fingers are circumferentially interlaced about the packoff bushing. Flange portions 33 thus capture the lock ring 36 axially when the piston 26 is forced upward. The lock ring 36 is a unitary C-shaped ring having a circumference in excess of 200°, and normally less than about 350°, and is intended for engaging and axially locking to the liner hanger. A preferred lock ring 36 may have a circumference of from 300° to 340°, thereby providing substantially full circumferential contact with the liner hanger while allowing for radial expansion and contraction of the lock ring. The relaxed diameter of the lock ring 36 is substantially as shown in FIG. 12A. The packing retainer 30 is normally spaced axially a slight distance above the stop surface 44 on the body 12 for locking and unlocking the bushing.

When fluid is pumped downward through the liner hanger running tool, the lower end of the piston 26 is exposed to high pressure, which moves the piston 26 away from stop surface 44, as shown in FIG. 12A, so that the lock surface 46 on the end of the piston 26 retains the C-ring 36 radially outward and into locking engagement with the liner hanger to axially lock the packoff bushing to the liner hanger. The lock ring 36 thus prevents the packoff bushing from moving axially when pressure is increased during the cementing operation, while the seals 24 and 28 maintain fluid integrity between the running tool and the liner hanger.

Since the top cap 34 is axially secured to the body 12, the load shoulder 44 on the top cap 34 provides a means for transmitting forces downward to the liner hanger during the running-in and cementing operation. Shoulder 44 would thus engage shoulder 45 on the running adapter 48 of the liner hanger when a set down weight is applied to the liner hanger so that the liner hanger is "hung off". A bearing 46 may be provided to allow the running tool body 12 to rotate relative to a set packoff bushing during an emergency releasing operation. The packoff bushing may thus be reliably maintained in the locked position, with the piston 26 up and the C-ring 36 expanded, as shown in FIG. 12A, when fluid pressure is applied to the packoff bushing. Those skilled in the art should appreciate that engagement shoulders 38 and 40 allow the packoff bushing assembly 10 to be retrieved with the running tool to the surface after the cementing operation. Retrievable packoff bushing 10 as shown in FIG. 12A thus replaces the bushing shown in FIG. 1.

Figure 12B:
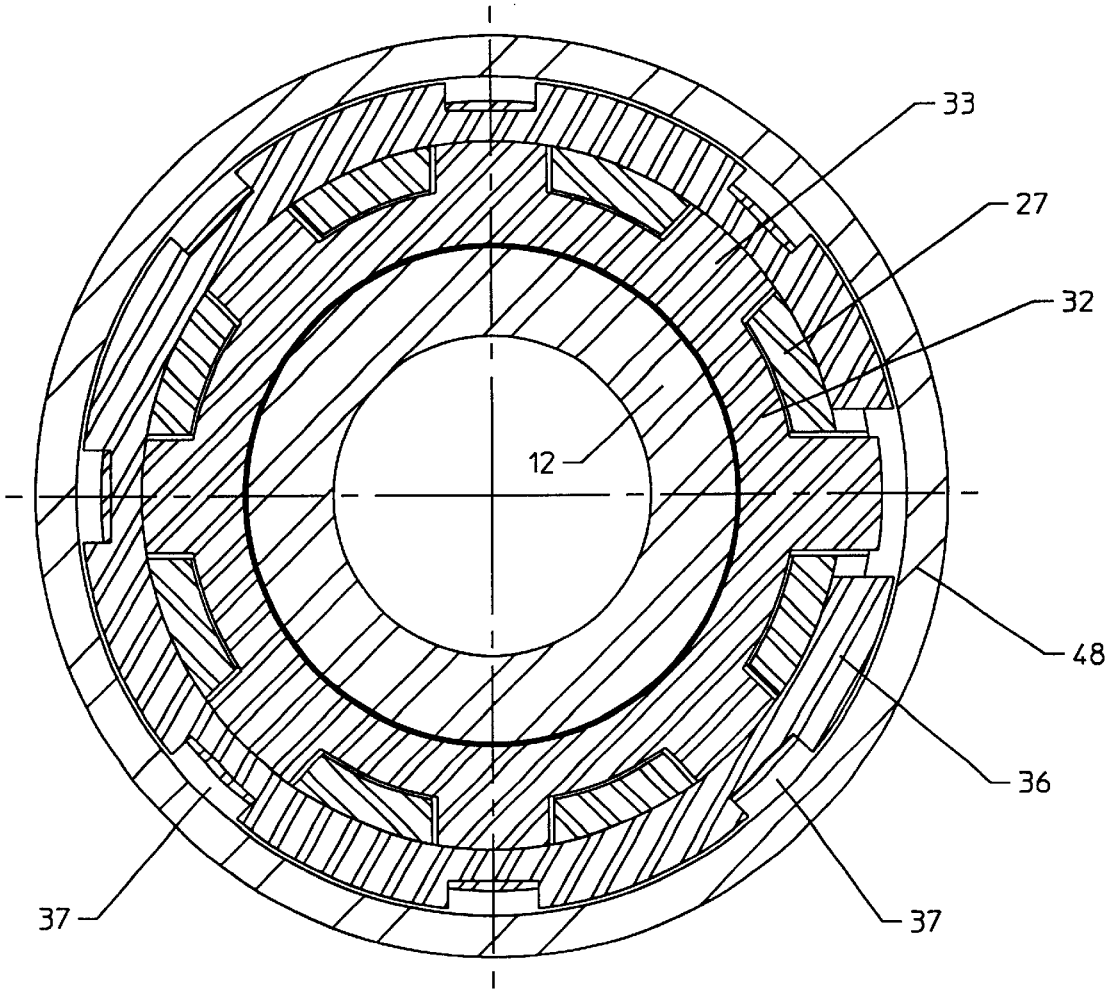
FIG. 12B is a cross-sectional view of the retrievable packoff bushing shown in FIG. 12A.

Use of the C-ring 36 rather than circumferentially spaced dogs allows high cementing pressure forces to be applied to the packoff bushing without "pumping out" the packoff bushing. As shown in FIG. 12A, an annular groove 47 in the running adapter 48 of the liner hanger receives the lock ring 36 to securely lock the packoff bushing to the liner hanger when fluid pressure is applied to the piston 26. Without fluid pressure, the C-ring 36 thus retracts radially inward toward the retaining member 32 when the lock ring 36 engages the top surface of the groove 47 as the bushing is pulled out of the liner hanger. When the bushing is re-stabbed into the liner hanger, the C-ring 36 is retracted radially inward, e.g., when the lock ring 36 engages load shoulder 45 on the liner hanger. During upward movement of the running tool relative to the liner hanger, the C-ring 36 thus may move radially inward when engaged, and may also move radially inward when the packoff bushing is re-stabbed back into the liner hanger. The C-ring design significantly increases reliability of the tool according to the present invention, and reduces both the complexity and the costs of prior art tools which use multiple lugs or dogs. FIG. 12B illustrates the splined members 27 of the piston 26 and the splined members 33 of the retaining member 32, and the C shape of the lock ring 36. External slots 37 circumferentially spaced about the C-ring 36 facilitate expansion and contraction of the C-ring.

The liner hanger running tool with the packoff bushing disclosed herein may be used on various types of liner hanger operations. The packoff bushing may be used with or without a packer setting assembly and a packer element for sealing between the liner hanger and the casing. Although the packoff bushing as disclosed herein is positioned axially between the liner hanger releasing assembly and the slip setting assembly, the packoff bushing could be provided at other locations in the liner hanger running tool.

Figure 13:
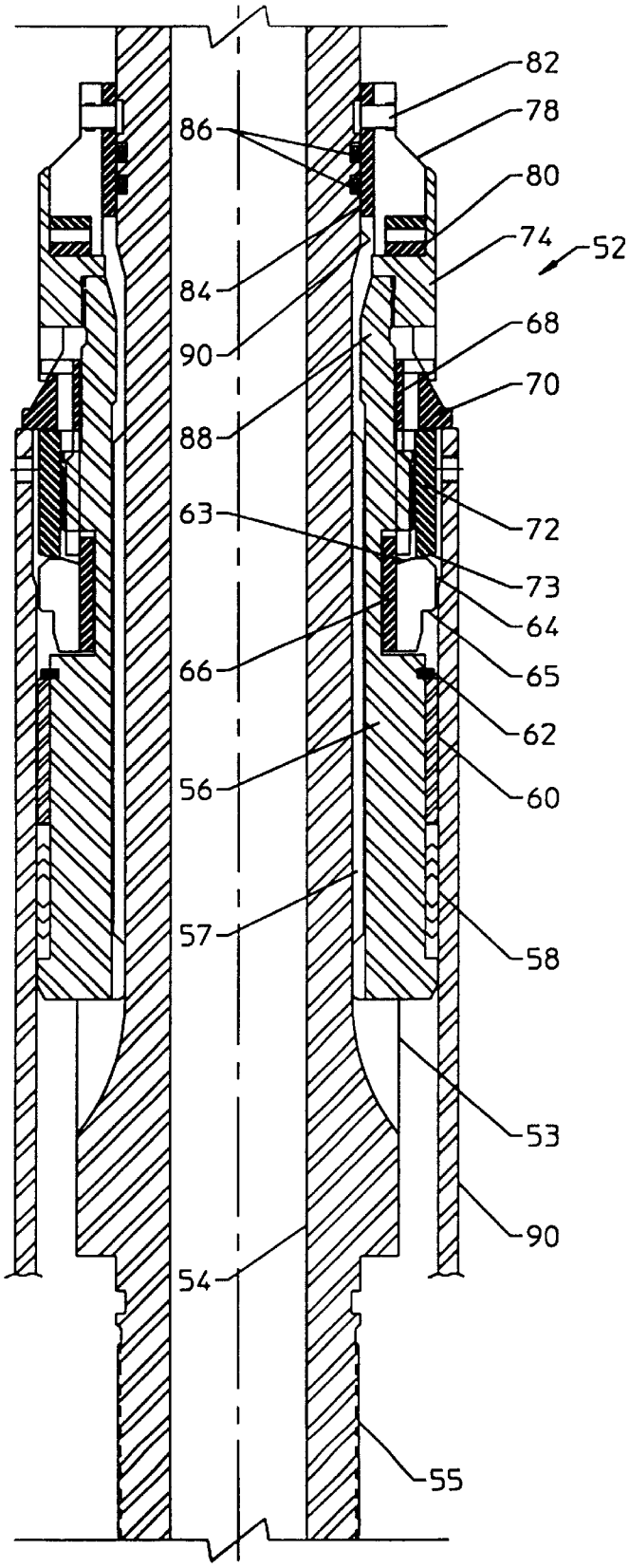
FIG. 13 is a cross-sectional view of a preferred embodiment of a packer setting assembly on a liner hanger running tool according to the present invention.

FIG. 13 Packer Setting Assembly

FIG. 13 illustrates a preferred embodiment of a packer setting assembly 52, which will allow activation and packoff of the liner top packer. The packer setting assembly is provided on the sleeve shaped body or sub 54 which is part of the mandrel of the running tool, and includes lower threads 55 for engagement with a lower sub of the mandrel. The packer setting assembly 52 includes a housing 56 carrying a V packing seal 58. Other conventional elastomeric seals may replace the V packing 58. A flow slot 53 in the body 54 ensures fluid communication with the splines or ribs 57 on the body 54, so that the housing 56 moves axially along these splines without trapping fluid pressure. Packing retainer 60 and snap ring 62 hold the V packing in place. A packer setting or force transmitting C-ring 64 is positioned on the housing 56, and includes an internal sleeve portion 66. A C-shaped trip ring or lockout ring 70 is positioned between the lock sleeve 68 and retainer cap 72. Lock sleeve 68 engages the sleeve portion 66 to retain the C-ring 64 in the compressed position as shown in FIG. 13, so that when released the C-ring 64 will snap out. A housing extension 74 is threadably secured to housing 56, and bearing 80 allows the body 54 to rotate relative to housing 56. Bearing sleeve 78 is connected to the sub 54 by shear member 82. Sleeve portion 84 of the bearing sleeve 78 engages the body 54 as shown in FIG. 13, although sealing between the body 54 and the bearing sleeve 78 is not required. Packing members 86 on the body 54 are discussed below.

The first time the packer setting assembly is moved out of the polished bore receptacle 90 (which is the same as the receptacle 130 discussed in the FIGS. 1–9 running tool), trip ring 70, which was positioned within the polished bore receptacle, will snap to a radially outward position, as shown in FIG. 13, due to the natural biasing of the C-shaped trip ring. When the packer setting assembly is subsequently reinserted into the polished bore receptacle, the trip ring 70 will engage the top of the polished bore receptacle 90 as shown in FIG. 13, and the packer setting C-ring 64 is positioned within the polished bore receptacle. When set down force is applied, housing 56 will move downward relative to lock sleeve 68, and the trip ring 70 will move radially inward due to camming action. The entire packer setting assembly may thus be lowered to bottom out on a lower portion of the running adapter prior to initiating the cementing operation. The next time the packer setting assembly is raised out of the polished bore receptacle, the radially outward biasing force of the C-ring 64 will cause the C-ring to engage the top of the polished bore receptacle of the liner hanger. More particularly, the shoulder 65 will engage the top of the polished bore receptacle 90, since the natural or released diameter of the C-ring 64 approximates the outer diameter of the receptacle 90. The flat surface 65 on the C-ring 64 thus engages the top surface of the tie back receptacle 90. In this position, the tapered surface 73 at the lower end of retainer cap 72 engages the mating tapered surface 63 of the upper end of C-ring 64, and the setting weight thus results in a radially outward force applied to the C-ring 64 to effectively lock the C-ring in the weight-transfer position, so that the C-ring will not prematurely snap radially inward before the packer is set. Once the C-ring 64 is set against the liner hanger, the body 54 may be moved downward relative to the housing 56, thereby shearing members 82.

The packer setting assembly 52 has high reliability since a substantial downward set weight may be transmitted through the C-ring 64 to the tie back receptacle, and since the mechanical setting pressure is assisted by fluid pressure between the ID of the casing and the OD of the running tool or drill pipe. After members 82 shear and body 54 moves downward relative to housing 56, the radially inward surface of projection 88 on the housing 56 is then supported on the larger diameter surface 90 of the sub 54, with packing members 86 sealing with the housing 56. A collar or similar stop on the body 54 engages the top of bearing sleeve 78 to limit downward travel of the mandrel. Seal 58 remains sealed to the tie back receptacle. After the packer setting assembly 52 is set, the increase in pressure in the annulus between the casing and the running tool allows the housing 56 to act as a piston which is forced downward in response to the annulus pressure, thereby providing increased downward force to reliably set the liner hanger packer when the packer is forced radially outward as it is pushed down the packer setting cone.

A complete running procedure for running, setting, and releasing the liner hanger system according to the present invention will now be discussed. The setting tool is conventionally attached to the lower end of a work string, typically a drill pipe, and is releasably connected to a liner hanger, which is attached to the top of the liner. The work string lowers the liner into the borehole into a position above the lower end of the previously set casing or liner. With the liner at a desired depth, well bore fluids are circulated "bottoms up" to clean the hole. A setting ball may initially be dropped from a cementing manifold at the surface. The ball may either free fall or may be pumped to the liner hanger slip setting assembly, where the ball will rest on the expandable ball seat. Fluid pressure may then be increased to a selected value, e.g. 500 psi, which exerts a force on the shear screws acting between the ball seat and the mandrel of the slip setting assembly. When this force surpasses the design limits, the screws will shear to release the ball and seat to a position that uncovers hydraulic ports in the mandrel. Continued pumping of fluid will then force the ball through the seat, and allow the ball to be pumped to the second ball seat within the releasing tool.

Fluid pressure is then increased to shear screws between the piston and the mandrel of the liner hanger setting assembly. The piston, which was exposed to pressure within the running string when the ball was first released, is responsive to fluid pressure and travels upward, thereby forcing the slips to release and come into contact with the casing. The liner load may then be slacked off onto the set slips. Once the slips are supporting the weight of the liner, the liner is "hung off".

With the liner load slacked off onto the hanger slips, additional slack off or "set down weight" may be applied to the hanger to check for any hanger movement. The set down weight will be transmitted through the running tool to the liner hanger, which is supported by the liner hanger slips. This set down weight may, for example, be transmitted through the running tool mandrel to the packoff bushing and then from the load shoulder on the packoff bushing to the liner hanger. A ball may then be landed, and the ball seat moved to expose fluid ports. Pressure may then be increased to a selected value, e.g. 1200 psi, which is transmitted through ports in the mandrel of the liner hanger releasing assembly. This increased pressure shears screws on the primary piston, thereby moving the piston to allow the liner hanger release ring to collapse and disengage the running ring from the liner hanger. At this stage, the liner hanger running tool is free from the liner hanger. Since the clutch that keys the running tool to the liner hanger is shear pinned to the releasing piston, it moves from the clutched position to an unclutched position as the piston moves up to release the running ring. The running tool is preferably released by the increase in fluid pressure acting on the primary piston. If the running tool is still engaged to the liner hanger after pressuring up on the primary releasing piston, the operator may continue to pressure the drill sting to the maximum allowable pressure checking for release in small pressure increments up to the shear pressure of the secondary piston. If the primary piston does not release the running tool from the liner hanger, continued pressure will shear the secondary piston from the primary piston and the secondary piston will move axially up to disengage the clutch of the running tool from the clutch on the liner hanger. With the clutch disengaged, the running tool may be rotated 5–6 turns to the right to disengage the running tool from the liner hanger.

The operator at this stage may pick up the running string and note the loss of liner weight on a rig weight indicator, thereby indicating that the running tool is released from the liner hanger. This pick up operation will also disengage the packoff bushing from the liner hanger running adapter or tie back receptacle. As previously indicated, the packoff bushing is designed to be re-stabbable so that the operator may pull the running tool and the packoff bushing upward as desired to check that the running tool is released from the liner hanger. After it is confirmed that the running tool is released, the packoff bushing will be re-stabbed when the running tool is slacked back off into the liner hanger. When there is pressure below the packoff bushing, the bushing is securely locked to the liner hanger.

A selected fluid pressure, e.g. 2500 psi, may then be used to shear the secondary piston from the clutch to allow the clutch to re-engage the liner hanger. Once the liner hanger running tool is released from the liner, pressure may then be applied to the ball and seat. At a predetermined pressure, e.g. 3000 psi, the ball will pass through the port isolation ball seat, expanding the diameter of the seat. The ball is forced through the seat to permanently deforming the ball seat. The drop in pressure and re-gaining fluid circulation will then indicate that the ball has successfully passed through the ball seat. The ball is then allowed to free fall or be pumped to the ball diverter.

The spacer and cement fluids may be mixed while circulating fluids for cement displacement. When the cement has been pumped, the pump down plug may be released from the surface, forming a barrier between the previously displaced cement and the displacement fluid. A calculated amount of displacement fluid may thus be used to pump the pump down plug to the liner wiper plug. As the pump down plug get close to the running tool, fluid pressure may be reduced, e.g. to about 500 psi, and this pressure will increase when the pump down plug latches in the liner wiper plug. Once the pump down plug is latched into the liner wiper plug, the work string can be pressured up and after a selected period of time, the liner wiper plug and the pump down plug will be released from the plug holder sub. Increased fluid pressure thus moves a piston to release a ring, which releases the liner wiper plug from the plug holder sub. The piston within the plug holder sub acts on a fluid with a known viscosity, and fluid flow through a predetermined size orifice will take a predetermined period of time to release the liner wiper plug. This time may be used by the operator to positively calculate displacement fluid volumes. A calculated amount of displacement fluid will thus force the cement to the desired height in the annulus between the liner and the casing. Fluid will thus be pumped until the liner wiper plug and the pump down plug set latches into the landing collar, at which time pressure may be increased to, e.g. 1000 psi, over circulating pressure to complete latching of plugs and check that the seals between the plugs and the landing collar are holding. Pressure may then be bleed off and checked for bleed back to ensure that the float equipment is holding pressure.

It should be remembered that the packer setting assembly incorporates an unlocking feature that allows the packer setting assembly to be pulled out of the liner hanger tie back receptacle one time without unlocking the packer setting ring. Upon re-stabbing the assembly into the tie back receptacle, the packer setting ring becomes armed and is ready to expand the second time the packer setting assembly is pulled out of the tie back receptacle. Accordingly, the running tool may be picked up until the packer setting assembly is removed from the tie back receptacle, which allows the trip ring to expand and engage the top of the tie back receptacle. Slacking off on the running string collapses the trip ring so that it may reenter the tie back receptacle, and moves a locking sleeve out of contact with packer setting ring. Since the C-shaped packer setting ring is compressed but is now released from the locking sleeve, the packer setting assembly is ready to be activated the next time it is pulled from the tie back receptacle. Accordingly, the running tool may be picked up sufficiently to expose the packer setting assembly, then set down weight used to set the packer element.

Once the packer setting ring is in its expanded position, drill pipe weight may be slacked off on top of the tie back receptacle. This downward force through the packer setting assembly and to the tie back receptacle initiates the packer setting sequence. This action will shear screws and allow the setting load to be transmitted to the packing element. As a load increases, the packer element will expand in OD as it moves down the cone, thereby pushing the expanding packer element out into engagement with the casing.

With the packer element in engagement with the casing, the rig rams may be closed around the drill pipe, so that a pressure vessel is formed between the casing and the running tool and between the packer element and the seals of the ram at the surface. Knowing how much load is required to properly set the packer element, a known fluid pressure can be applied to the annulus to cause the tie back receptacle to move down, thereby applying a greater and known load to the packer element. A desired setting load to the packer element may thus be applied through a combination of set down weight and fluid pressure.

After pulling the setting tool to a predetermined position above the top of the liner, fluid may be circulated through the drill string to circulate any excess cement to the surface, thereby reducing the need for drill out. Once the excess cement has been circulated out of the well, the operator may pull the setting tool from the well. Once at the surface, the tool may be checked for damage and serviced.

The tools as discussed above function as an assembly for a specific application, i.e., for the running and releasing of the liner hanger, the cementing of the liner into the wellbore and the setting of the packer element. One could run a liner hanger without a packer element and therefore the running tool would not require the packer setting assembly. Also, a packer element could be run into a wellbore without a liner hanger slip mechanism and therefore the slip releasing assembly would not be required in the running tool. Various combinations of the disclosed tools could be put together to run a variety of downhole tools.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A tool for suspending from a running string to position a liner hanger in a casing within a wellbore, suspending a liner from the liner hanger and retrieving portions of the tool, comprising:

a tool mandrel supported from the running string;

a slip setting assembly about the mandrel for setting slips to engage the casing and suspend the liner hanger from the casing; and a releasing assembly for releasing from set liner hanger portions of the tool to be retrieved to the surface, the releasing assembly including a connecting member for engaging the tool with the liner hanger, a first piston hydraulically moveable in response to fluid pressure within the tool mandrel from a lock position to a release position for releasing the connecting member, a clutch for rotationally connecting the tool mandrel with the liner hanger, and a second piston moveable in response to fluid pressure within the tool mandrel for disengaging the clutch, such that right-hand rotation of the running string moves a nut downward along the mandrel so that the running string may then be picked up to disengage the tool from the liner hanger.

2. The tool as defined in claim 1, further comprising:

a piston shear member for interconnecting the first piston and the second piston, such that the second piston may be disconnected from the first piston in response to fluid pressure within the tool mandrel.

3. The tool as defined in claim 1, further comprising:

a clutch shear member for interconnecting the second piston and the clutch, such that shearing the clutch shear member reengages the clutch with the liner hanger to permit rotation of the liner hanger with the running string.

4. The tool as defined in claim 1, further comprising:

a port in the tool mandrel for fluid communication with the first piston; and a sleeve for blocking the port, such that the increase in fluid pressure when a ball lands on a seat shifts the sleeve downward to open the port.

5. The tool as defined in claim 1, wherein the engaging member is a radially collapsible C-ring.

6. The tool as defined in claim 5, wherein the C-ring includes external threads for engagement with internal threads on the liner hanger to secure the tool to the liner hanger.

7. The tool as defined in claim 1, further comprising:

a plurality of dogs carried by the nut for fitting within slots in the liner hanger to rotationally lock the nut to the liner hanger.

8. The tool as defined in claim 1, further comprising:

a flow-through port in the first piston, such that fluid pressure within the mandrel passes through the flow-through port to act upon the second piston.

9. The tool as defined in claim 1, further comprising:

a stop on the first piston for limiting travel of the second piston.

10. The tool as defined in claim 1, wherein the first piston is a radially inner piston for sealing with the tool mandrel, and the second piston is a radially outer piston for sealing with the inner piston.

11. A tool for suspending from a running string to position a liner hanger in a casing within a wellbore, suspending a liner from the liner hanger in place and retrieving portions of the tool, comprising: a tool mandrel supported from the running string;

a slip setting assembly about the mandrel for setting slips to engage the casing and suspend the liner hanger from the casing;

a releasing assembly about the tool mandrel for releasing the liner hanger from the portions of the tool to be retrieved to the surface; and a packoff bushing for sealing between the liner hanger and the tool mandrel, including a radially moveable locking member and a fluid pressure responsive piston moveable in response to fluid pressure within the tool mandrel between a release position whereby the packoff bushing may be removed from the liner hanger and reinserted into the liner hanger, and a lock position for retaining the locking member in a groove in the liner hanger to lock the packoff bushing to the liner hanger.

12. The tool as defined in claim 11, wherein the radially moveable locking member comprises a C-shaped lock ring.

13. The tool as defined in claim 12, wherein the C-shaped lock ring includes radially external slots for facilitating expansion and contraction of the lock ring.

14. The tool as defined in claim 12, wherein the C-shaped lock ring has a circumference from 200°–350°.

15. The tool as define in claim 12, wherein the lock ring retracts when engaging a shoulder on the liner hanger, thereby allowing the lock ring to be reinserted into the liner hanger after being raised above the liner hanger.

16. The tool as defined as claim 11, wherein the piston is axially moveable with respect to the tool mandrel to move the locking member to the lock position in response to fluid pressure within the tool mandrel.

17. The tool as defined in claim 11, wherein the packoff bushing comprises:

a radially internal seal for sealing between the piston and the mandrel; and a radially external seal for sealing between the piston and the liner hanger.

18. The tool as defined in claim 11, wherein the packoff bushing includes a radially outer shoulder for engaging a radially inner shoulder on the liner hanger for applying set down weight to the liner hanger.

19. The tool as defined in claim 11, wherein the packoff bushing includes a radially inner shoulder, and the tool mandrel includes a radially outer shoulder, such that the engagement of the inner shoulder and outer shoulder allow the packoff bushing to be retrieved with the retrieving portions of the tool.

20. The tool as defined in claim 11, further comprising:

a packer setting assembly about the tool mandrel for setting a packer to seal between the casing and the liner hanger.

21. A packer setting assembly for setting a radial set packer element, the packer setting assembly applying a force on one of the packer element and a cone to move the packer element relative to the cone, the packer setting assembly comprising:

a radially expandable force transmitting C-ring, the force transmitting C-ring when expanded acting to engage a setting sleeve for applying a set-down weight through the setting sleeve to set the radial set packer element.

22. The packer setting assembly as defined in claim 21, further comprising:

a lockout mechanism for preventing the force transmitting C-ring from moving to the expanded position.

23. The packer setting assembly as defined in claim 22, wherein the lockout mechanism includes a lockout C-ring for radially expanding to engage a top of the liner and thereby disengage the lockout mechanism.

24. The packer setting assembly as defined in claim 22, further comprising:

the lockout mechanism moves from an expanded position to a retracted position due to a camming surface on a housing of the packer setting assembly, thereby releasing the force transmitting C-ring.

25. The packer setting assembly as defined in claim 22, wherein the lockout mechanism moves axially to release the force transmitting C-ring.

26. The packer setting assembly as defined in claim 21, further comprising:

a lock-out mechanism for allowing the force transmitting C-ring to be raised out of the top of a liner hanger one time without moving the force transmitting C-ring to the expanded position, such that the next time the force transmitting C-ring is moved out of the liner hanger, the force transmitting C-ring expands to its expanded position for engagement with the liner hanger.

27. The packer setting assembly as defined in claim 21, further comprising:

a packer setting housing;

an I.D. seal for sealing between a packer mandrel and the packer setting housing; and an O.D. seal for sealing with between the setting sleeve and the packer setting housing, such that fluid pressure may be used to assist in applying a setting force through to the setting sleeve to the packer element.

28. The packer setting assembly as defined in claim 21, further comprising:

a packer setting housing about a mandrel; and a bearing for facilitating rotation of the mandrel relative to the housing.

29. The packer setting assembly as defined in claim 21, wherein the radial set packer element includes a metal radially inward base and one or more radially outer seal bodies.

30. The packer setting assembly as defined in claim 21, wherein the setting sleeve acts on the packer element of a liner hanger to seal between the liner hanger and a casing.

31. A method of releasing a running tool while supported on a running string from a liner hanger in a casing within a wellbore, the liner hanger being secured to a casing by a slip assembly to suspend the liner hanger from the casing, the method comprising:

providing a releasing assembly about a tool mandrel, the releasing assembly including a connecting member for engaging the running string with the liner hanger, a first piston hydraulically moveable in response to fluid pressure within the tool mandrel from a lock position to a release position for releasing the connecting member, a clutch for rotationally connecting the tool mandrel with the liner hanger, and a second piston moveable in response to fluid pressure within the tool mandrel for disengaging the clutch; and pressurizing the running string to move the first piston to the release position for releasing the running string.

32. The method as defined in claim 31, further comprising:

pressurizing the running string to move the second piston to disengage the clutch;

rotating the running string to move a nut downward along the tool mandrel; and thereafter picking up the running string to disengage the running tool from the liner hanger.

33. The method as defined in claim 31, further comprising:

shearably interconnecting the first piston and the second piston, such that the second piston may be disconnected from the first piston in response to fluid pressure within the tool mandrel.

34. The method as defined in claim 31, further comprising:

shearably interconnecting the second piston and the clutch, such that shearing a clutch shear member re-engages the clutch to permit rotation of the liner hanger with the running string.

35. The method as defined in claim 31, further comprising:

providing a port in the tool mandrel for fluid communication with the first piston; and blocking the port with a sleeve, such that the increase in fluid pressure when a ball lands on a seat shifts the sleeve downward to open the port.

36. The method as defined in claim 31, wherein the connecting member is formed to be a radially collapsible C-ring.

37. The method as defined in claim 31, further comprising:

providing a plurality of dogs carried by a nut for fitting within slots in the liner hanger to rotationally lock the nut to the liner hanger.

38. The method as defined in claim 31, further comprising:

providing a flow-through port in the first piston, such that fluid pressure within the tool mandrel passes through the flow-through port to act upon the second piston.

39. The method as defined in claim 31, further comprising:

providing a stop on the first piston for limiting travel of the second piston.

40. The method as defined in claim 31, wherein the first piston is a radially inner piston for sealing with the tool mandrel, and the second piston is a radially outer piston for sealing with the inner piston.

41. A method of sealing between a liner hanger suspended in a casing within a wellbore and supporting a tool mandrel from a running string, the method comprising:

providing a packoff bushing for sealing between the liner hanger and the tool mandrel, the packoff bushing including a radially moveable locking member and a fluid pressure responsive piston;

moving the piston in response to fluid pressure within the tool mandrel between a release position whereby the packoff bushing may be removed from the liner hanger and reinserted into the liner hanger, and a lock position for retaining the locking member in a groove in the liner hanger to lock the packoff bushing to the liner hanger.

42. The method as defined in claim 41, further comprising:

forming the radially moveable locking member to have a C-shaped lock ring configuration.

43. The method as define in claim 42, wherein the lock ring retracts when engaging a shoulder on the liner hanger, thereby allowing the lock ring to be reinserted into the liner hanger after being raised above the liner hanger.

44. The method as defined as claim 41, wherein the piston is axially moveable with respect to the tool mandrel to move the locking member to the lock position in response to fluid pressure within the tool mandrel.

45. The method as defined in claim 41, further comprising:

providing a radially internal seal for sealing between the piston and the mandrel; and providing a radially external seal for sealing between the piston and the liner hanger.

46. The method as defined in claim 41, further comprising:

providing a radially outer shoulder on the packoff bushing for engaging a radially inner shoulder on the liner hanger when the locking member is aligned with the groove in the liner hanger for applying set down weight through the radially outer shoulder to the liner hanger.

47. The method as defined in claim 41, further comprising:

providing a radially inner shoulder on the packoff bushing;

providing a radially outer shoulder on the tool mandrel; and engaging of the inner shoulder and outer shoulder to retrieve the packoff bushing to the surface.

48. The method as defined in claim 41, further comprising:

providing a packer setting assembly about the tool mandrel for setting a packer to seal between the casing and the liner hanger.

49. A method of setting a radial set packer element by applying a force on one of the packer element and a cone to move the packer element relative to the cone, the method comprising:

providing a radially expandable force transmitting C-ring;

expanding the force transmitting C-ring to engage a setting sleeve; and applying a set-down weight through the setting sleeve to set the radial set packer element.

50. The method as defined in claim 49, further comprising:

providing a lockout mechanism for preventing the force transmitting C-ring from moving to the expanded position.

51. The method as defined in claim 50, further comprising:

engaging the lock out mechanism with a top of the liner hanger to release the force transmitting C-ring.

52. The packer setting assembly as defined in claim 51, further comprising:

providing a C-ring lockout mechanism;

moving the C-ring lockout mechanism from an expanded position to a retracted position by applying set down weight to the C-ring lockout mechanism due to a camming surface on a housing of the packer setting assembly, thereby releasing the force transmitting C ring.

53. The method as defined in claim 50, wherein the lockout mechanism moves axially to release the force transmitting C-ring.

54. The method as defined in claim 49, further comprising:

allowing the force transmitting C-ring to be raised out of the top of a liner hanger one time without moving the force transmitting C-ring to the expanded position, such that the next time the force transmitting C-ring is moved out of the liner hanger, the force transmitting C-ring expands to its expanded position for engagement with the liner hanger.

55. The method as defined in claim 50, further comprising:

providing a packer setting housing;

providing an I.D. seal for sealing between a packer mandrel and the packer setting housing; and providing an O.D. seal for sealing with between the setting sleeve and the packer setting housing, such that fluid pressure assists in applying a setting force to the setting sleeve.

56. The method as defined in claim 49, wherein the radial set packer element includes a metal radially inward base and one or more radially outer seal bodies.

57. A system for sealing between a liner and a running string in a well, including a liner hanger for securing the liner in the well the liner hanger including a profile for cooperation with a running tool to limit axial movement of the running tool with respect to the liner hanger, the running tool comprising:

a seal body supported on the running string for sealing between the liner hanger and the running tool;

a C-ring for engagement with the profile on the liner hanger for limiting axial movement of the seal body with respect to the liner hanger; and a fluid pressure responsive piston moveable relative to the seal body for moving the C-ring from an unlocked position to a locked position.

58. A system as defined in claim 57, wherein the fluid pressure responsive piston and the C-ring cooperate to enable the running tool to be repeatedly lifted above an upper end of the liner hanger and thereafter restabbed into the liner hanger.

59. A system as defined in claim 57, wherein the seal body includes a shoulder for engagement with a retrieving surface on the running tool for retrieving the seal body with the running tool to the surface.

60. A system as defined in claim 57, wherein the seal body forms a portion of a mandrel of the running tool.

61. A system as defined in claim 57, wherein C-ring has a circumferential length of from 300° to 340°.

62. A system as defined in claim 57, wherein the profile on the liner hanger comprises a groove extending radially outward from a radially inner surface of the liner hanger, and the C-ring fits within the groove to limit axial movement of the seal body with respect to the liner hanger.

63. A system as defined in claim 57, further comprising:

a bearing for facilitating rotation of the running tool relative to the seal body.

64. A system as defined in claim 57, further comprising:

a liner hanger packer for sealing between the liner hanger and a casing radially outward of the liner hanger.

65. A system as defined in claim 57, wherein the C-ring is biased radially inward, such that the seal ring is normally radially retracted.

66. A system as defined in claim 57, wherein the piston is rotatably locked to the seal body.

67. A system as defined in claim 57, wherein the C-ring includes radially extending slots for facilitating expansion and contraction of the C-ring.

68. A liner hanger running tool for running a liner into a well from a running string, including a packer setting assembly for setting a compression set liner top packer by applying a setting force to one of a packer element and a cone to move the packer element relative to the cone, the running tool further comprising:

a packer setting sub secured to the running tool; and a radially expandable C-ring for radially moving from an inactive position to a set position, such that in the set position the C-ring transfers the packer setting force for setting the liner top packer.

69. A liner hanger running tool as defined in claim 68, further comprising:

a shear indicator for providing visual confirmation at the surface that the C-ring has moved a packer setting sleeve to the set position.

70. A liner hanger running tool as defined in claim 68, wherein the packer setting sub is a sleeve-shaped member forming a portion of a running tool mandrel.

71. A liner hanger running tool as defined in claim 70, further comprising:

a bearing assembly for facilitating the rotation of the packer setting sub relative to the sleeve-shaped member forming the portion of a running tool mandrel.

72. A liner hanger running tool as defined in claim 68, further comprising:

a lock-out member for preventing the C-ring from prematurely moving radially inward to the set position.

73. A liner hanger running tool as defined in claim 68, wherein the packer setting sub supports an inner diameter seal for sealed engagement with the packer setting sub and a fluid responsive piston, and an outer diameter seal for sealing engagement with the liner and the piston, such that the fluid responsive piston provides an axial force to assist in setting the liner top packer.

74. A liner hanger running tool as defined in claim 68, wherein the liner hanger running tool initially positions the C-ring within the liner, and the subsequent axial movement of the C-ring above the liner moves the C-ring radially outward, such that when a downward force is subsequently applied to the running tool, the expanded diameter C-ring engages the liner to set the liner top packer.

75. A liner hanger running tool as defined in claim 68, further comprising:

an unlocking assembly for positioning within the liner and for releasing the C-ring radially outward to the set position the first time the running tool is moved upward, such that the C-ring thereafter stays above an engaging surface on the liner.

76. A liner hanger running tool as defined in claim 75, wherein the unlocking assembly includes a trip ring moving radially inward while a packer setting sleeve moves axially downward relative to both the C-ring and the liner hanger.

77. A liner hanger running tool as defined in claim 76, wherein the unlocking assembly comprises:

a locking ring radially moveable from a stop position to a release position, such that in the stop position the locking ring retains the trip ring in a compressed position, and axial movement of the locking ring to a release position releases the trip ring to an expanded position.

78. A liner hanger running tool as defined in claim 68, wherein the C-ring is biased radially outward.

79. A liner hanger running tool as defined in claim 68, when the packer setting sub is positioned axially between a liner hanger releasing assembly and a liner hanger slip setting assembly.

80. A method of sealing between a liner and a running string by sealing between a liner hanger at the upper end of the liner and a running tool supported on the running string, the method comprising:

lowering a pack off bushing supported on the running tool into the liner hanger;

thereafter lifting the running tool upward such that the pack off bushing is above a sealing surface on the liner hanger; and therefore reinserting at least a portion of the running tool including the pack off bushing into the interior of the liner hanger to seal the pack off bushing between the liner hanger and the running tool.

* * * * *